US009133569B2

(12) United States Patent
Kanaya

(10) Patent No.: US 9,133,569 B2
(45) Date of Patent: Sep. 15, 2015

(54) MAT, METHOD OF MANUFACTURING MAT, AND EXHAUST GAS PURIFICATION APPARATUS

(75) Inventor: Masaki Kanaya, Ogaki (JP)

(73) Assignee: IBIDEN CO., LTD., Ogaki-shi (JP)

( * ) Notice: Subject to any disclaimer, the term of this patent is extended or adjusted under 35 U.S.C. 154(b) by 0 days.

(21) Appl. No.: 13/338,145

(22) Filed: Dec. 27, 2011

(65) Prior Publication Data

US 2012/0159914 A1 Jun. 28, 2012

(30) Foreign Application Priority Data

Dec. 28, 2010 (JP) ..... 2010-293616

(51) Int. Cl.
*D04H 1/46* (2012.01)
*D04H 1/4209* (2012.01)
*F01N 3/28* (2006.01)

(52) U.S. Cl.
CPC ..... *D04H 1/4209* (2013.01); *D04H 1/46* (2013.01); *F01N 3/2864* (2013.01); *Y10T 428/249922* (2015.04)

(58) Field of Classification Search
CPC ..... D04H 5/02; D04H 1/4209; D04H 1/46; F01N 3/2864; Y10T 428/249922
USPC ..... 428/102; 55/502; 28/107
See application file for complete search history.

(56) References Cited

U.S. PATENT DOCUMENTS 3,112,548 A * 12/1963 Smith, II ..... 28/108
3,859,698 A * 1/1975 Okamoto et al. ..... 28/115
2001/0000500 A1* 4/2001 Meng et al. ..... 442/409
2009/0087352 A1* 4/2009 Okabe ..... 422/177
2009/0272600 A1* 11/2009 Okabe et al. ..... 181/227

FOREIGN PATENT DOCUMENTS

| | | |
|---|---|---|
| CN | 101429886 | 5/2009 |
| CN | 101571066 | 11/2009 |
| EP | 1840346 | 10/2007 |
| EP | 2113642 | 11/2009 |
| JP | 62-56348 | 3/1987 |
| JP | 09-000946 | 1/1997 |
| JP | 2001-65337 | 3/2001 |
| JP | 2007-292040 | 11/2007 |
| JP | 2009-113336 | 5/2009 |
| WO | WO 00/27622 | 5/2000 |

* cited by examiner

*Primary Examiner* — Aaron Austin
*Assistant Examiner* — Laura Figg
(74) *Attorney, Agent, or Firm* — Mori & Ward, LLP

(57) ABSTRACT

A mat includes inorganic fibers, a first main surface, a second main surface, a first interlaced part group and a second interlaced part group. The first interlaced part group includes a plurality of first interlaced parts arranged in rows. Each of the plurality of first interlaced parts is formed from a point on the first main surface to a point present between the first main surface and the second main surface. The second interlaced part group includes a plurality of second interlaced parts arranged in rows. Each of the plurality of second interlaced parts is formed from a point on the second main surface to a point present between the first main surface and the second main surface. A direction of rows formed by the first interlaced part group and a direction of rows formed by the second interlaced part group are different from each other.

12 Claims, 23 Drawing Sheets

BACKGROUND ART

Interlaced parts are formed in the X-direction
(Holding sealing material X)

Interlaced parts are formed in the Y-direction
(Holding sealing material Y)

BACKGROUND ART

Punching out of holding sealing material Y

Punching out of holding sealing material X

BACKGROUND ART

BACKGROUND ART

BACKGROUND ART

A-A line cross-sectional view

B-B line cross-sectional view

C-C line cross-sectional view

D-D line cross-sectional view

E-E line cross-sectional view

F-F line cross-sectional view

G-G line cross-sectional view

H-H line cross-sectional view

I-I line cross-sectional view

J-J line cross-sectional view

MAT, METHOD OF MANUFACTURING MAT, AND EXHAUST GAS PURIFICATION APPARATUS

CROSS-REFERENCE TO RELATED APPLICATIONS

The present application claims priority under 35 U.S.C. §119 to Japanese Patent Application 2010-293616, filed on Dec. 28, 2010, the contents of which are incorporated herein by reference in their entirety.

BACKGROUND OF THE INVENTION

1. Field of the Invention

The present invention relates to a mat, a method of manufacturing a mat, and an exhaust gas purification apparatus.

2. Discussion of the Background

Conventionally, a nonwoven fabric-like mat obtained by compacting inorganic fibers such as silica fibers or alumina fibers has been known and this nonwoven fabric-like mat is excellent in properties such as heat resistance and elasticity (repulsive force), and therefore has been employed for various uses.

For example, a nonwoven fabric-like mat is used as a constituent material of an exhaust gas purification apparatus.

To explain specifically, a common exhaust gas purification apparatus is constituted by a column-like exhaust gas treatment body, a cylindrical casing for housing the exhaust gas treatment body, and a mat-like holding seal material disposed between the exhaust gas treatment body and the casing, and the nonwoven fabric-like mat is used as a material constituting the holding seal material.

The holding seal material is produced through a cutting step of cutting a nonwoven fabric-like mat into a prescribed shape.

Generally, of end surfaces of a holding seal material parallel to each other in the width direction, projected portions are formed in one end surface and recessed portions with a shape to be fitted with the projected portions when the holding seal material is wound on the column-like exhaust gas treatment body and the end surfaces are brought into contact with each other are formed in the other end surface (see FIGS. 1A and 1B).

When the holding seal material is disposed between the exhaust gas treatment body and the casing, the holding seal material is wound on the outer circumference of the exhaust gas treatment body in such a manner that the projected portions and the recessed portions are fitted with each other.

The holding seal material constituted by a nonwoven fabric-like mat having repulsive force has a prescribed holding force. Therefore, in the exhaust gas purification apparatus, the exhaust gas treatment body is firmly held in a prescribed position in the casing by the holding seal material. Further, since the holding seal material is disposed between the exhaust gas treatment body and the casing, the exhaust gas treatment body is hardly brought into contact with the casing even when vibration or the like is applied, and moreover, exhaust gas hardly leaks between the exhaust gas treatment body and the casing.

As a mat to be used as such a holding seal material, JP-A 9-946 discloses a binder mat produced by impregnating mat made from alumina fibers with an organic binder solution, subjecting the mat to a drying step, and carrying out hot air drying of the mat in a compacted state.

The produced binder mat is cut into a prescribed shape to produce a holding seal material.

Also, conventionally, a technique of carrying out needling treatment for a substrate mat made from inorganic fibers has been known. The needling treatment means pushing and pulling a fiber-interlacing means such as a needle or the like in and out the substrate mat. The inorganic fibers are interlaced three-dimensionally by carrying out the needling treatment, so that the shape of the mat can be maintained.

JP-A 62-56348, JP-A 2007-292040 and JP-A 2001-65337 disclose such needling treatment.

JP-A 62-56348 discloses execution of barb-needling treatment of pushing and pulling a barb needle having a plurality of barbs in and out in the thickness direction of a precursor sheet obtained by compacting alumina fiber precursors.

A mat disclosed in JP-A 2007-292040 is produced by adjusting the density range of an interlaced part formed by needling treatment. Accordingly, it aims to optimize both properties of strength and repulsive force.

JP-A 2001-65337 discloses a holding seal material in which interlaced parts formed by needling treatment are arranged in rows.

The contents of JP-A 9-946, JP-A 62-56348, JP-A 2007-292040 and JP-A 2001-65337 are incorporated herein by reference in their entirety.

SUMMARY OF THE INVENTION

According to one aspect of the present invention, a mat includes inorganic fibers, a first main surface, a second main surface, a first interlaced part group and a second interlaced part group. The first interlaced part group includes a plurality of first interlaced parts arranged in rows. Each of the plurality of first interlaced parts is constituted by interlacing the inorganic fibers with one another and formed from a point on the first main surface to a point present between the first main surface and the second main surface. The second interlaced part group includes a plurality of second interlaced parts arranged in rows. Each of the plurality of second interlaced parts is constituted by interlacing the inorganic fibers with one another and formed from a point on the second main surface to a point present between the first main surface and the second main surface. A direction of rows formed by the first interlaced part group and a direction of rows formed by the second interlaced part group are different from each other.

According to another aspect of the present invention, a method of producing a mat containing inorganic fibers includes preparing a precursor sheet having a first main surface and a second main surface. Needles are inserted from a respective plurality of points arranged in rows and present on the first main surface to points present between the first main surface and the second main surface. Needles are inserted from a respective plurality of points arranged in rows and present on the second main surface to points present between the first main surface and the second main surface. A direction of rows formed by the plurality of the points on the first main surface in which the needles are inserted and a direction of rows formed by the plurality of the points on the second main surface in which the needles are inserted are different from each other.

According to further aspect of the present invention, a method of producing a mat containing inorganic fibers includes preparing a first mat before lamination and a second mat before lamination. The first mat before lamination has a main surface $\alpha$, a main surface $\beta$, a first interlaced part group including a plurality of first interlaced parts arranged in rows. Each of the plurality of first interlaced parts is constituted by interlacing the inorganic fibers with one another and formed from a point on the main surface $\alpha$ toward the main surface $\beta$.

The second mat before lamination has a main surface γ, a main surface δ, and a second interlaced part group including a plurality of second interlaced parts arranged in rows. Each of the plurality of second interlaced parts is constituted by interlacing the inorganic fibers with one another and formed from a point on the main surface γ toward the main surface δ. The first mat before lamination and the second mat before lamination are laminated so that the main surface β of the first mat before lamination and the main surface δ of the second mat before lamination contact each other in such a manner that a direction of the rows formed by the first interlaced part group and a direction of the rows formed by the second interlaced part group are different from each other.

According to further aspect of the present invention, an exhaust gas purification apparatus includes an exhaust gas treatment body, a casing to house the exhaust gas treatment body, and a holding sealing material to hold the exhaust gas treatment body, which is disposed between the exhaust gas treatment body and the casing. The holding sealing material includes a first interlaced part group and a second interlaced part group. The first interlaced part group includes a plurality of first interlaced parts arranged in rows. Each of the plurality of first interlaced parts is constituted by interlacing the inorganic fibers with one another and formed from a point on the first main surface to a point present between the first main surface and the second main surface. The second interlaced part group includes a plurality of second interlaced parts arranged in rows. Each of the plurality of second interlaced parts is constituted by interlacing the inorganic fibers with one another and formed from a point on the second main surface to a point present between the first main surface and the second main surface. A direction of rows formed by the first interlaced part group and a direction of rows formed by the second interlaced part group are different from each other.

According to further aspect of the present invention, an exhaust gas purification apparatus includes an exhaust gas treatment body, a casing to house the exhaust gas treatment body, and a holding sealing material to hold the exhaust gas treatment body, which is disposed between the exhaust gas treatment body and the casing. The holding sealing material includes a mat containing inorganic fibers. The mat is produced by a method which includes preparing a precursor sheet having a first main surface and a second main surface. Needles are inserted from a respective plurality of points arranged in rows and present on the first main surface to points present between the first main surface and the second main surface. Needles are inserted from a respective plurality of points arranged in rows and present on the second main surface to points present between the first main surface and the second main surface. A direction of rows formed by the plurality of the points on the first main surface in which the needles are inserted and a direction of rows formed by the plurality of the points on the second main surface in which the needles are inserted are different from each other.

According to further aspect of the present invention, an exhaust gas purification apparatus includes an exhaust gas treatment body, a casing to house the exhaust gas treatment body, and a holding sealing material to hold the exhaust gas treatment body, which is disposed between the exhaust gas treatment body and the casing. The holding sealing material includes a mat containing inorganic fibers. The mat is produced by a method which includes preparing a first mat before lamination and a second mat before lamination. The first mat before lamination has a main surface α, a main surface β, a first interlaced part group including a plurality of first interlaced parts arranged in rows. Each of the plurality of first interlaced parts is constituted by interlacing the inorganic fibers with one another and formed from a point on the main surface α toward the main surface β. The second mat before lamination has a main surface γ, main surface δ, and a second interlaced part group including a plurality of second interlaced parts arranged in rows. Each of the plurality of second interlaced parts is constituted by interlacing the inorganic fibers with one another and formed from a point on the main surface γ toward the main surface δ. The first mat before lamination and the second mat before lamination are laminated so that the main surface β of the first mat before lamination and the main surface δ of the second mat before lamination contact each other in such a manner that a direction of the rows formed by the first interlaced part group and a direction of the rows formed by the second interlaced part group are different from each other.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1A:
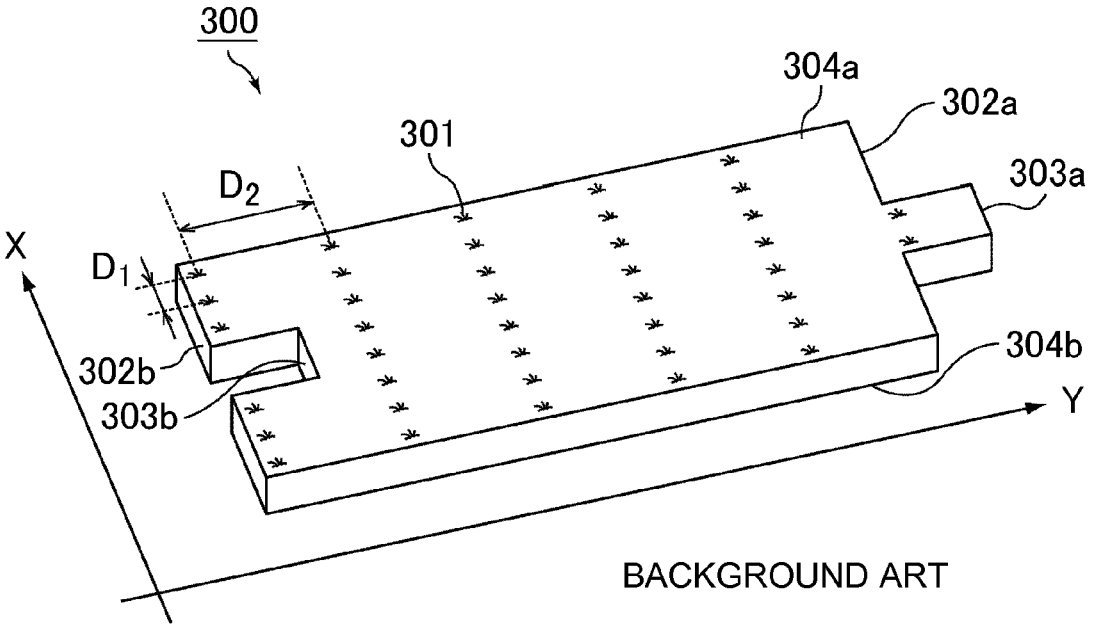
FIG. 1A and FIG. 1B are perspective views schematically showing one example of a conventional holding seal material.

The embodiments will now be described with reference to the accompanying drawings, wherein like reference numerals designate corresponding or identical elements throughout the various drawings.

In JP-A 2001-65337, two directions are shown as directions of rows formed by the interlaced part. In the present description, these two directions are referred to as X-direction and Y-direction.

Herein, the X-direction and the Y-direction will be described.

Figure 1B:
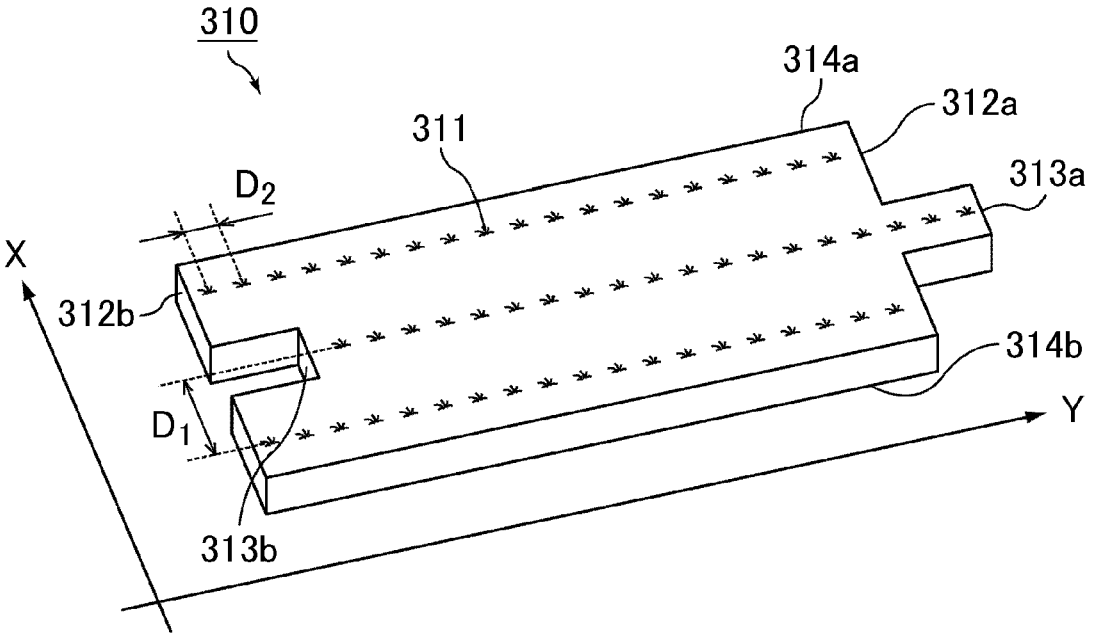
BACKGROUND ART FIG.1B

FIG. 1A and FIG. 1B are perspective views schematically showing one example of a conventional holding seal material (JP-A 2001-65337).

In a conventional holding seal material 300 shown in FIG. 1A, rows of interlaced parts 301 are formed in the X-direction. In the present description, the case where "rows are formed in the X-direction" is the case where a distance D1 of two neighboring interlaced parts 301 in the X-direction is narrower than a distance D2 of the two neighboring interlaced parts 301 in the Y-direction.

On the other hand, in the conventional holding seal material 310 shown in FIG. 1B, rows of interlaced parts 311 are formed in the Y-direction. In the present description, the case where "rows are formed in the Y-direction" is the case where the distance D2 of the two neighboring interlaced parts 311 in the Y-direction is narrower than the distance D1 of the two neighboring interlaced parts 311 in the X-direction.

Additionally, the X-direction is a direction perpendicular to the rounded surface direction of the exhaust gas treatment body in the case where the holding seal material is disposed between the exhaust gas treatment body and the casing. That is, the X-direction is a direction parallel to the longitudinal direction of the exhaust gas treatment body. The Y-direction is a direction parallel to the rounded surface direction of the exhaust gas treatment body in the case where the holding seal material is disposed between the exhaust gas treatment body and the casing. That is, the Y-direction is a direction perpendicular to the longitudinal direction of the exhaust gas treatment body.

In the present description, a holding seal material in which rows of interlaced parts are formed in the X-direction (the conventional holding seal material 300 shown in FIG. 1A) may be also referred to as a holding seal material X. In addition, a holding seal material in which rows of interlaced parts are formed in the Y-direction (the conventional holding seal material 310 shown in FIG. 1B) may be also referred to as a holding seal material Y.

Figure 2A:
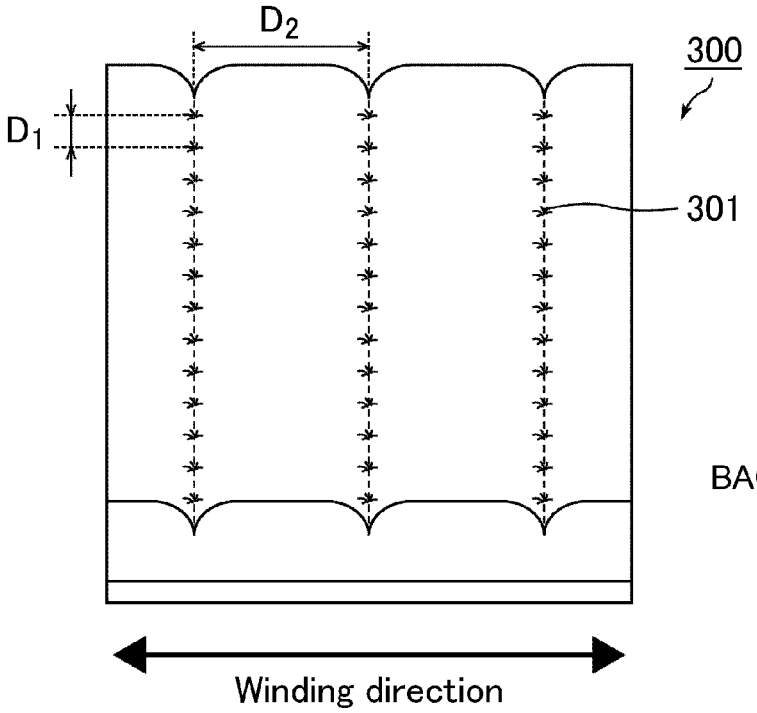
FIG. 2A is an explanatory view schematically showing a portion of a conventional holding seal material X.

FIG. 2A is an explanatory view schematically showing a portion of a conventional holding seal material X.

Figure 2B:
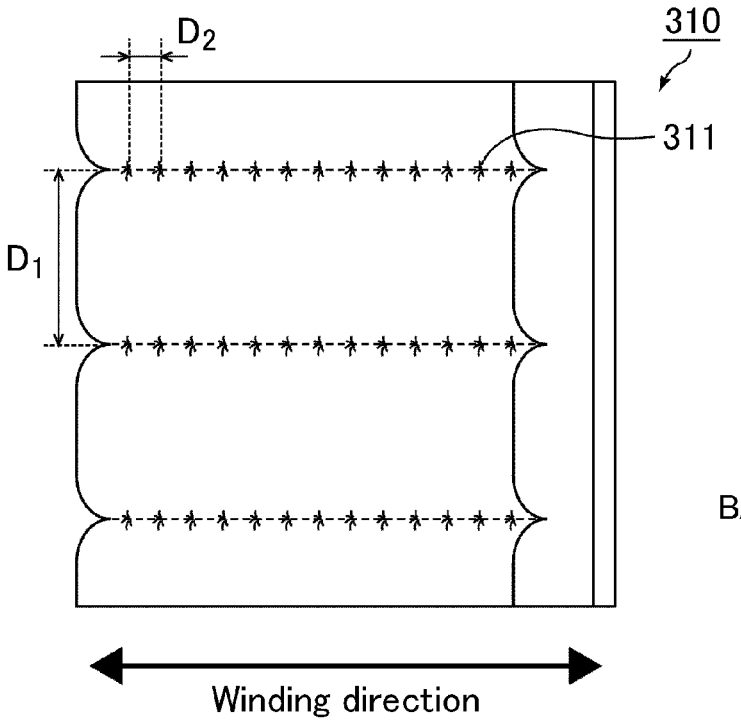
BACKGROUND ART FIG.2B
FIG. 2B is an explanatory view schematically showing a portion of a conventional holding seal material Y.

FIG. 2B is an explanatory view schematically showing a portion of a conventional holding seal material Y.

In the conventional holding seal material X, interlaced parts 301 are arranged so as to form rows in the X-direction. FIG. 2A shows this appearance by dotted lines.

In the conventional holding seal material Y, interlaced parts 311 are arranged so as to form rows in the Y-direction. FIG. 2B shows this appearance by dotted lines.

Each of the conventional holding seal material X shown in FIG. 1A and the conventional holding seal material Y shown in FIG. 1B has a first main surface (304*a* and 314*a*) as well as a second main surface (304*b* and 314*b*) in the reverse position to the first main surface (304*a* and 314*a*). The holding seal material X has the interlaced parts 301 arranged so as to form rows in the X-direction in both of the first main surface side and the second main surface side. Also, the conventional holding seal material Y has the interlaced parts 311 arranged so as to form rows in the Y-direction in both of the first main surface side and the second main surface side.

The interlaced parts 301 in the conventional holding seal material X are formed relatively more densely in the X-direction. Attributed to this, in the case where an operation of winding the holding seal material on the outer circumference of the exhaust gas treatment body is carried out, folding lines are formed by a plurality of the interlaced parts 301 arranged in the X-direction and therefore, the winding operation is made easy to carry out.

In contrast, the interlaced parts 311 in the conventional holding seal material Y are formed relatively more densely in the Y-direction.

Further, in the conventional holding seal material Y, at the time of winding the holding seal material on the outer circumference of the exhaust gas treatment body, the interlaced parts 311 are formed with high density in the direction in which the holding seal material is extended (that is, in the Y-direction). Consequently, many portions in which fibers are interlaced are present in the direction in which the holding seal material is extended and therefore, the holding seal material is hardly extended and cut.

In contrast, in the conventional holding seal material X, at the time of winding the holding seal material on the outer circumference of the exhaust gas treatment body, the interlaced parts 301 are formed with high density in the X-direction, different from the direction in which the holding seal material is extended (that is, the Y-direction).

Figure 3A:
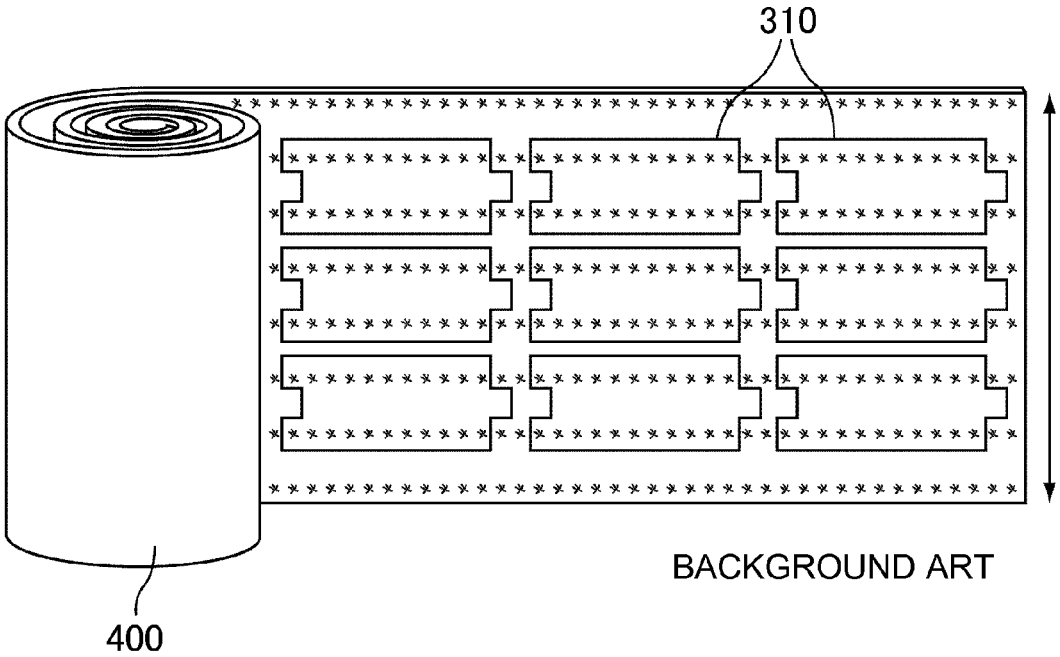
FIG. 3A and FIG. 3B are explanatory views schematically showing the condition of punching out a conventional mat to give a holding seal material.
Figure 3B:
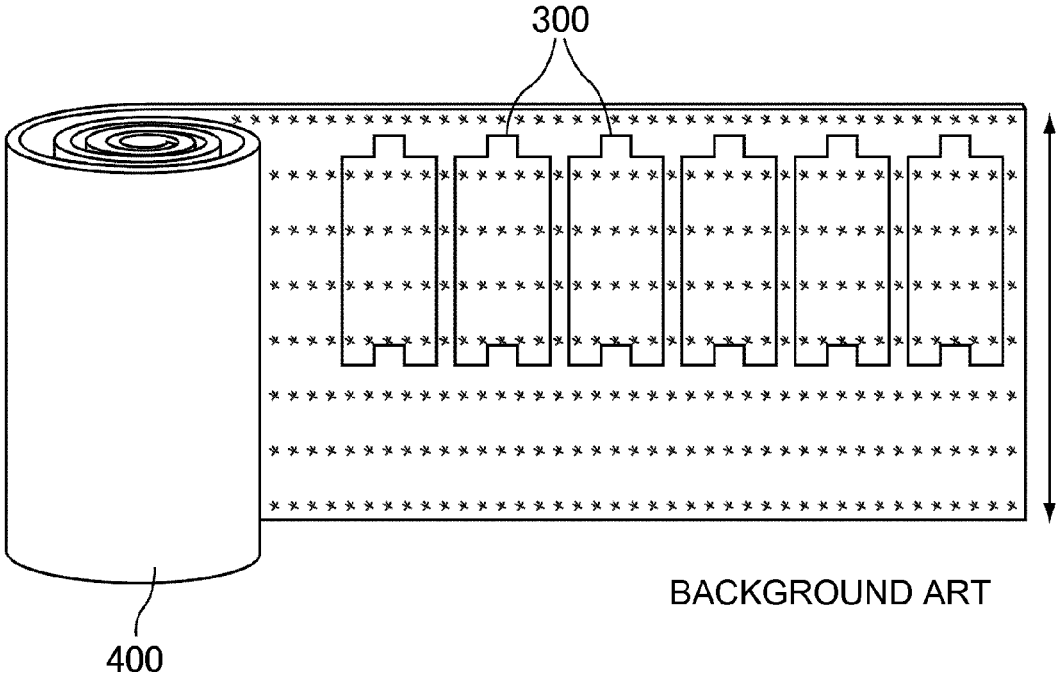
BACKGROUND ART FIG.3B

FIG. 3A and FIG. 3B are explanatory views schematically showing the condition of punching out a conventional mat to give a holding seal material.

Generally, a holding seal material is obtained by punching out a mat 400 subjected to needling treatment.

As shown in FIG. 3A and FIG. 3B, in the mat 400, interlaced parts are arranged so as to form rows in the direction perpendicular to the width direction (the direction shown by both arrows in FIG. 3A and FIG. 3B) of the mat 400.

As shown in FIG. 3A, the conventional holding seal material Y is obtained by punching out the mat 400 in such a manner that the short side direction is parallel to the width direction of the mat 400. At this time, a remnant material remaining after punching out the mat 400 to give the holding seal material Y is short and the yield is high.

In contrast, as shown in FIG. 3B, the conventional holding seal material X is obtained by punching out the mat 400 in such a manner that the long side direction is parallel to the width direction of the mat 400.

Figure 4:
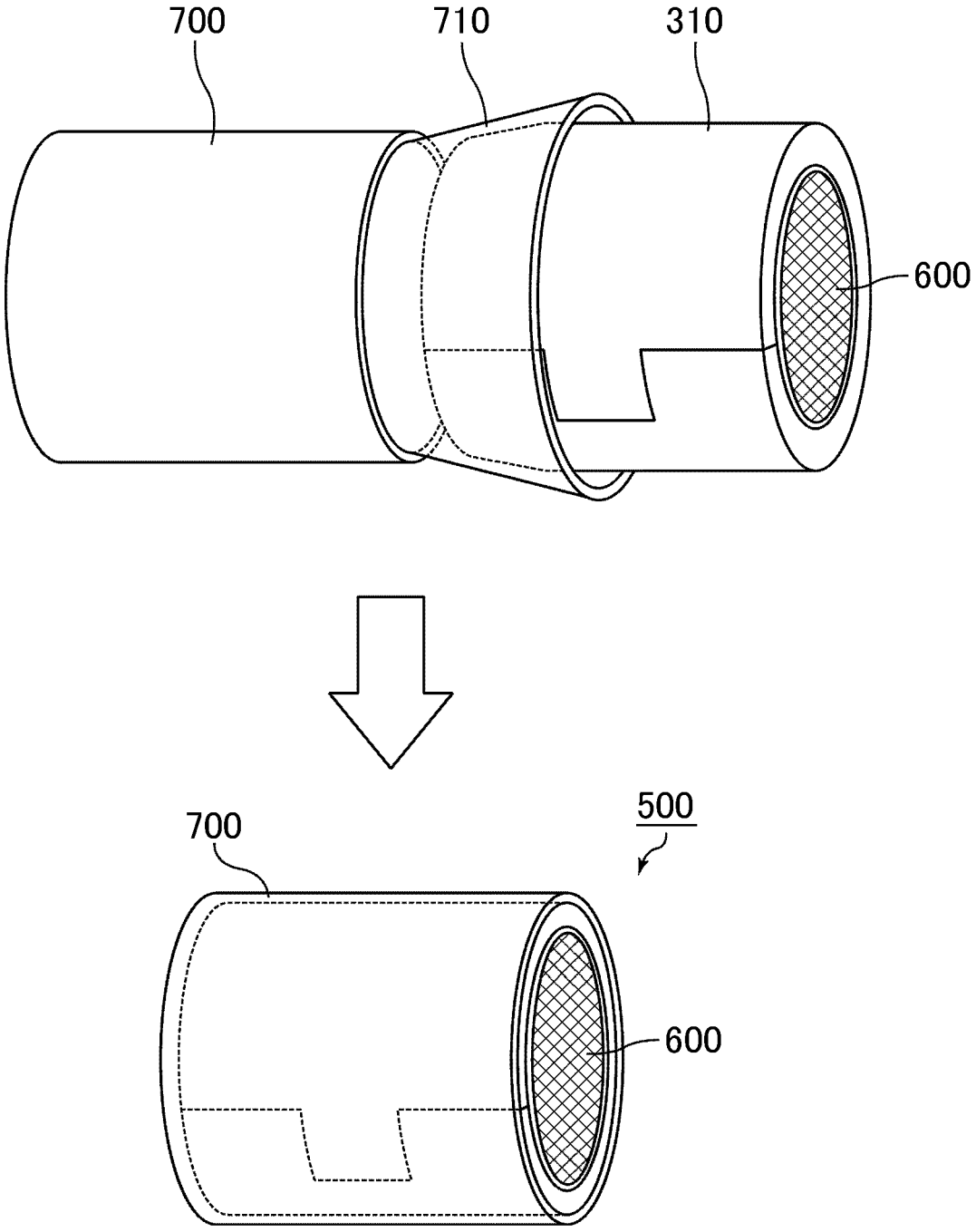
FIG. 4 is a perspective view schematically showing the condition of disposing a conventional holding seal material between an exhaust gas treatment body and a casing by a stuffing method.

FIG. 4 is a perspective view schematically showing the condition of disposing a conventional holding seal material between an exhaust gas treatment body and a casing by a stuffing method.

As a method for producing an exhaust gas purification apparatus using a holding seal material, a method for inserting an exhaust gas treatment body on which the holding seal material is wound into a casing in a stuffing manner.

According to the method, an exhaust gas treatment body 600 on which a holding seal material 310 is wound is pushed from an open surface of a casing 700, and the exhaust gas treatment body 600 is attached to a prescribed position to produce an exhaust gas purification apparatus. As shown in FIG. 4, a stuffing jig 710 may be used which is made from a tapered cylindrical body and has an inner diameter in one end part slightly smaller than the inner diameter of the end part of the casing 700 and an inner diameter in the other end part sufficiently larger than the outer diameter of the exhaust gas treatment body including the holding seal material 310.

Herein, as described above, in the conventional holding seal material X, at the time of winding the holding seal material on the outer circumference of the exhaust gas treatment body, the holding seal material is easy to be extended in the direction in which the holding seal material is extended (that is, the Y-direction) and is therefore easy to be deformed. Consequently, wrinkles are hardly formed, at the time of disposing the conventional holding seal material X between the exhaust gas treatment body and the casing by the stuffing method.

In contrast, as described above, in the conventional holding seal material Y, at the time of winding the holding seal material on the outer circumference of the exhaust gas treatment body, the holding seal material is hard to be extended in the direction in which the holding seal material is extended (that is, the Y-direction), and is therefore scarcely deformed.

Figure 5:
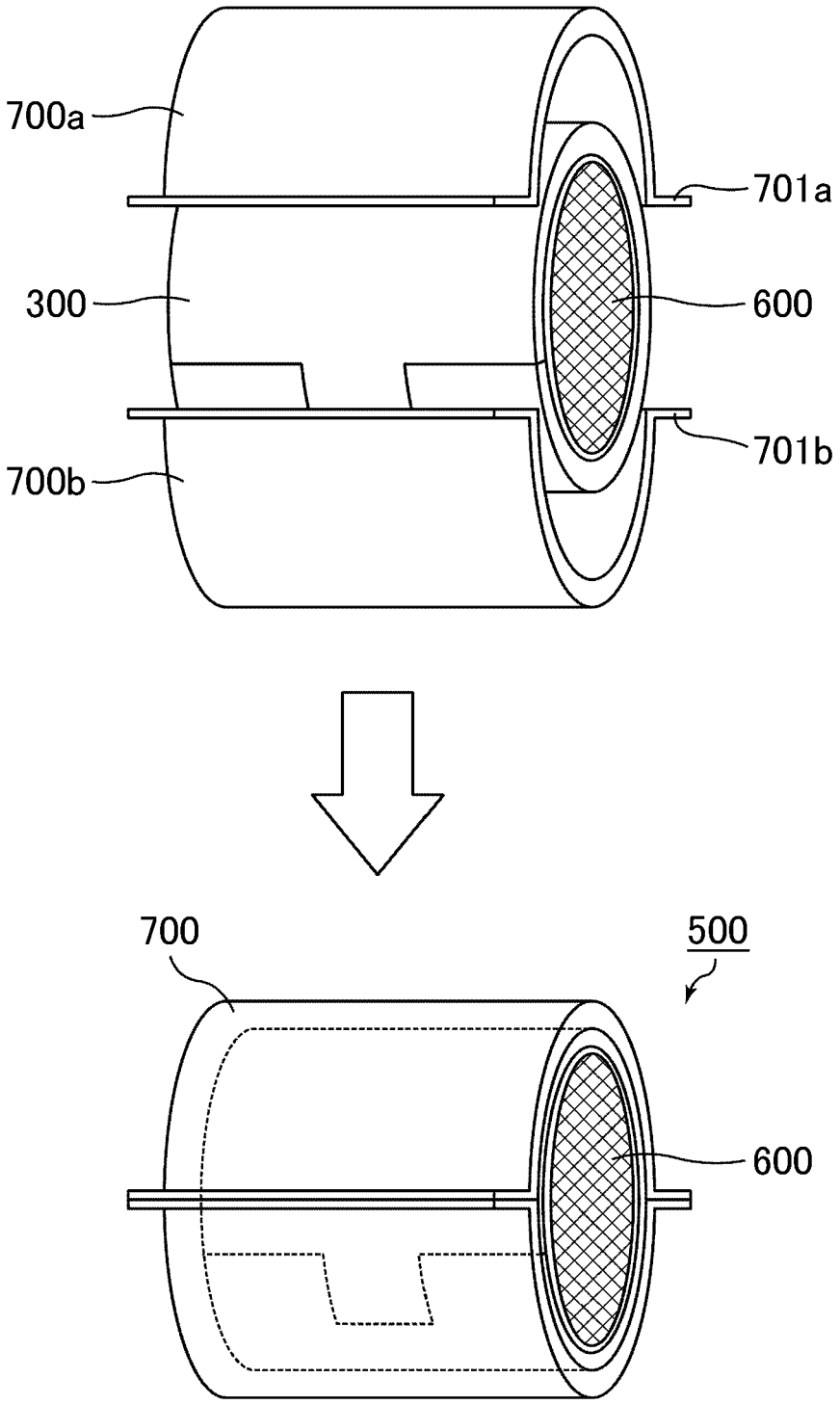
FIG. 5 is a perspective view schematically showing the condition of disposing a conventional holding seal material between an exhaust gas treatment body and a casing by a clamshell method.

FIG. 5 is a perspective view schematically showing the condition of disposing a conventional holding seal material between an exhaust gas treatment body and a casing by a clamshell method.

In the clamshell method, casing members 700*a* and 700*b* are used. The casing members 700*a* and 700*b* are members obtained by dividing a casing 700 in such a manner that a paired casing 700 is completed when both members are set face to face. After an exhaust gas treatment body 600 is installed in one of the casing members 700*a* and 700*b*, the other casing member is combined and further the casing members 700*a* and 700*b* are formed into the casing 700 by welding flange parts 701*a* and 701*b* to obtain an exhaust gas purification apparatus 500 in which the exhaust gas treatment body 600 is attached to a prescribed position.

Herein, as described above, in the case where the operation of winding the conventional holding seal material X on the outer circumference of the exhaust gas treatment body is carried out, folding lines are formed by a plurality of the interlaced parts 301 arranged in the X-direction, a shown, for example, in Figs. 1A and 2A.

The embodiment of the present invention provides a mat which is likely to have better operability of winding, is hardly extended and cut, is likely to be produced at high yield, scarcely forms wrinkles at the time of stuffing, and scarcely protruded between casing members.

That is, the mat according to an embodiment of the present invention is a mat containing inorganic fibers and having a first main surface and a second main surface, including:

a first interlaced part group constituted by arranging, in rows, a plurality of first interlaced parts constituted by interlacing the inorganic fibers with one another and formed from points on the first main surface to points present between the first main surface and the second main surface; and a second interlaced part group constituted by arranging, in rows, a plurality of second interlaced parts constituted by interlacing the inorganic fibers with one another and formed from points on the second main surface to points present between the first main surface and the second main surface, wherein the direction of rows formed by the first interlaced part group and the direction of rows formed by the second interlaced part group are different from each other.

The mat according to the embodiment of the present invention includes the first interlaced part group and the second interlaced part group.

The first interlaced part group is constituted by arranging a plurality of first interlaced parts in rows. The second interlaced part group is constituted by arranging a plurality of second interlaced parts in rows.

Both of the first interlaced parts and the second interlaced parts are constituted by interlacing inorganic fibers with one another.

The first interlaced parts are formed from points on the first main surface of the mat to points present between the first main surface and the second main surface. The second interlaced parts are formed from points on the second main surface of the mat to points present between the first main surface and the second main surface.

Herein, the first interlaced part group and the second interlaced part group will be described with reference to FIG. 6A, FIG. 6B, FIG. 7A, FIG. 7B, and FIG. 7C.

Figure 6A:
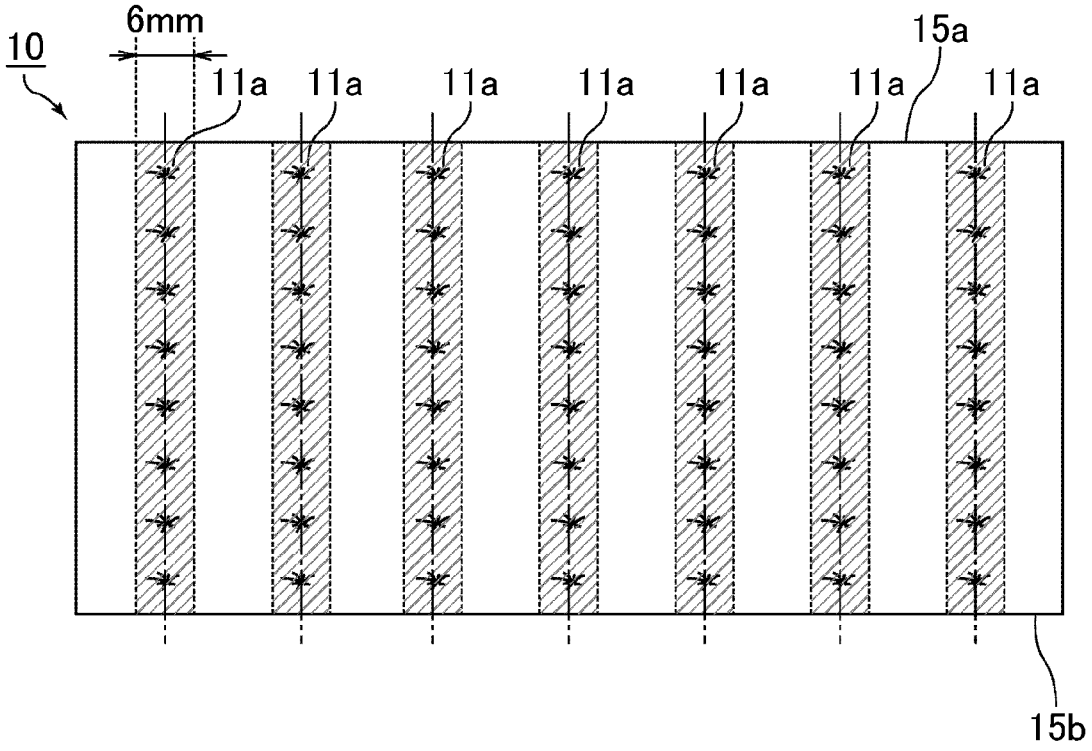
FIG. 6A is an explanatory view schematically showing a first interlaced part group of the mat according to an embodiment of the present invention.

FIG. 6A is an explanatory view schematically showing a first interlaced part group of the mat according to the embodiment of the present invention.

Figure 6B:
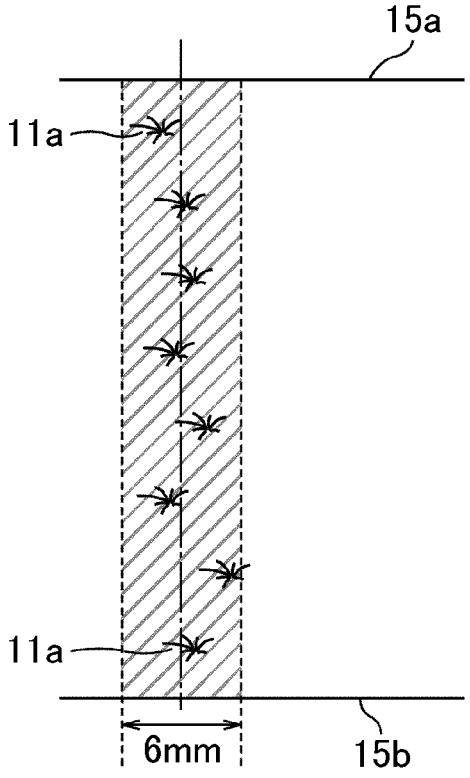
FIG. 6B is an explanatory view schematically showing a portion of the first interlaced part group of the mat according to the embodiment of the present invention.

FIG. 6B is an explanatory view schematically showing a portion of the first interlaced part group of the mat according to the embodiment of the present invention.

Figure 7A:
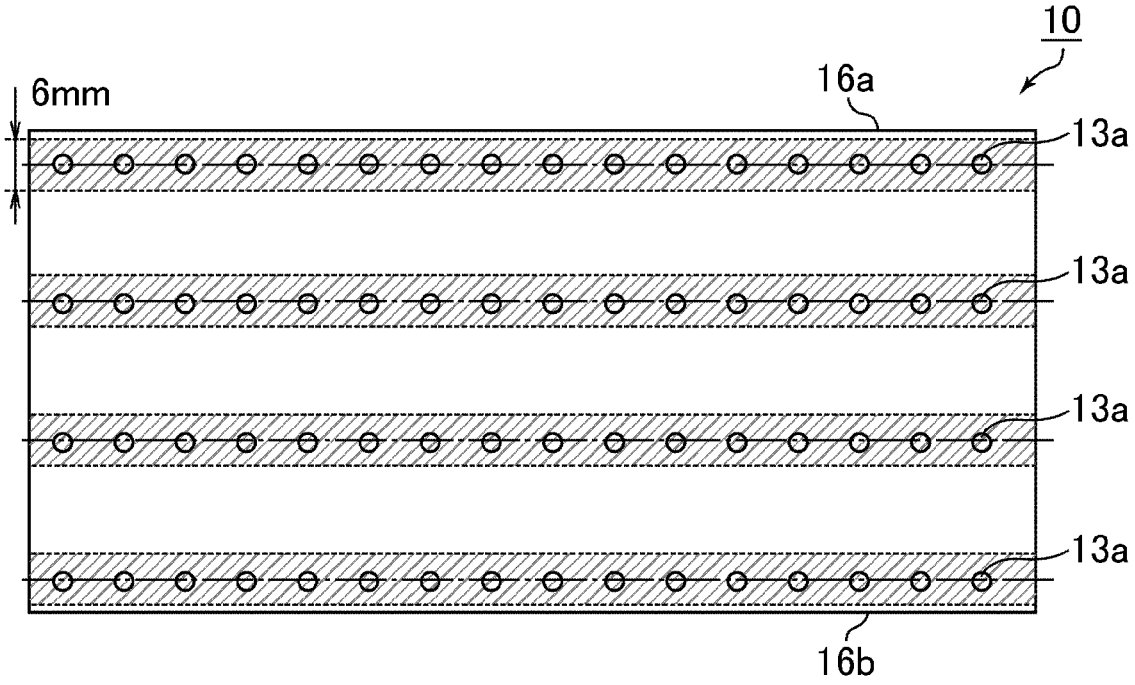
FIG. 7A is an explanatory view schematically showing a second interlaced part group of the mat according to the embodiment of the present invention.

FIG. 7A is an explanatory view schematically showing a second interlaced part group of the mat according to the embodiment of the present invention.

Figure 7B:
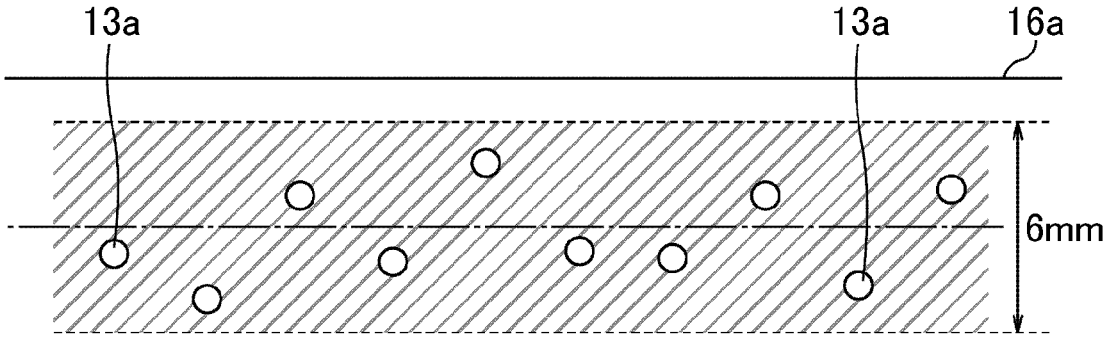
FIG. 7B is an explanatory view schematically showing a portion of the second interlaced part group of the mat according to the embodiment of the present invention.

FIG. 7B is an explanatory view schematically showing a portion of the second interlaced part group of the mat according to the embodiment of the present invention.

Figure 7C:
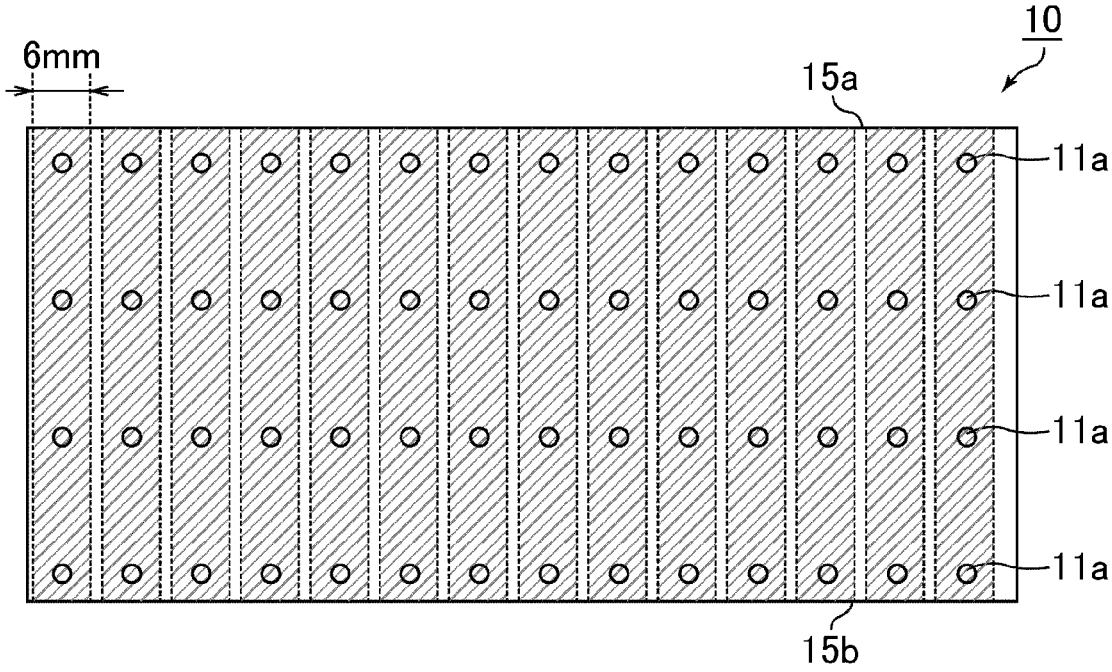
FIG. 7C is an explanatory view schematically showing the second interlaced part group of the mat according to the embodiment of the present invention.

FIG. 7C is an explanatory view schematically showing the second interlaced part group of the mat according to the embodiment of the present invention.

FIG. 6A shows the state where a plurality of first interlaced parts 11*a* are arranged in rows.

"A plurality of first interlaced parts 11*a* are arranged in rows" means that "a plurality of stripes are set on the mat and a plurality of the first interlaced parts 11*a* form rows in the respective stripes".

The stripe to which the first interlaced part 11*a* belongs is in a region surrounded with a portion of a long side 15*a* of the mat, a portion of a long side 15*b* of the mat, and two straight lines.

As shown in FIG. 6A, in the case where the long side 15*a* and the long side 15*b* are substantially in parallel, the two straight lines are lines substantially perpendicular to the long sides of the mat (the long side 15*a* and the long side 15*b*).

The stripe to which the first interlaced part 11*a* belongs is referred to as a first stripe (the stripe shown in FIG. 6A).

The length of the portion of the long side 15*a* and the length of the portion of the long side 15*b* are referred to as width of the first stripe. The width of the first stripe is 6 mm.

In the example shown in FIG. 6A, a plurality of the first interlaced parts 11*a* belonging to the respective first stripes are arranged on substantially straight lines.

In the present invention, in the case where a plurality of first interlaced parts belong to a certain first stripe, in addition to the case where these first interlaced parts are arranged on substantially straight lines, the case where these first interlaced parts are not arranged on substantially straight lines (see FIG. 6B) is regarded as the case where these first interlaced parts "form rows".

Similarly, FIG. 7A shows the state where a plurality of second interlaced parts 13*a* are arranged in rows.

"A plurality of second interlaced parts 13*a* are arranged in rows" means that "a plurality of stripes are set on the mat and a plurality of the second interlaced parts 13*a* form rows in the respective stripes".

The stripe to which the second interlaced part 13*a* belongs is in a region surrounded with sides in the width direction of the mat and two straight lines.

As shown in FIG. 7A, in the case where a long side 16*a* and a long side 16*b* of the mat are substantially in parallel, the two straight lines are lines substantially parallel to the long side of the mat (the long side 16*a* and the long side 16*b*).

The stripe to which the second interlaced part 13*a* belongs is referred to as a second stripe (the stripe shown in FIG. 7A).

The length of the side in the width direction of the mat is referred to as the width of the second stripe. The width of the second stripe is 6 mm.

In the example shown in FIG. 7A, a plurality of the second interlaced parts 13*a* belonging to the respective second stripes are arranged on substantially straight lines.

In the present invention, in the case where a plurality of second interlaced parts belong to a certain second stripe, in addition to the case where these second interlaced parts are arranged on substantially straight lines, the case where these second interlaced parts are not arranged on substantially straight lines (see FIG. 7B) is regarded as the case where these second interlaced parts "form rows".

Additionally, the first interlaced part group and the second interlaced part group are distinguished as follows.

For example, in the case where interlaced parts are present on a mat in an aspect shown in FIG. 7A, a plurality of interlaced parts present on the mat constitute the second interlaced part group but do not constitute the first interlaced part group.

That can be explained as follows.

In the case where interlaced parts are present on a mat in an aspect shown in FIG. 7A, stripes in the direction substantially parallel to the long side of the mat can be set as shown in FIG. 7A, and further, stripes in the direction substantially perpendicular to the long side of the mat can also be set as shown in FIG. 7C.

In such a case, whether a plurality of the interlaced parts constitute the first interlaced part group or constitute the second interlaced part group is determined as follows.

That is, in the case of comparison of the density of the interlaced parts belonging to the stripes in the direction substantially parallel to the long side of the mat (see FIG. 7A) with the density of the interlaced parts belonging to the stripes in the direction substantially perpendicular to the long side of the mat (see FIG. 7C), the stripes with higher density of the interlaced parts are specified.

In the case where the stripes with higher density of the interlaced parts are stripes in the direction substantially perpendicular to the long side of the mat, a plurality of the interlaced parts are determined to constitute the first interlaced part group. On the other hand, in the case where the stripes with higher density of the interlaced parts are stripes in the direction substantially parallel to the long side of the mat, a plurality of the interlaced parts are determined to constitute the second interlaced part group.

The first interlaced part group and the second interlaced part group in the embodiment of the present invention are described above.

The conventional holding seal material X has interlaced parts arranged so as to form rows in the X-direction in both of the first main surface side and in the second main surface side. Also, the conventional holding seal material Y has interlaced parts arranged so as to form rows in the Y-direction in both of the first main surface side and the second main surface.

In contrast, according to the mat as described in the embodiment of the present invention, the direction of the rows formed by the first interlaced part group and the direction of the rows formed by the second interlaced part group are different from each other.

Herein, in the case where the first interlaced parts are arranged as shown in FIG. 6A and the second interlaced parts are arranged as shown in FIG. 7A, "the direction of the rows formed by the first interlaced part group" and "the direction of the rows formed by the second interlaced part group" can be defined as follows.

As shown in FIG. 6A, in the case where a plurality of the first interlaced parts belonging to respective stripes are arranged on substantially straight lines in the direction substantially perpendicular to the long side of the mat, "the direction of the rows formed by the first interlaced part group" is the direction substantially perpendicular to the long side of the mat.

Also, as shown in FIG. 7A, in the case where a plurality of the second interlaced parts belonging to respective stripes are arranged on substantially straight lines in the direction substantially parallel to the long side of the mat, "the direction of the rows formed by the second interlaced part group" is the direction substantially parallel to the long side of the mat.

"The direction of the rows formed by the first interlaced part group" and "the direction of the rows formed by the second interlaced part group" are described above.

As described above, according to the mat as described in the embodiment of the present invention, the direction of the rows formed by the first interlaced part group and the direction of the rows formed by the second interlaced part group are different from each other. Consequently, in the case of carrying out an operation of winding the mat on the outer circumference of the exhaust gas treatment body by setting either one of the direction of the rows formed by the first interlaced part group and the direction of the rows formed by the second interlaced part group to be the direction close to the X-direction, folding lines tend to be formed by the interlaced parts arranged in the direction and therefore, the winding operation is made easy to be carried out.

That is, it may become easier to solve the problem that the conventional holding seal material Y has, that is, "in the case where an operation of winding the holding seal material on the outer circumference of the exhaust gas treatment body is carried out, there is no folding line formed by a plurality of the interlaced parts arranged in the X-direction and therefore, the winding work is difficult to be carried out".

Further, according to the mat according to the embodiment of the present invention, the interlaced parts are formed with relatively high density in the direction in which the mat is extended (that is, Y-direction) at the time of winding the mat on the outer circumference of the exhaust gas treatment body, in either one side of the first main surface side and the second main surface side. As shown in FIG. 7A, an example is the case where the interlaced parts are arranged so as to form rows in the Y-direction (the long side direction of the mat), or the like. Consequently, many portions in which fibers are interlaced are present in the direction in which the mat is extended and therefore, the mat is hardly extended and cut.

That is, it may become easier to solve the problem that the conventional holding seal material X has, that is, "at the time of winding the holding seal material on the outer circumference of the exhaust gas treatment body, the interlaced parts are formed with high density in the X-direction, different from the direction in which the holding seal material is extended (that is, the Y-direction), and few portions in which fibers are interlaced are present in the direction in which the holding seal material is extended and therefore, the holding seal material is easy to be extended and cut".

Figure 8:
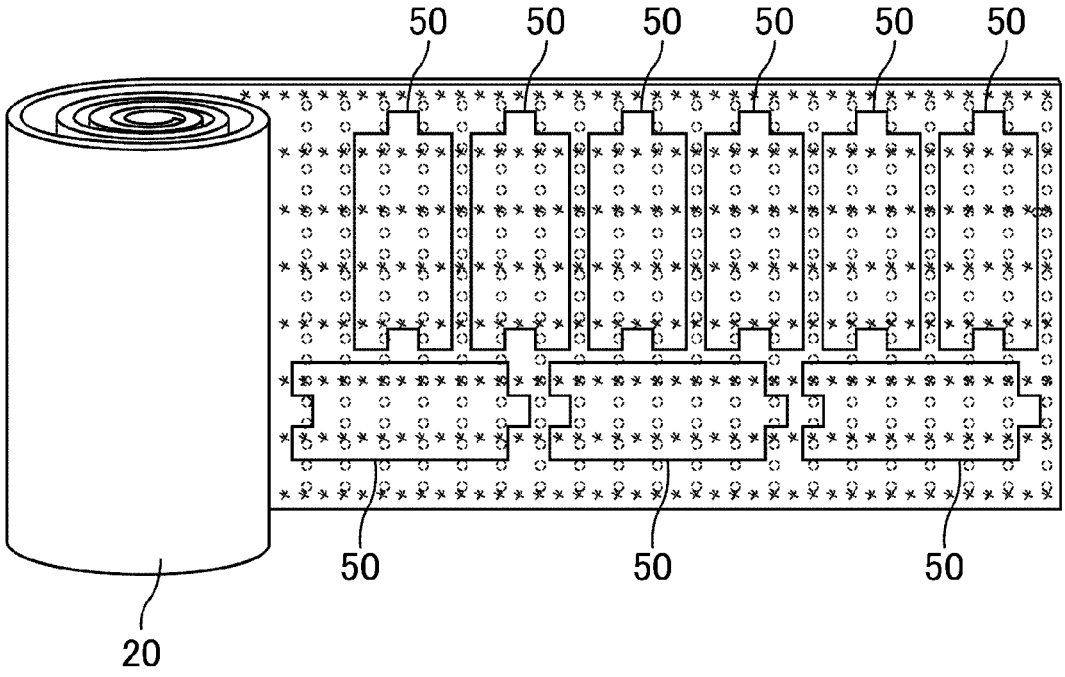
FIG. 8 is an explanatory view schematically showing the condition where the mat according to the embodiment of the present invention is punched out to give a holding seal material.

FIG. 8 is an explanatory view schematically showing the condition where the mat of the embodiment of the present invention is punched out to give a holding seal material.

According to the mat according to the embodiment of the present invention, as shown in FIG. 8, even if punching is carried out from different directions in the case of punching out the mat to give a holding seal material, the same holding seal material tends to be obtained and a remnant material tends to be reduced and thus, the yield tends to be improved.

That is, it may become easier to solve the problem that the conventional holding seal material X has, that is, "at the time of punching out the mat in such a manner that the long side direction is parallel to the width direction of the mat, a remnant material remaining after punching out the mat to give a holding seal material is large and the yield is low" (see FIG. 3B).

Further, according to the mat according to the embodiment of the present invention, at the time of winding the mat on the outer circumference of the exhaust gas treatment body, the mat tends to be easily extended and deformed since the interlaced parts are not easily formed with high density in the direction in which the mat is extended (that is, the Y-direction), in either one side of the first main surface side and the second main surface side. Consequently, wrinkles are hardly formed, at the time of disposing the mat between the exhaust gas treatment body and the casing by the stuffing method.

That is, it may become easier to solve the problem that the conventional holding seal material Y has, that is, "at the time of winding the holding seal material on the outer circumference of the exhaust gas treatment body, the holding seal material is hard to be extended in the direction in which the holding seal material is extended (that is, the Y-direction), and is therefore scarcely deformed, wrinkles are easy to be formed, at the time of disposing the conventional holding seal material between the exhaust gas treatment body and the casing by the stuffing method" (referred to as an effect (A)).

Further, according to the mat according to the embodiment of the present invention, folding lines formed by a plurality of the interlaced parts arranged in the direction close to the X-direction tends to be set inward by winding the mat on the exhaust gas treatment body in such a manner that the main surface in the side where the interlaced parts are formed in the direction close to the X-direction is to be bonded to the exhaust gas treatment body. Consequently, in the case where the mat is disposed between the exhaust gas treatment body and the casing by the clamshell method, the mat tends to be prevented from being protruded between casing members.

That is, it may become easier to solve the problem that the conventional holding seal material X has, that is, "folding lines are formed by a plurality of the interlaced parts arranged in the X-direction and therefore, the conventional holding seal material is inferior in adhesion property to the exhaust gas treatment body, and in the case of disposing the holding seal material between the exhaust gas treatment body and the casing by the clamshell method, the holding seal material may possibly be protruded between casing members" (referred to as an effect (B)).

According to the mat according to the embodiment of the present invention, both of the effect (A) and the effect (B) tend to be simultaneously exerted.

In the mat according to the embodiment of the present invention, the smaller angle of angles formed between the direction of the rows formed by the first interlaced part group and the direction of the rows formed by the second interlaced part group is from about 60° to about 90°.

In the mat according to the embodiment of the present invention, the smaller angle of angles formed between the direction of the rows formed by the first interlaced part group and the direction of the rows formed by the second interlaced part group is from about 85° to about 90°.

Consequently, the effects tend to be enjoyed more preferably.

The mat according to the embodiment of the present invention further contains an organic binder.

When the mat containing the organic binder is exposed to high temperature, the organic binder is decomposed and the inorganic fibers tend to be released from adhesion and expanded.

Consequently, if a holding seal material using the mat containing the organic binder is used for an exhaust gas purification apparatus, at the time of using the exhaust gas purification apparatus, the organic binder is decomposed due to the high temperature exhaust gas, and the inorganic fibers tend to be released from adhesion and the holding seal material is expanded and thus, it tends to exhibit high holding force.

In the mat according to the embodiment of the present invention, the inorganic fibers are at least one kind selected from the group consisting of alumina fibers, ceramic fibers, alumina-silica fibers, silica fibers, glass fibers, and bio-soluble fibers.

Since these inorganic fibers are excellent in properties such as heat resistance, a mat made from these inorganic fibers and a holding seal material using the mat are more likely to be excellent in heat resistance, holding force, and the like.

Further, in the case where the inorganic fibers constituting the mat include bio-soluble fibers, even if the bio-soluble fibers are scattered and taken in a living body at the time of handling the mat, the bio-soluble fibers are dissolved and discharged out of the living body and thus, the mat is more likely to be excellent in safety for human body.

The method for producing a mat according to the embodiment of the present invention is a method for producing a mat containing inorganic fibers, the production method of a mat including a step of carrying out needling treatment for a precursor sheet having a first main surface and a second main surface, the step of carrying out needling treatment including a first needling step of inserting needles from a respective plurality of points arranged in rows and present on the first main surface to points present between the first main surface and the second main surface; and a second needling step of inserting needles from a respective plurality of points arranged in rows and present on the second main surface to points present between the first main surface and the second main surface, wherein the direction of rows formed by a plurality of the points on the first main surface in which the needles are inserted in the first needling step and the direction of rows formed by a plurality of the points on the second main surface in which the needles are inserted in the second needling step are different from each other.

The method for producing a mat according to the embodiment of the present invention includes the first needling step and the second needling step.

The first needling step is a step of inserting needles from a respective plurality of points arranged in rows and present on the first main surface to points present between the first main surface and the second main surface. Consequently, the first interlaced part group is more easily formed, which is constituted by arranging, in rows, a plurality of first interlaced parts constituted by interlacing the inorganic fibers with one another and formed from points on the first main surface to points present between the first main surface and the second main surface.

The second needling step is a step of inserting needles from a respective plurality of points arranged in rows and present on the second main surface to points present between the first main surface and the second main surface. Consequently, the second interlaced part group is more easily formed, which is constituted by arranging, in rows, a plurality of second interlaced parts constituted by interlacing the inorganic fibers with one another and formed from points on the second main surface to points present between the first main surface and the second main surface.

Additionally, the direction of rows formed by a plurality of the points on the first main surface in which the needles are inserted in the first needling step and the direction of rows formed by a plurality of the points on the second main surface in which the needles are inserted in the second needling step tend to be different from each other. Consequently, the direction of the rows formed by the first interlaced part group and the direction of the rows formed by the second interlaced part group tend to be different from each other.

That is, according to the method for producing a mat according to the embodiment of the present invention, the mat according to the embodiment of the present invention tends to be produced.

In the method for producing a mat according to the embodiment of the present invention, the smaller angle of angles formed between the direction of the rows formed by a plurality of the points on the first main surface in which the needles are inserted in the first needling step and the direction of the rows formed by a plurality of the points on the second main surface in which the needles are inserted in the second needling step is from about 60° to about 90°.

Accordingly, the mat according to the embodiment of the present invention tends to be produced.

The method for producing a mat according to the embodiment of the present invention is a method for producing a mat containing inorganic fibers, including steps of:

preparing a first mat before lamination having a main surface $\alpha$ and a main surface $\beta$ and a first interlaced part group constituted by arranging, in rows, a plurality of first interlaced parts constituted by interlacing the inorganic fibers with one another and formed from points on the main surface $\alpha$ toward the main surface $\beta$, and a second mat before lamination having a main surface $\gamma$ and a main surface $\delta$ and a second interlaced part group constituted by arranging, in rows, a plurality of second interlaced parts constituted by interlacing the inorganic fibers with one another and formed from points on the main surface $\gamma$ toward the main surface $\delta$; and laminating the first mat before lamination and the second mat before lamination by bonding the main surface $\beta$ of the first mat before lamination and the main surface $\delta$ of the second mat before lamination in such a manner that the direction of the rows formed by the first interlaced part group and the direction of the rows formed by the second interlaced part group are different from each other.

According to the method for producing a mat according to the embodiment of the present invention, first, a first mat before lamination and a second mat before lamination are prepared.

The first mat before lamination has a first interlaced part group constituted by arranging, in rows, a plurality of first interlaced parts constituted by interlacing the inorganic fibers with one another and formed from points on the main surface $\alpha$ toward the main surface $\beta$. The second mat before lamination has a second interlaced part group constituted by arranging, in rows, a plurality of second interlaced parts constituted by interlacing the inorganic fibers with one another and formed from points on the main surface $\gamma$ toward the main surface $\delta$.

Next, the first mat before lamination and the second mat before lamination are laminated by bonding the main surface $\beta$ of the first mat before lamination and the main surface $\delta$ of the second mat before lamination in such a manner that the direction of the rows formed by the first interlaced part group and the direction of the rows formed by the second interlaced part group are different from each other.

According to the method for producing a mat according to the embodiment of the present invention, the mat according to the embodiment of the present invention tends to be produced.

In the method for producing a mat according to the embodiment of the present invention, the lamination step is carried out to laminate the first mat before lamination and the second mat before lamination in such a manner that the smaller angle of angles formed between the direction of the rows formed by the first interlaced part group and the direction of the rows formed by the second interlaced part group becomes from about 60° to about 90°.

Accordingly, the mat according to the embodiment of the present invention tends to be produced.

The exhaust gas purification apparatus according to the embodiment of the present invention is an exhaust gas purification apparatus including:

an exhaust gas treatment body;

a casing for housing the exhaust gas treatment body; and a holding seal material for holding the exhaust gas treatment body, which is disposed between the exhaust gas treatment body and the casing, wherein the holding seal material is the mat according to the embodiment of the present invention.

The exhaust gas purification apparatus according to the embodiment of the present invention is an exhaust gas purification apparatus including:

an exhaust gas treatment body;

a casing for housing the exhaust gas treatment body; and a holding seal material for holding the exhaust gas treatment body, which is disposed between the exhaust gas treatment body and the casing, wherein the holding seal material is a mat produced by the method for producing a mat according to the embodiment of the present invention.

(First Embodiment)

Hereinafter, one embodiment of the mat, method for producing a mat, and exhaust gas treatment apparatus of the present invention will be described with reference to the drawings.

Figure 9:
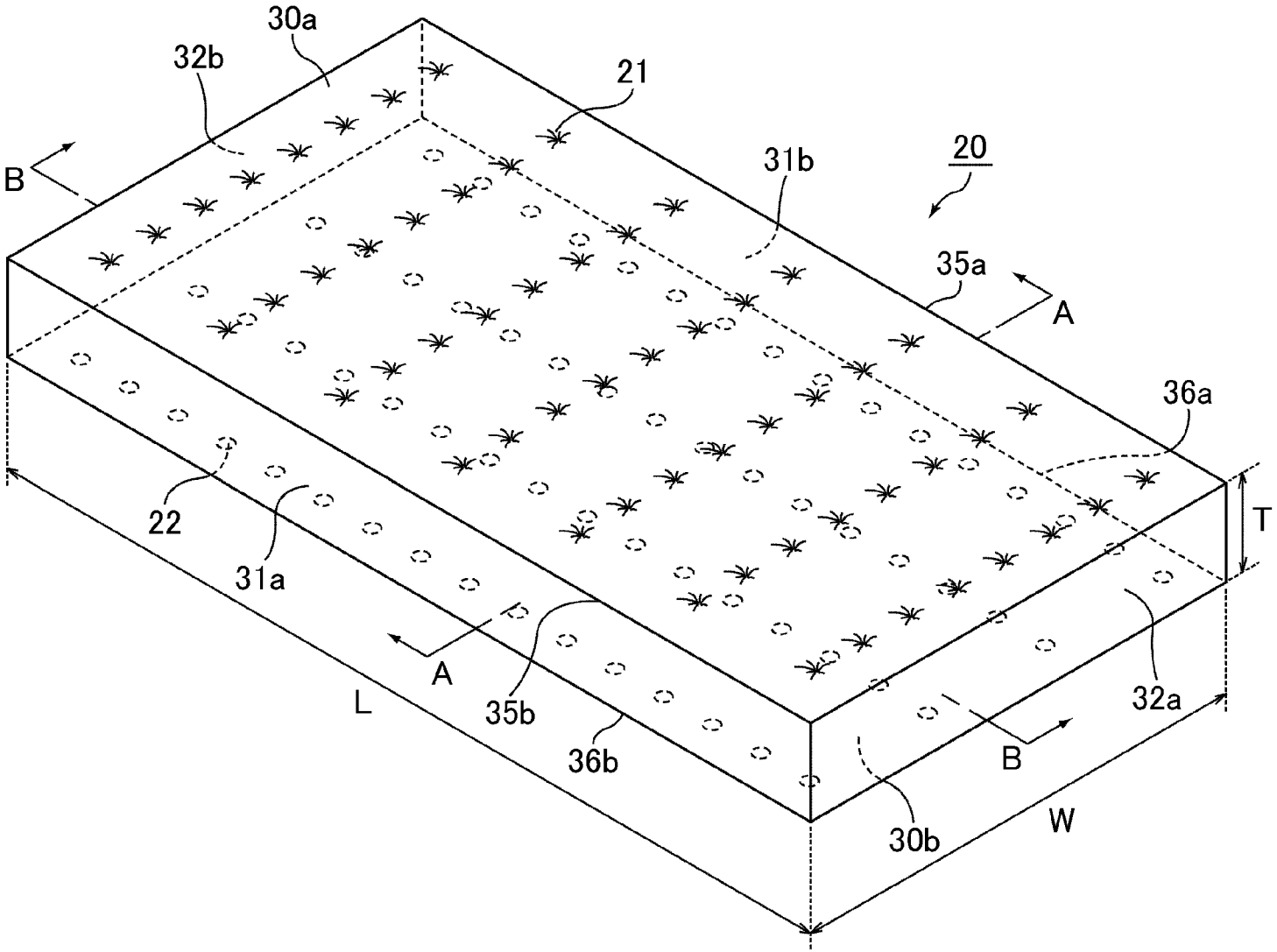
FIG. 9 is a perspective view schematically showing one example of a mat of one embodiment of the present invention.

FIG. 9 is a perspective view schematically showing one example of a mat of one embodiment of the present invention.

Figure 10A:
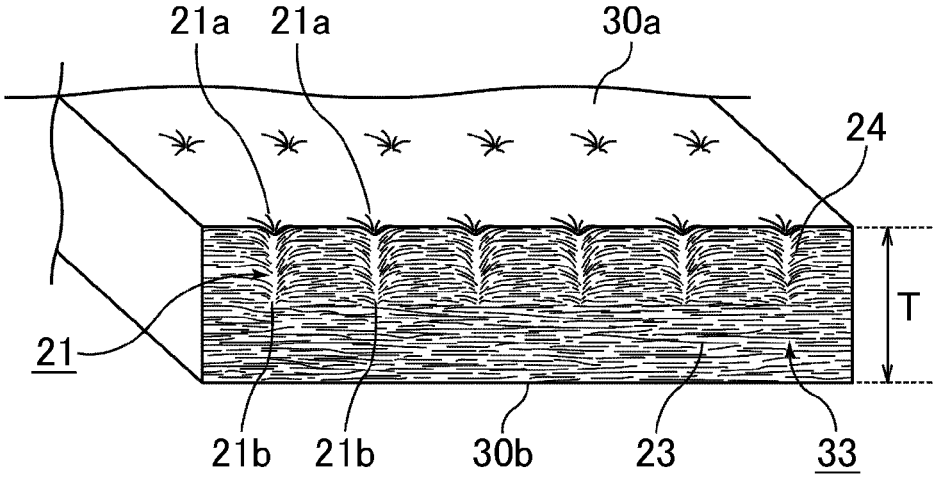
FIG. 10A is an A-A line cross-sectional view of the mat shown in FIG. 9.
Figure 10B:
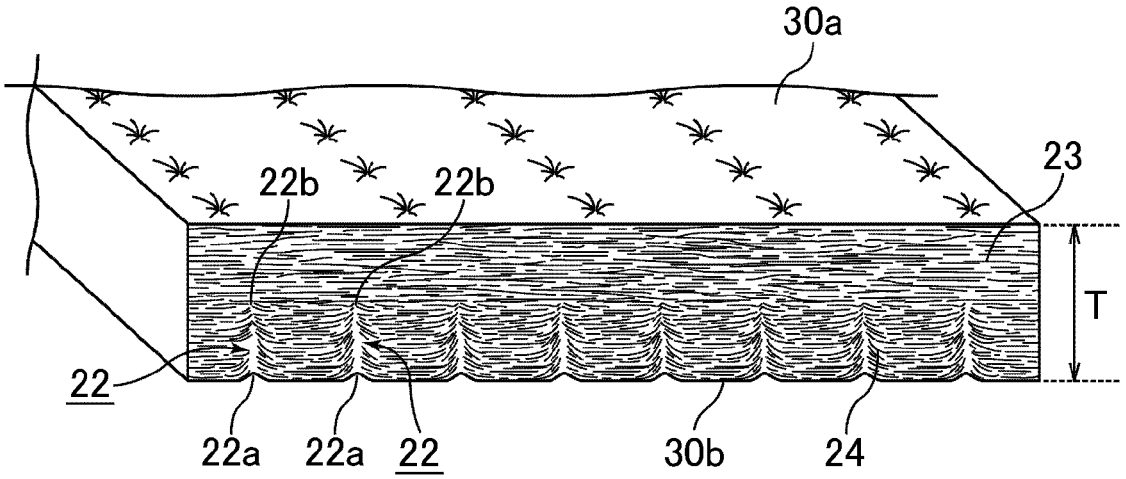
FIG. 10B is a B-B line cross-sectional view of the mat shown in FIG. 9.

FIG. 10A is an A-A line cross-sectional view of the mat shown in FIG. 9 and FIG. 10B is a B-B line cross-sectional view of the mat shown in FIG. 9.

As shown in FIG. 9, a mat 20 has a first main surface 30*a* and a second main surface 30*b* facing to the first main surface 30*a*.

The mat 20 also has a first long side surface 31*a* and a second long side surface 31*b* facing to the first long side surface 31*a*.

The mat 20 also has a first short side surface 32*a* and a second short side surface 32*b* facing to the first short side surface 32*a*.

The first main surface 30*a* has a first long side 35*a* and a first long side 35*b*. The second main surface 30*b* has a second long side 36*a* and a second long side 36*b*. The first long side 35*a*, the first long side 35*b*, the second long side 36*a*, and the second long side 36*b* may be simply referred to as a long side in the present description.

In the present embodiment, the respective long sides are parallel to one another. However, in the present invention, the respective long sides are not necessarily strictly parallel, and may be substantially parallel. "Substantially parallel" means that the smaller angle of angles formed between two long sides is from 0° to about 5°.

As shown in FIG. 10A, a plurality of first interlacing starting points 21*a* are present on the first main surface 30*a*. Further, a plurality of first interlacing finishing points 21*b* are present between the first main surface 30*a* and the second main surface 30*b*.

First interlaced parts 21 are formed from the first interlacing starting points 21*a* to the first interlacing finishing points 21*b*.

The distance between the first interlacing starting point 21*a* to the first interlacing finishing point 21*b* is substantially a half of the thickness T of the mat 20.

As shown in FIG. 10B, a plurality of second interlacing starting points 22*a* are present on the second main surface 30*b*. Further, a plurality of second interlacing finishing points 22*b* are present between the first main surface 30*a* and the second main surface 30*b*.

Second interlaced parts 22 are formed from the second interlacing starting points 22*a* to the second interlacing finishing points 22*b*.

The distance between the second interlacing starting point 22*a* to the second interlacing finishing point 22*b* is substantially a half of the thickness T of the mat 20.

In the present embodiment, there is described the case where the distance between the first interlacing starting point 21*a* to the first interlacing finishing point 21*b* and the distance between the second interlacing starting point 22*a* to the second interlacing finishing point 22*b* are substantially the same. However, in the present invention, a distance $T_1$ between the first interlacing starting point to the first interlacing finishing point and a distance $T_2$ between the second interlacing starting point to the second interlacing finishing point may be different from each other.

In the present invention, in the case where the thickness of the mat is defined as T, it is desirable to satisfy $T_1 \geq T \times$about 0.1 and $T_2 \geq T \times$about 0.1, and more desirable to satisfy $T_1 \geq T \times$ about 0.3 and $T_2 \geq T \times$about 0.3. Also, it is desirable to satisfy $T_1 \leq T \times$about 0.9 and $T_2 \leq T \times$about 0.9, and more desirable to satisfy $T_1 \leq T \times$about 0.7 and $T_2 \leq T \times$about 0.7.

In the case where $T_1 \geq T \times$about 0.1 or $T_2 \geq T \times$about 0.1, the above problems of conventional techniques tend to be sufficiently solved. Also, in the case where $T_1 \leq T \times$about 0.9 or $T_2 \leq T \times$about 0.9, the above problems of conventional techniques tend to be sufficiently solved.

Further, in the present invention, $T_1$ in the respective first interlaced parts may be the same or different from each other. Also, $T_2$ in the respective second interlaced parts may be the same or different from each other.

In portion 33 other than the first interlaced parts 21 and the second interlaced parts 22 (hereinafter, simply referred to as non interlaced part-formed regions), inorganic fibers 23 are relatively loosely interlaced and show a nonwoven fabric-like state.

On the other hand, in the first interlaced parts 21 and the second interlaced part 22, inorganic fibers 24 are interlaced densely one another as compared with the inorganic fibers 23 constituting the non interlaced part-formed region 33.

The mat 20 is made in the state such that it is sawed along the thickness direction by the inorganic fibers 24 interlaced densely one another, and the bulk of the mat 20 is properly decreased around the first interlaced parts 21 and the second interlaced parts 22.

As shown in FIG. 9, in the first interlaced parts 21 are arranged on substantially straight lines in the direction substantially perpendicular to the longitudinal direction of the mat 20. The direction of the rows formed by the first interlaced part group is a direction substantially perpendicular to the longitudinal direction of the mat 20.

Further, the second interlaced parts 22 are arranged on substantially straight lines in the direction substantially parallel to the longitudinal direction of the mat 20. The direction of the rows formed by the second interlaced part group is a direction substantially parallel to the longitudinal direction of the mat 20.

Consequently, the smaller angle is about 90° of angles formed between the direction of the rows formed by the first interlaced part group and the direction of the rows formed by the second interlaced part group.

Accordingly, in the present embodiment, the smaller angle θ is defined as about 90° of angles formed between the direction of the rows formed by the first interlaced part group and the direction of the rows formed by the second interlaced part group. However, in the present invention, θ is not limited to about 90°. θ is desirably from about 60° to about 90°, more desirably from about 85° to about 90°, and even more desirably about 90°. In the case where θ is not lower than about 60°, the above problems of conventional techniques tend to be sufficiently solved.

The shape of the mat 20 shown in FIG. 9 is a substantially rectangular shape in plane view having a prescribed length (shown with both arrows L in FIG. 9), width (shown with both arrows W in FIG. 9), and thickness (shown with both arrows T in FIG. 9).

The size of the mat 20 is not particularly limited; however it is desirably in a range of length from about 100 mm to about 10000 mm×width from about 100 mm to about 1500 mm×thickness from about 5 mm to about 30 mm.

The mat 20 is constituted by interlacing the inorganic fibers 23 and 24 with one another, for example, as shown in FIGS. 10A and 10B.

The inorganic fibers are desirably at least one kind of inorganic fibers selected from the group consisting of alumina fibers, ceramic fibers, alumina-silica fibers, silica fibers, glass fibers, and bio-soluble fibers.

The alumina fibers may contain, other than alumina, additives such as CaO, MgO, and $ZrO_2$.

The composition ratio of the alumina-silica fibers based on weight ratio is desirably $Al_2O_3$:$SiO_2$=from about 60:about 40 to about 80:about 20 and more desirably $Al_2O_3$:$SiO_2$=from about 70:about 30 to about 74:about 26.

The silica fibers may contain, other than silica, additives such as CaO, MgO and $ZrO_2$.

The bio-soluble fibers are inorganic fibers including at least one kind compound selected from the group consisting of alkali metal compounds, alkaline earth metal compounds, and boron compounds.

Since the bio-soluble fibers are easy to be dissolved even if the fibers are taken in human body, the mat constituted by interlacing the bio-soluble fibers with one another is excellent in safety for human body.

A specific composition of the bio-soluble fiber is a composition containing from about 60 wt % to about 85 wt % of silica and from about 15 wt % to about 40 wt % of at least one kind compound selected from the group consisting of alkali metal compounds, alkaline earth metal compounds, and boron compounds.

The silica means SiO or $SiO_2$.

Further, the alkali metal compounds include, for example, oxides of Na and K, and the alkaline earth metal compounds include, for example, oxides of Mg, Ca and Ba. The boron compounds include, for example, oxides of B.

If the silica content is not lower than about 60 wt %, production by a glass melting method tends to be easy and fiber formation tends to be easy. Further, the structure is less likely to be fragile and dissolution in physiological saline solution is less likely to be excessively easy.

On the other hand, if it is not higher than about 85 wt %, dissolution in physiological saline solution is less likely to be excessively difficult.

Additionally, the silica content is calculated in terms of $SiO_2$.

If the amount of at least one kind compound selected from the group consisting of alkali metal compounds, alkaline earth metal compounds, and boron compounds is not lower than about 15 wt %, dissolution in physiological saline solution is less likely to be excessively difficult.

On the other hand, if it not higher than about 40 wt %, production by a glass melting method tends to be easy and fiber formation tends to be easy. Further, the structure is less likely to be fragile and dissolution in physiological saline solution is less likely to be excessively easy.

The solubility of the inorganic fibers in a physiological saline solution is desirably about 30 ppm or higher. It is because if the solubility is not less than about 30 ppm, in the case where the inorganic fibers are taken in human body, the inorganic fibers are more easily discharged out the body, and it is preferable in terms of health.

The solubility can be measured by the following method.

(a) First, an inorganic fiber sample is prepared by suspending 2.5 g of inorganic fibers in distilled water using a blender for foods, thereafter, allowing the suspension to stand still to precipitate the inorganic fibers, further removing the supernatant liquid by decantation, and drying the suspension at 110° C. to remove the remaining liquid.

(b) A physiological saline solution is prepared by diluting 6.780 g of sodium chloride, 0.540 g of ammonium chloride, 2.270 g of sodium hydrogen carbonate, 0.170 g of disodium hydrogen phosphate, 0.060 g of sodium citrate dihydrate, 0.450 g of glycin, and 0.050 g of sulfuric acid (specific gravity 1.84) in 1 liter (L) of distilled water.

(c) After 0.50 g of the inorganic fiber sample prepared in (a) and 25 $cm^3$ of the physiological saline solution prepared in (b) are put in a centrifugal tube and well shaken, the mixture is treated in a shaking incubator at 37° C. and 20 cycles/minute for 5 hours.

Thereafter, the centrifugal tube is taken out and centrifugal separation is carried out at 4500 rpm for 5 minutes and the supernatant is taken out by an injector.

(d) Next, the supernatant is filtered by a filter (0.45 μm cellulose nitrate membrane filter) and the obtained sample is subjected to atomic absorption spectrometry to measure the solubility of silica, calcium oxide, and magnesium oxide to the aqueous physiological saline solution.

The average fiber length of the inorganic fibers is desirably about 3.5 mm or longer and about 100 mm or shorter.

If the average fiber length of the inorganic fibers is not shorter than about 3.5 mm, the fiber length of the inorganic fiber is less likely to be too short, and the interlacing by needling is less likely to be insufficient. On the other hand, if the average fiber length of the inorganic fibers is not longer than about 100 mm, the fiber length of the inorganic fiber is less likely to be too long, and the handling property of the inorganic fibers is less likely to be deteriorated at the time of producing a mat.

The average fiber diameter of the inorganic fibers is desirably from about 3 μm to about 10 μm. If the average fiber diameter of the inorganic fibers 23, 24 is from about 3 μm to about 10 μm, the strength and flexibility of the inorganic fibers 23, 24 are more likely to be sufficiently high and the shear strength of the mat 20 tend to be improved.

If the average fiber diameter of the inorganic fibers is not shorter than about 3 μm, the tensile strength of the inorganic fibers is less likely to be insufficient. On the other hand, if the average fiber diameter of the inorganic fibers is not longer than about 10 μm, the flexibility of the inorganic fibers is less likely to be insufficient.

The formation density of the total of the first interlaced parts 21 and the second interlaced parts 22 (in the description hereinafter, "interlaced parts" includes "first interlaced parts" and "second interlaced parts") is desirably from about 1 piece/$cm^2$ to about 60 piece/$cm^2$. It is because if the formation density of the interlaced parts is within the range, the shear strength of the mat 20 becomes higher and the bulk is properly decreased.

In contrast, if the formation density of the interlaced parts is not lower than about 1 piece/$cm^2$, the number of the interlaced parts formed per unit surface area is less likely to be too low and the shear strength tends not to be low and the bulk tends to be low.

Further, if the formation density of the interlaced parts is not higher than about 60 piece/$cm^2$, the number of the interlaced parts formed per unit surface area is less likely to be too high, the bulk tends to be too low, and the repulsive force tends not to be decreased. Moreover, inorganic fibers finely cut by the needling treatment are less likely to be contained in a large quantity and the shear strength of the mat tends not to be low.

Additionally, the formation density of the interlaced parts means the total number of the interlaced parts formed in 1 $cm^2$ of the respective main cross-sections, which are confirmed by cutting the mat close to the first main surface and close to the second main surface along the plane substantially parallel to the first main surface and the second main surface in the thickness direction and observing the obtained respective main cross-sections with eyes or magnifying glass.

The shortest distance between one first interlacing starting point 21*a* and another first interlacing starting point 21*a* closest to the former and the shortest distance between one second interlacing starting point 22*a* and another second interlacing starting point 22*a* closest to the former (in the description hereinafter, also simply referred to as "interlacing starting point" without distinguishing "the first interlacing starting point" and "the second interlacing starting point") is desirable to be from about 1 mm to about 10 mm. It is because if the shortest distance between one interlacing starting point and another interlacing starting point closest to the former is from about 1 mm to about 10 mm, the interlaced parts are not so densely gathered and the shear strength of the mat 20 tends to be sufficiently high and the bulk tends to be properly low.

On the other hand, if the shortest distance between one interlacing starting point and another interlacing starting point closest to the former is not longer than about 10 mm, the number of the interlaced parts formed per unit surface area is less likely to be too low, the shear strength tends not to be low and the bulk tends to be low.

Further, if the shortest distance is not shorter than about 1 mm, the number of the interlaced parts formed per unit surface area is less likely to be high, the bulk of the mat becomes appropriately low and the repulsive force tends not to be decreased. Moreover, inorganic fibers finely cut by the needling treatment are less likely to be contained in a large quantity and the shear strength of the mat tends not to be low.

Additionally, in the present embodiment, the shortest distance between one interlacing starting point and another interlacing starting point closest to the former is entirely substantially equal.

The diameter of the interlacing starting point is desirably from about 0.1 mm to about 2 mm.

If the diameter of the interlacing starting point is within the range, the diameter of the interlacing starting points is not so large and the shear strength of the mat 20 tends to be sufficiently high.

On the other hand, if the diameter of the interlacing starting point is not longer than about 2 mm, the inorganic fibers constituting the interlacing starting points and the interlaced parts are less likely to be in the coarse state and the shear strength of the mat tends not to be low.

Further, if the diameter of the interlacing starting point is not shorter than about 0.1 mm, the inorganic fibers are more likely to be sufficiently interlaced in the interlaced parts and the shear strength of the mat tends not to be low and the bulk tends to be sufficiently low.

The weight per unit surface area of the mat 20 is desirably from about 900 g/$m^2$ to about 3000 g/$m^2$.

If the weight per unit surface area of the mat 20 is not lower than about 900 g/$m^2$, it is easier to cause the interlacing effect of needling. On the other hand, if the weight per unit surface area of the mat 20 is not higher than about 3000 g/$m^2$, it is easier to cause the thickness control effect of needling.

The weight per unit surface area of the mat 20 is more desirably from about 1500 g/$m^2$ to about 2800 g/$m^2$.

Also, the density of the mat 20 is desirably from about 0.08 g/$cm^2$ to about 0.20 g/$cm^3$.

If the density of the mat 20 is not lower than about 0.08 g/$cm^3$, it may become easier to obtain sufficient repulsive force as a holding sealing material. On the other hand, if the density of the mat 20 is not higher than about 0.20 g/$cm^3$, breakdown of the fibers due to pressure is less likely to be caused in the case where the mat is disposed as a holding sealing material between an exhaust gas treatment body and a casing.

Also, the density of the mat 20 is more desirably from about 0.10 g/$cm^2$ to about 0.15 g/$cm^3$.

The mat 20 may contain an organic binder (an organic binding material).

If a holding sealing material using a mat containing an organic binder (hereinafter, also simply referred to as a binder mat) is used for an exhaust gas purification apparatus, the organic binder is decomposed due to the high temperature exhaust gas at the time of using the exhaust gas purification apparatus, the inorganic fibers are released from adhesion and the holding seal material is more easily expanded so that the high holding force tend to be exhibited.

Additionally, the organic binder may be, for example, an acrylic resin, rubber such as acrylic rubber, a water-soluble organic polymer such as carboxymethyl cellulose or polyvinyl alcohol, a thermoplastic resin such as a styrene resin, a thermosetting resin such as an epoxy resin, or the like. Above all, acrylic rubber, acrylonitrile-butadiene rubber, or styrene-butadiene rubber is particularly desirable.

The total amount of the organic binder contained in the entire binder mat is desirably from about 0.5 wt % to about 20 wt % in the entire weight of the binder mat. It is because if the total amount of the organic binder contained in the entire binder mat is in this range, the inorganic fibers constituting the binder mat tends to be more firmly attached to one another so that the strength of the binder mat tend to be improved. Further, it is because the bulk of the binder mat tend to be lowered properly.

On the other hand, if the total amount of the organic binder contained in the entire binder mat is not lower than about 0.5 wt % in the entire weight of the binder mat, the amount of the organic binder is less likely to be too low, the inorganic fibers tend not to be scattered and the strength of the binder mat tends not to be low.

Further, if the total amount of the organic binder contained in the entire binder mat is not higher than 20 wt % in the entire weight of the binder mat, the amount of the organic components in the exhaust gas to be discharged is less likely to be increased in the case where a holding sealing material using the binder mat is used for an exhaust gas purification apparatus and therefore, a load tends not to be placed on the environments.

Next, the constitutions of a holding sealing material using the mat of the present embodiment and an exhaust gas purification apparatus will be described with reference to drawings.

Figure 11A:
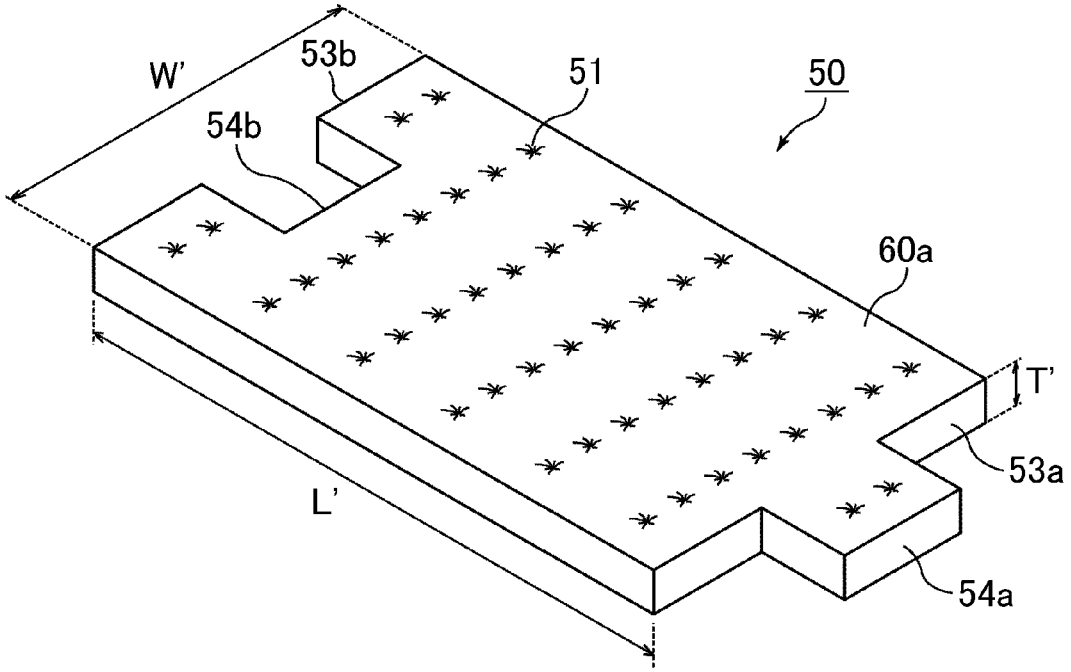
FIG. 11A and FIG. 11B are perspective views schematically showing one example of a holding seal material using a mat of a first embodiment of the present invention.
Figure 11B:
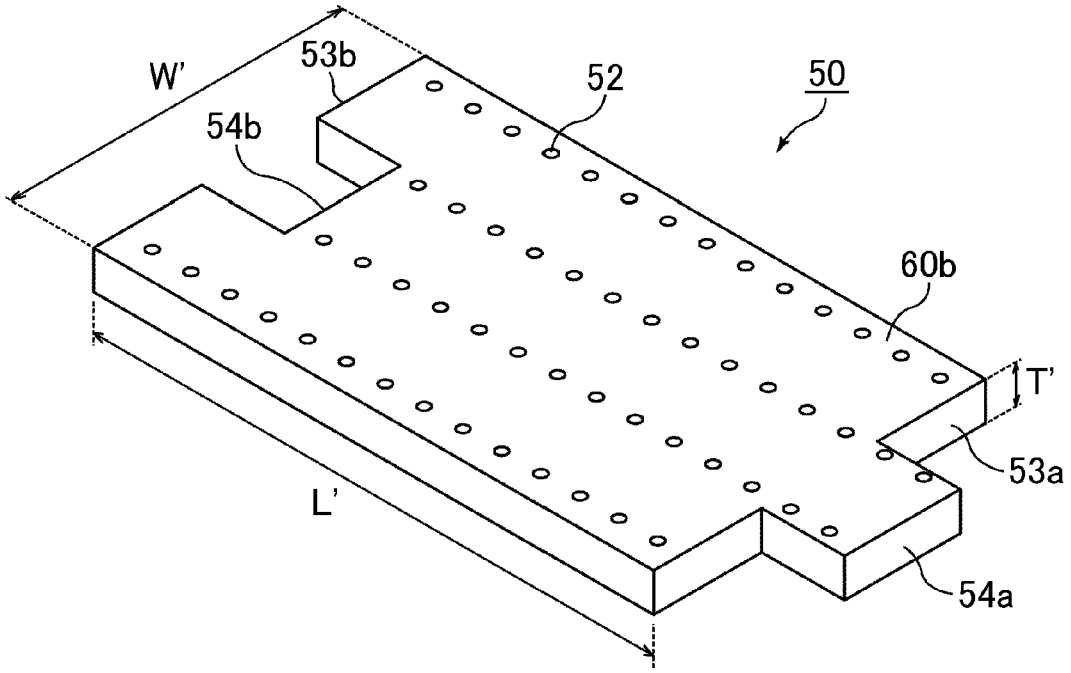

FIG. 11A and FIG. 11B are perspective views schematically showing one example of a holding sealing material using a mat of a first embodiment of the present invention.

FIG. 11A is a view of a holding sealing material observed from one direction and FIG. 11B is a view of a holding sealing material observed from another direction.

A holding sealing material 50 of the present embodiment shown in FIG. 11A and FIG. 11B is produced by cutting the mat 20 in a prescribed shape.

The shape of the holding sealing material 50 of the present embodiment shown in FIG. 11A and FIG. 11B is a substantially rectangular shape in plane view having a prescribed length (shown with the arrows L' in FIG. 11A and FIG. 11B), width (shown with the arrows W' in FIG. 11A and FIG. 11B), and thickness (shown with the arrows T' in FIG. 11A and FIG. 11B).

Further, of end surfaces 53*a* and 53*b* of the holding sealing material 50 substantially parallel to each other in the width direction, a projected portion 54*a* is formed in one end surface 53*a* and a recessed portion 54*b* with a form to be fitted with the projected portion 54*a* when the holding sealing material 50 is rolled so as to bring the end surface 53*a* and the end surface 53*b* into contact with each other is formed in the other end surface 53*b*.

The total amount of the organic binder contained in the entire holding sealing material 50 is desirably from about 0.5 wt % to about 20 wt % in the entire weight of the holding sealing material 50. It is because if the total amount of the organic binder contained in the entire holding sealing material is in this range, the inorganic fibers constituting the holding sealing material tends to be more firmly attached to one another so that the strength of the holding sealing material tends to be improved. Further, it is because the bulk of the holding sealing material tends to be lowered properly.

On the other hand, if the total amount of the organic binder contained in the entire holding sealing material is not lower than about 0.5 wt % in the entire weight of the holding sealing material, the amount of the organic binder is less likely to be too low, whereby the inorganic fibers tend not to be scattered and the strength of the holding sealing material tends not to be low.

Further, if the total amount of the organic binder contained in the entire holding sealing material is not higher than about 20 wt % in the entire weight of the holding sealing material, the amount of the organic components in the exhaust gas to be discharged is less likely to be increased in the case where the holding sealing material is used for an exhaust gas purification apparatus and therefore, a load tends not to be placed on the environments.

The size of the holding sealing material is desirable to be length from about 200 mm to about 1000 mm×width from about 50 mm to about 500 mm×thickness from about 5 mm to about 30 mm.

As shown in FIG. 11A, in a first main surface 60*a* side, first interlaced parts 51 are arranged on substantially straight lines in the direction substantially parallel to the width direction W' of the holding sealing material 50. The direction of rows formed by the first interlaced part group is a direction substantially parallel to the width direction W' of the holding sealing material 50.

Also, as shown in FIG. 11B, in a second main surface 60*b* side, second interlaced parts 52 are arranged on substantially straight lines in the direction substantially parallel to the length direction L' of the holding sealing material 50. The direction of rows formed by the second interlaced part group is a direction substantially parallel to the length direction L' of the holding sealing material 50.

Since the width direction W' and length direction L' of the holding sealing material 50 are substantially orthogonal, the smaller angle is about 90° of angles formed between the direction of the rows formed by the first interlaced part group and the direction of the rows formed by the second interlaced part group.

Additionally, the width direction W' of the holding sealing material 50 is a direction substantially perpendicular to the rounded surface direction of the exhaust gas treatment body in the case where the holding sealing material is disposed between the exhaust gas treatment body and the casing and a direction substantially parallel to the longitudinal direction of the exhaust gas treatment body. That is, the width direction W' of the holding sealing material 50 is the X-direction.

Further, the length direction L' of the holding sealing material 50 is a direction substantially parallel to the rounded surface direction of the exhaust gas treatment body in the case where the holding sealing material is disposed between the exhaust gas treatment body and the casing and a direction substantially perpendicular to the longitudinal direction of the exhaust gas treatment body. That is, the length direction L' of the holding sealing material 50 is the Y-direction.

The holding sealing material 50 can be used preferably for an exhaust gas purification apparatus.

The constitution of an exhaust gas purification apparatus using the holding sealing material 50 will be described with reference to drawings.

Figure 12A:
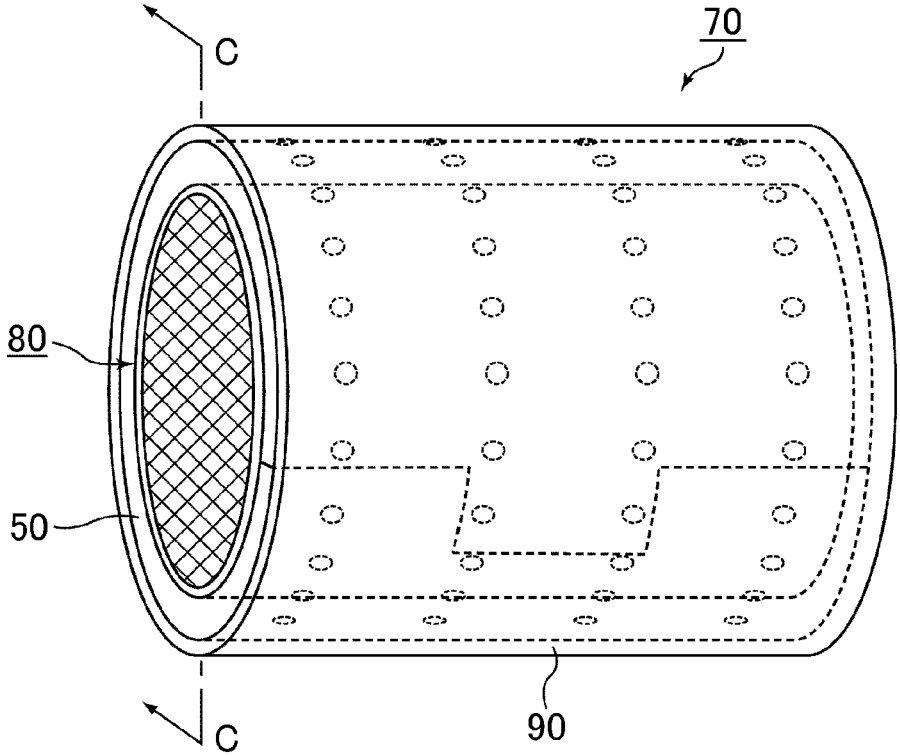
FIG. 12A is a perspective view schematically showing an exhaust gas purification apparatus of a first embodiment of the present invention.
Figure 12B:
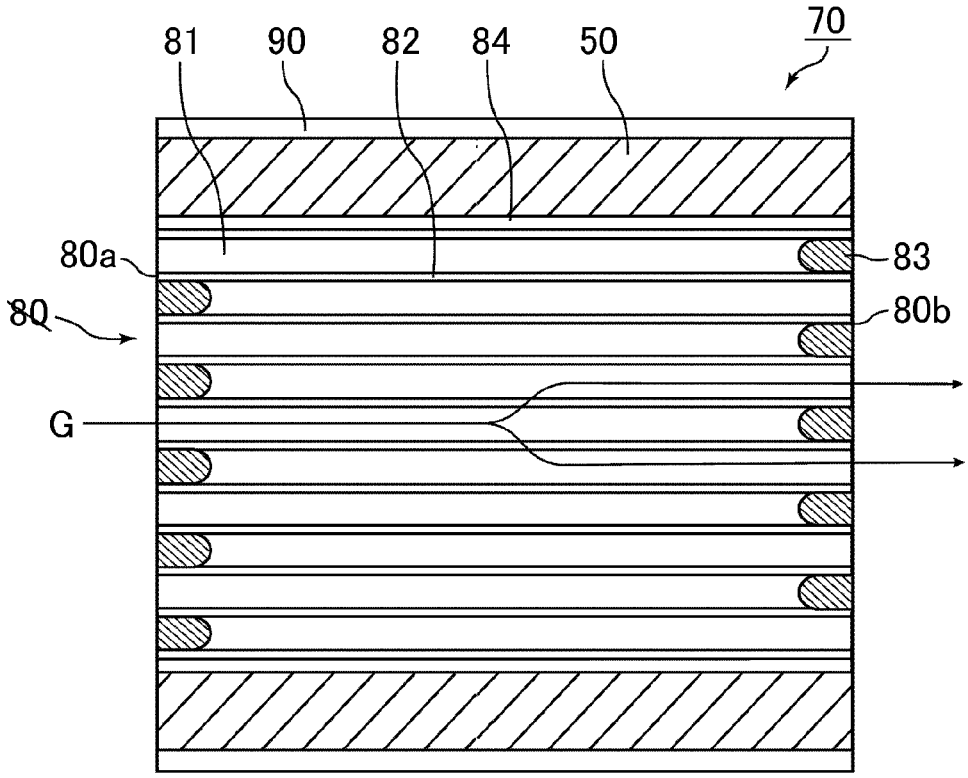
FIG. 12B is a C-C line cross-sectional view of the exhaust gas purification apparatus shown in FIG. 12A.

FIG. 12A is a perspective view schematically showing an exhaust gas purification apparatus of a first embodiment of the present invention and FIG. 12B is a C-C line cross-sectional view of the exhaust gas purification apparatus shown in FIG. 12A.

Figure 13A:
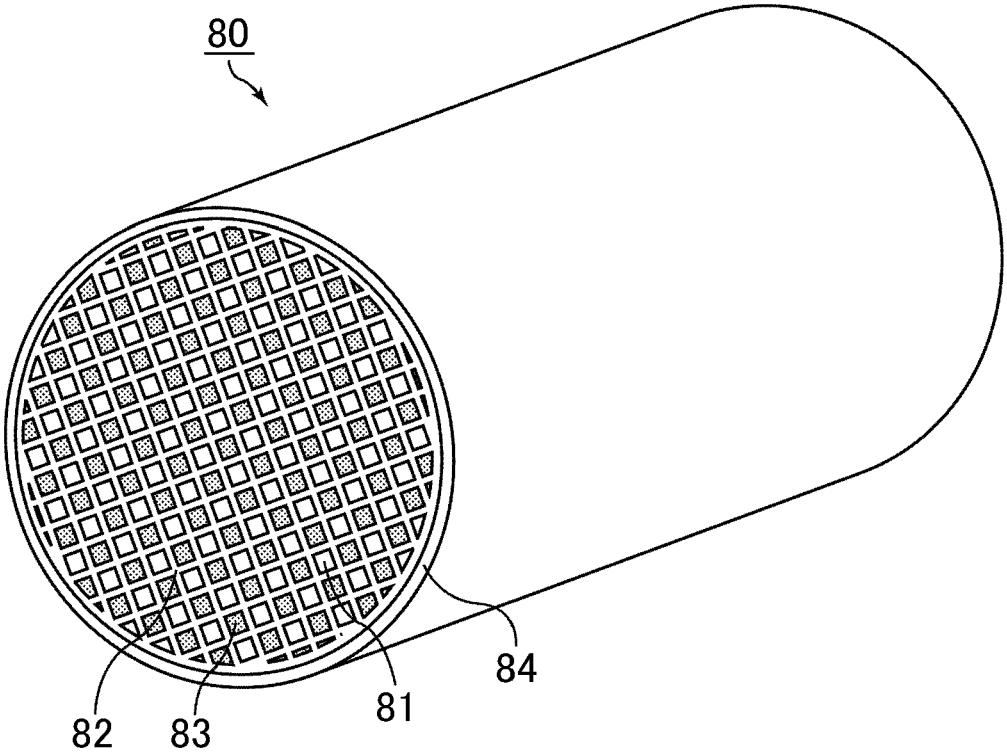
FIG. 13A is a perspective view schematically showing an exhaust gas treatment body constituting the exhaust gas purification apparatus shown in FIG. 12A.
Figure 13B:
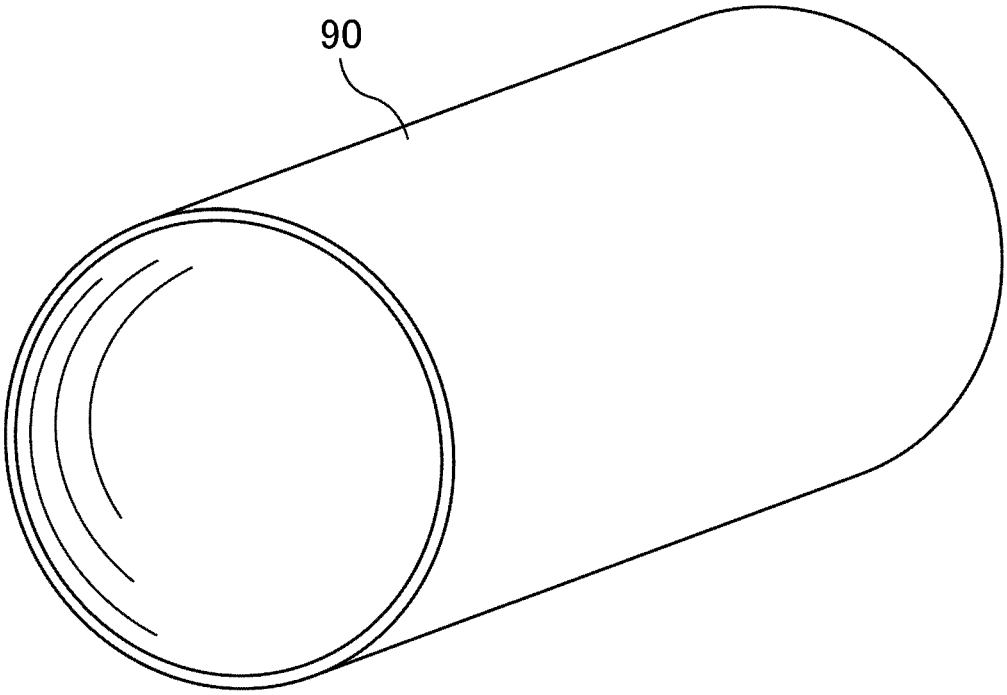
FIG. 13B is a perspective view schematically showing a casing constituting the exhaust gas purification apparatus shown in FIG. 12A.

FIG. 13A is a perspective view schematically showing an exhaust gas treatment body constituting the exhaust gas purification apparatus shown in FIG. 12A and FIG. 13B is a perspective view schematically showing a casing constituting the exhaust gas purification apparatus shown in FIG. 12A.

As shown in FIG. 12A, FIG. 12B, and FIG. 13A, an exhaust gas purification apparatus 70 of the present embodiment is constituted by a column-like exhaust gas treatment body 80 in which a large number of cells 81 are arranged in the longitudinal direction with being partitioned by cell walls 82, a casing 90 for housing the exhaust gas treatment body 80, and the holding sealing material 50 of the present embodiment disposed between the exhaust gas treatment body 80 and the casing 90 to hold the exhaust gas treatment body 80.

Since it has been already described, the constitution of the holding sealing material 50 is omitted.

Additionally, an introduction pipe for introducing exhaust gas discharged out of an internal combustion engine and a discharge pipe for discharging exhaust gas passed through the exhaust gas purification apparatus outside may be connected to the end parts of the casing 90.

As shown in FIG. 13A, the exhaust gas treatment body 80 of the present embodiment is made from mainly a porous ceramic and its shape is a substantially column shape. Further, for the purpose of reinforcing the outer circumferential part of the exhaust gas treatment body 80, adjusting the shape, or improving the heat insulation property of the exhaust gas treatment body 80, a coat layer 84 is provided on the outer circumference of the exhaust gas treatment body 80.

Furthermore, either one end part of the respective cells of the exhaust gas treatment body 80 is sealed by a seal material 83.

In addition, the exhaust gas treatment body 80 may be made from, for example, cordierite or aluminum titanate, and may be formed integrally as shown in FIG. 13A. Also, the exhaust gas treatment body may be an exhaust gas treatment body made from silicon carbide or silicon-containing silicon carbide and obtained by binding a plurality of column-like honeycomb fired bodies in which a large number of cells are arranged in the longitudinal direction with being partitioned by cell walls through an adhesive material layer containing mainly a ceramic interposed therebetween.

The casing 90 will be described. The casing 90 shown in FIG. 13B is made from mainly a metal such as stainless steel and the shape thereof is substantially a cylindrical shape. Its inner diameter is made slightly shorter than the diameter of the wound body of the exhaust gas treatment body 80 on which the holding sealing material 50 is wound, and its length is substantially the same as the length of the exhaust gas treatment body 80 in the longitudinal direction.

Additionally, the material of the casing is not limited to stainless steel as described above and may be metals such as aluminum and iron as long as the metals have heat resistance.

Further, usable as the casing are a casing obtained by dividing a substantially cylindrical casing along the longitudinal direction into a plurality of casing pieces (that is, a clamshell), a substantially cylindrical casing having a slit (an open part) extended along the longitudinal direction and a C-shaped or U-shaped cross section, and a metal sheet to be a substantially cylindrical casing by winding the sheet on the holding sealing material wound on the exhaust gas treatment body.

The reasons for that exhaust gas is purified by the exhaust gas purification apparatus 70 having the above constitution will be described below with reference to FIG. 12B.

As shown in FIG. 12B, the exhaust gas discharged out of an internal combustion engine and flowing in the exhaust gas purification apparatus 70 (in FIG. 12B, the exhaust gas is shown by G and the flow of the exhaust gas is shown with the arrow) flows in one cell 81 opened in an exhaust gas flowing side end surface 80*a* of the exhaust gas treatment body 80 and passes through the cell wall 82 partitioning the cell 81. At this time, the particulate matter (hereinafter, also simply referred to as PM) of the exhaust gas is collected by the cell wall 82 and the exhaust gas is purified. The purified exhaust gas flows out of another cell 81 opened in an exhaust gas flowing out side end surface 80*b* and is discharged outside.

Next, a method for producing the mat of the present embodiment, a method for producing a holding sealing material using the produced mat, and a method for producing an exhaust gas purification apparatus using the produced holding sealing material will be described.

The mat of the present embodiment is produced through the following steps (1) to (4).

Herein, the case of producing a mat containing alumina-silica fibers will be described; however, the inorganic fibers constituting the mat of the present embodiment are not limited to alumina-silica fibers, and may be the inorganic fibers with various compositions such as alumina fibers described above.

(1) Spinning Step

A silica sol is added to an aqueous basic aluminum chloride solution adjusted so as to have prescribed values of Al content and the atomic ratio of Al and Cl in such a manner of adjusting the composition ratio of the inorganic fibers after firing to $Al_2O_3$:$SiO_2$=from about 60:about 40 to about 80:about 20 (weight ratio). Further, for the purpose of improving formability, a proper amount of an organic polymer is added to produce a mixed solution.

The obtained mixed solution is concentrated to give a mixture for spinning. The mixture for spinning is spun by a blowing method to produce an inorganic fiber precursor having a prescribed average fiber diameter.

The blowing method is a method of spinning a mixture for spinning which is extruded out of a nozzle for supplying a mixture for spinning to the high rate gas flow (air flow) blown out of an air nozzle to spin an inorganic fiber precursor.

(2) Compaction Step

Next, the inorganic fiber precursor is layered by a cross-layer method to produce a precursor sheet with a predetermined size.

In the cross-layer method, a layering apparatus constituted by a belt conveyer for transportation in a prescribed direction and an arm capable of reciprocating in the direction substantially orthogonal to the transportation direction of the belt conveyer for supplying the inorganic fiber precursor (precursor web) compacted in a thin layer sheet is used.

In the case of producing the precursor sheet using the layering apparatus by the cross-layer method, first, the belt conveyer is operated for transportation. In this state, while arm is reciprocated in the direction substantially orthogonal to the transportation direction of the belt conveyer, the precursor web is supplied continuously on the belt conveyer. While folded and layered on the belt conveyer a plurality of times, the precursor web is continuously transported in a prescribed direction by the belt conveyer. When the length of the layered precursor web becomes a length proper for handling, the layered precursor web is cut to produce a precursor sheet with a prescribed size.

In the precursor sheet produced by the cross-layer method, most of inorganic fiber precursor is arranged along a direction substantially parallel to the first main surface and the second main surface and moderately interlaced with one another.

(3) Needling Step

In the needling step, needling treatment is carried out using a needling apparatus shown in the following FIG. 14A and FIG. 15A.

Figure 14A:
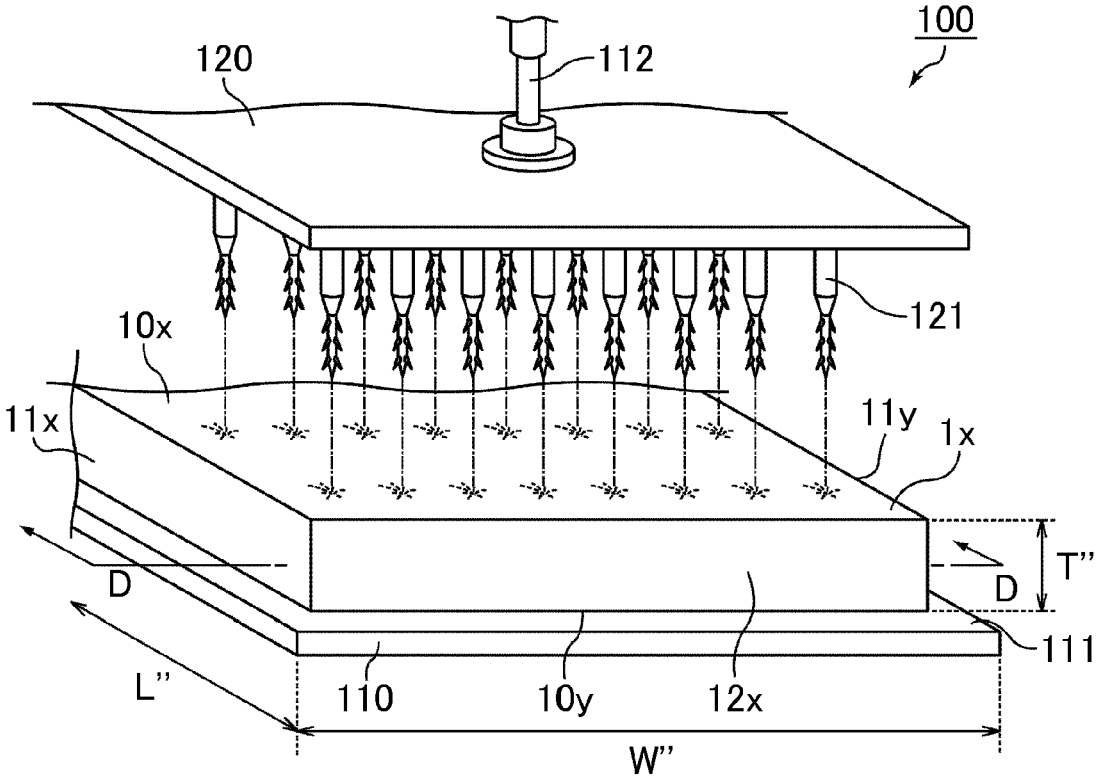
FIG. 14A is a perspective view schematically showing a needling apparatus and a precursor sheet to be used in a method for producing the mat of the present embodiment.
Figure 14B:
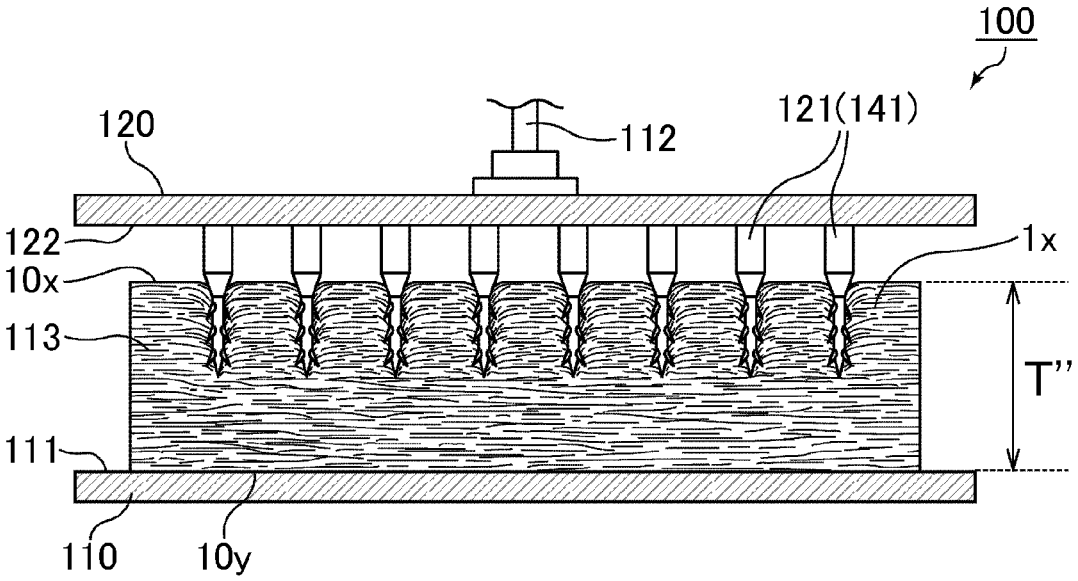
FIG. 14B is a D-D line cross-sectional view of a needling apparatus and a precursor sheet in the case where needles are inserted in the precursor sheet in the method for producing a mat of the present embodiment.

FIG. 14A is a perspective view schematically showing a needling apparatus and a precursor sheet to be used in the method for producing a mat of the present embodiment and FIG. 14B is a D-D line cross-sectional view of a needling apparatus and a precursor sheet in the case where needles are inserted in the precursor sheet in the method for producing a mat of the present embodiment.

Figure 15A:
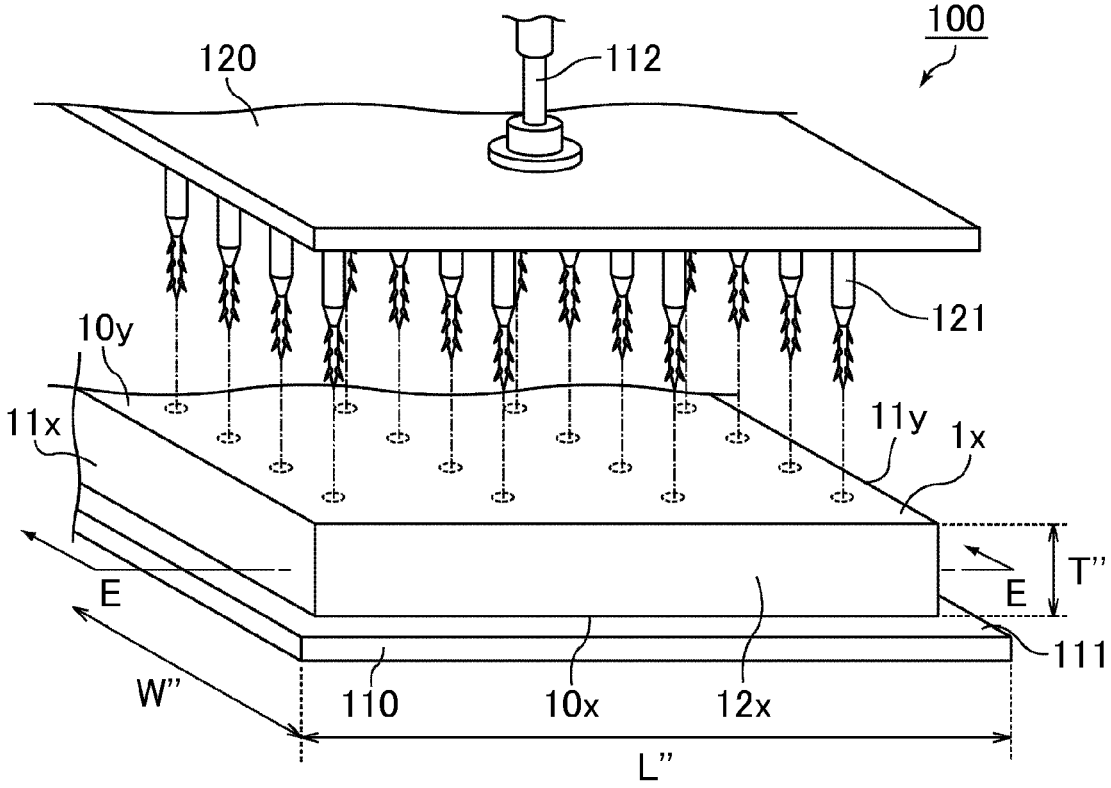
FIG. 15A is a perspective view schematically showing a needling apparatus and a precursor sheet to be used in a method for producing the mat of the present embodiment.
Figure 15B:
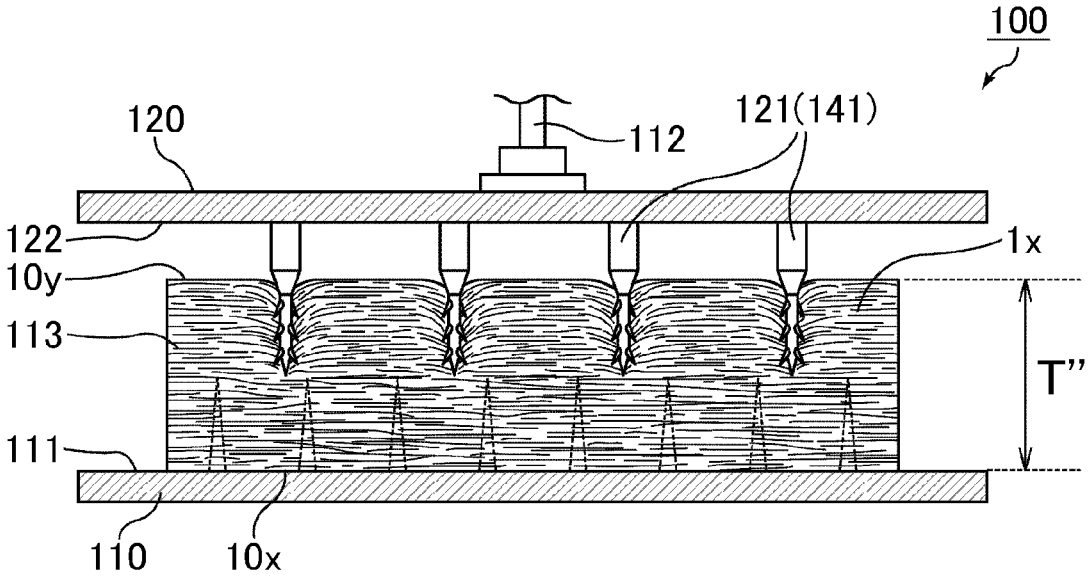
FIG. 15B is an E-E line cross-sectional view of a needling apparatus and a precursor sheet in the case where needles are inserted in the precursor sheet in the method for producing a mat of the present embodiment.

FIG. 15A is a perspective view schematically showing a needling apparatus and a precursor sheet to be used in the method for producing a mat of the present embodiment and FIG. 15B is an E-E line cross-sectional view of a needling apparatus and a precursor sheet in the case where needles are inserted in the precursor sheet in the method for producing a mat of the present embodiment.

A needling apparatus 100 shown in FIG. 14A is constituted by a supporting plate 110 having a mount surface 111 capable of supporting a precursor sheet 1*x* and a needle plate 120 attached to the tip end of a piston 112 provided facing to the mount surface 111 of the supporting plate 110 and capable of reciprocating in the piercing direction (the thickness direction of the precursor sheet 1X, the direction shown by both arrows T" in FIG. 14A and FIG. 14B).

A plurality of needles 121 are attached at prescribed intervals in an opposite surface 122 of the needle plate 120 facing to the supporting plate 110, the shape of which is like a pinholder.

The needles 121 are thinly tapered needles and barbs are formed in the needle surface.

The needles 121 are aligned at prescribed intervals in substantially straight lines along the width direction W" of the supporting plate 110 and a plurality of needle rows 141 are formed. A plurality of the needle rows 141 are substantially parallel to one another. The distance between neighboring two needles 121 in the width direction W" is all substantially equal and the distance between neighboring two needle rows 141 is also all substantially equal. The distance between neighboring two needles 121 in the width direction W" is narrower than the distance between neighboring two needle rows 141.

The precursor sheet 1*x* has a first main surface 10*x*, a second main surface 10*y* facing to the first main surface 10*x*, a first long side surface 11*x*, a second long side surface 11*y* facing to the first long side surface 11*x*, a first short side surface 12*x*, a second short side surface (not illustrated) facing to the first short side surface 12*x*, and is a sheet constituted by interlacing inorganic fiber precursor 113 with one another which is converted into inorganic fibers by firing.

In the case where the needling treatment is carried out using the needling apparatus 100, (3-1) a first needling step and (3-2) a second needling step are carried out.

(3-1) First Needling Step

First, the precursor sheet 1*x* is set on the mount surface 111 of the supporting plate 110 in such a manner that the width direction of the precursor sheet 1*x* and the needle rows 141 are substantially parallel (see FIG. 14A).

Next, the needle plate 120 is moved up and down along the thickness direction of the precursor sheet 1*x*.

As a result, as show in FIG. 14*b*, the needles 121 are inserted from the first main surface 10*x* to the middle points between the first main surface 10*x* and the second main surface 10*y* of the precursor sheet 1*x*, and the inserted needles 121 are pulled out of the precursor sheet 1*x*. Consequently, a first interlaced part precursor is formed. The first interlaced part precursor is converted into the first interlaced part by firing the precursor sheet 1*x*.

(3-2) Second Needling Step

Successively, the precursor sheet 1*x* is turned back and the precursor sheet 1*x* is set on the mount surface 111 of the supporting plate 110 in such a manner that the width direction of the precursor sheet 1*x* and the needle rows 141 are substantially perpendicular (see FIG. 15A).

Additionally, the needling apparatus 100 shown in FIG. 15A and the needling apparatus 100 shown in FIG. 14A are the same needling apparatus and FIG. 14A and FIG. 15A are drawings of the same needling apparatus 100 viewed from different directions.

Next, the needle plate 120 is move up and down in the thickness direction of the precursor sheet 1*x*.

As a result, as shown in FIG. 15B, the needles 121 are inserted from the second main surface 10*y* to the middle points between the first main surface 10*x* and the second main surface 10*y* of the precursor sheet 1*x*, and the inserted needles 121 are pulled out of the precursor sheet 1*x*. Consequently, a second interlaced part precursor is formed. The second interlaced part precursor is converted into the second interlaced part by firing the precursor sheet 1*x*.

Additionally, although the first interlaced part precursor is shown by the dotted line in FIG. 15B; however, actually the first interlaced part precursor is not seen in the E-E line cross-section.

As described above, the first interlaced part precursor and the second interlaced part precursor are formed in the precursor sheet 1*x* by (3-1) first needling step and (3-2) second needling step and the needling treatment is completed. The rows formed by the first interlaced part precursor and the rows formed by the second interlaced part precursor are orthogonal.

A needling precursor sheet is produced in such a manner.

In the second needling step of the present embodiment, there is description the case where after the precursor sheet 1*x* is turned back, the precursor sheet 1*x* is set on the mount surface 111 of the supporting plate 110 in such a manner that the width direction of the precursor sheet 1*x* and the needle rows 141 are substantially perpendicular.

However, the second needling step in the present invention is not limited to this example. In the second needling step in the present invention, in the case of setting the precursor sheet on the mount surface of the supporting plate after the precursor sheet is turned back, the width direction of the precursor sheet and the direction of the needle rows are made properly different so that the direction of the rows formed by the first interlaced part precursor and the direction of the rows formed by the second interlaced part precursor can be made properly different from each other.

At this time, the smaller angle of angles formed between the width direction of the precursor sheet and the direction of the needle rows is adjusted to desirably from about 60° to about 90°, more desirably from about 85° to about 90°, and even more desirably about 90° as in the present embodiment. In the case where the smaller angle of angles formed between the width direction of the precursor sheet and the direction of the needle rows is not smaller than about 60°, the problems of the conventional techniques are more likely to be sufficiently solved.

(4) Firing Step

Successively, the obtained needling precursor sheet is fired at a highest temperature of about 1000 to 1600° C. to convert the inorganic fiber precursor into inorganic fibers and the mat of the present embodiment is produced.

(5) Forming and Cutting Step

In the case where the produced mat is used as a holding sealing material, the produced mat is cut to produce a holding sealing material having a prescribed size.

At this time, a punching apparatus including a punching plate attached to a tip end of a piston and capable of reciprocating in the up and down direction and a mount plate facing to the punching plate and on which a mat can be mounted is used.

A punching blade with a shape corresponding to the outer shape of a holding sealing material to be produced and an elastic member made from expansive and contractive rubber or the like are fixed in the punching plate. Further, a through hole is provided in the mount plate in the position corresponding to the punching blade so as to keep the punching blade from being contact with the mount plate in the case where the punching plate approaches the mount plate.

In the case where a holding sealing material is produced by punching using the punching apparatus, the mat is set on the mount plate and the punching plate is moved in the up and down direction.

As a result, the mat is pushed against the elastic member and shrunk in the thickness direction of the mat and at the same time, the punching blade inserts in the inside of the mat from one main surface side of the mat and the punching blade penetrates the mat.

Consequently, a holding sealing material with a prescribed shape as shown in FIG. 11A and FIG. 11B is produced by punching.

Additionally, since regions near the edge parts of the mat may possibly have uneven weight distribution, it is desirable not to use the regions of a range of from about 50 mm to about 100 mm from the edge parts of the mat.

In the present embodiment, at the time of punching the mat to obtain a holding sealing material, substantially the same holding sealing materials can be obtained by carrying out punching from different directions.

This will be described with reference to FIG. 16.

Figure 16:
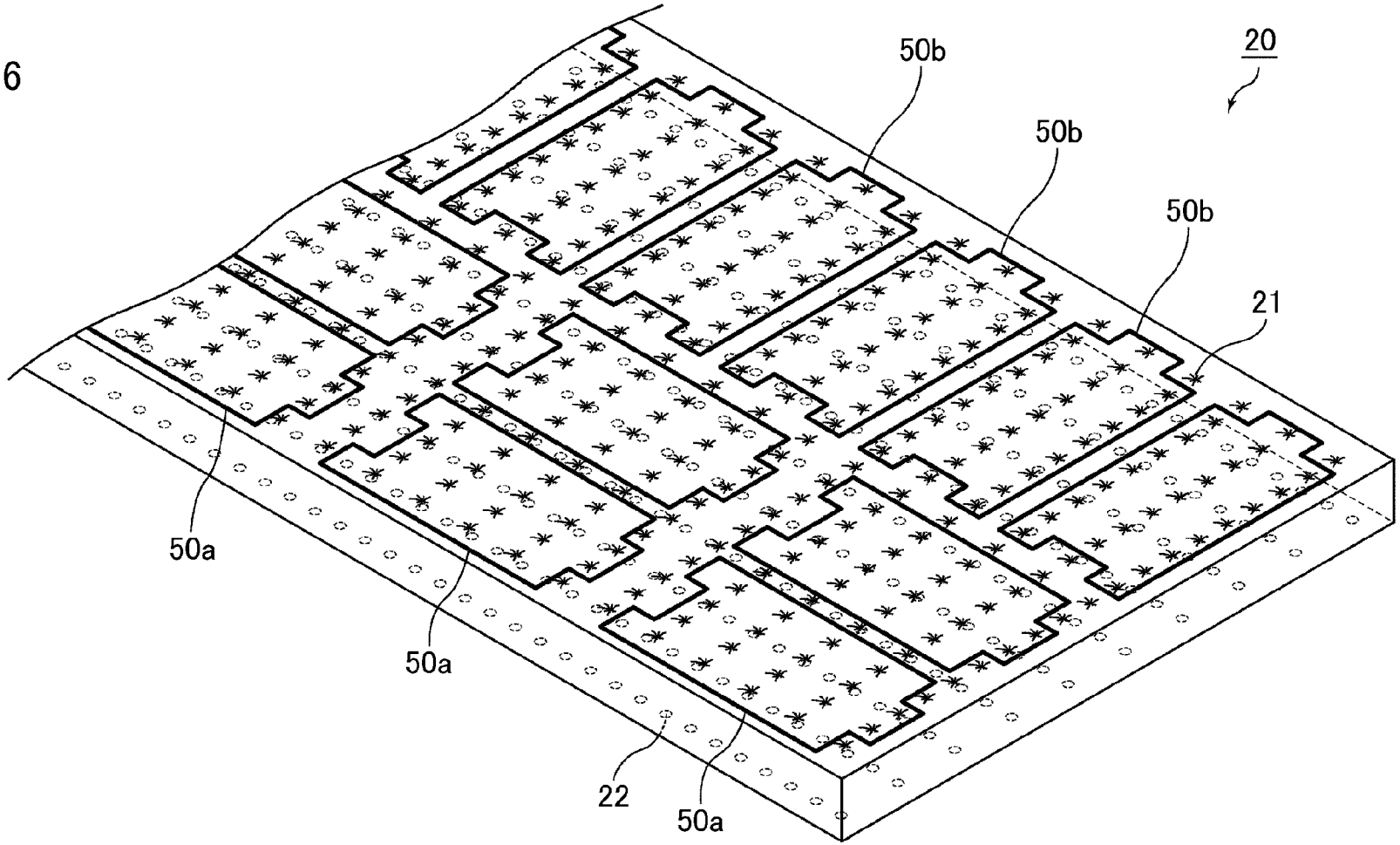
FIG. 16 is an explanatory view schematically showing the condition where a mat of one embodiment of the present invention is punched out to give a holding seal material.

FIG. 16 is an explanatory view schematically showing the condition where a mat of one embodiment of the present invention is punched out to give a holding sealing material.

The holding sealing material 50*a* is obtained by punching the mat 20 in such a manner that the longitudinal direction of the holding sealing material 50*a* is substantially perpendicular to the width direction of the mat 20. The holding sealing material 50*b* is obtained by punching the mat 20 in such a manner that the longitudinal direction of the holding sealing material 50*b* is substantially parallel to the width direction of the mat 20.

Herein, the first interlaced parts 21 and the second interlaced parts 22 are formed in the mat 20. The first interlaced parts 21 are arranged so as to form rows in a direction substantially parallel to the width direction of the mat 20. The second interlaced parts 22 are arranged so as to form rows in a direction substantially perpendicular to the width direction of the mat 20.

Consequently, the holding sealing material 50*a* and the holding sealing material 50*b* are the substantially same holding sealing material 50.

Additionally, the first interlaced parts 21 in the mat 20 become the first interlaced parts 51 in the holding sealing material 50*a* and the second interlaced parts 22 in the mat 20 become the first interlaced parts 52 in the holding sealing material 50*a*. Further, the first interlaced parts 21 in the mat 20 become the second interlaced parts 52 in the holding sealing material 50*b* and the second interlaced parts 22 in the mat 20 become the first interlaced parts 51 in the holding sealing material 50*b*.

The mat 20 produced in the above manner is equivalent to the mat of the present invention and the holding sealing material 50 is also equivalent to the mat of the present invention. The mat in the present invention may be a material from which the following holding sealing material is produced by punching or may be the following holding sealing material itself.

The holding sealing material is a holding sealing material containing inorganic fibers and having a first main surface and a second main surface, the holding sealing material including a first interlaced part group constituted by arranging, in rows, a plurality of first interlaced parts constituted by interlacing the inorganic fibers with one another and formed from points on the first main surface to points present between the first main surface and the second main surface; and a second interlaced part group constituted by arranging, in rows, a plurality of second interlaced parts constituted by interlacing the inorganic fibers with one another and formed from points on the second main surface to points present between the first main surface and the second main surface, wherein the direction of rows formed by the first interlaced part group and the direction of rows formed by the second interlaced part group are different from each other.

In the case where an exhaust gas purification apparatus is produced using the holding sealing material produced through the step (5), the production may be carried out by subjecting the produced holding sealing material to the following step (6).

Hereinafter, the step (6) of producing an exhaust gas purification apparatus will be described with reference to drawings.

Figure 17:
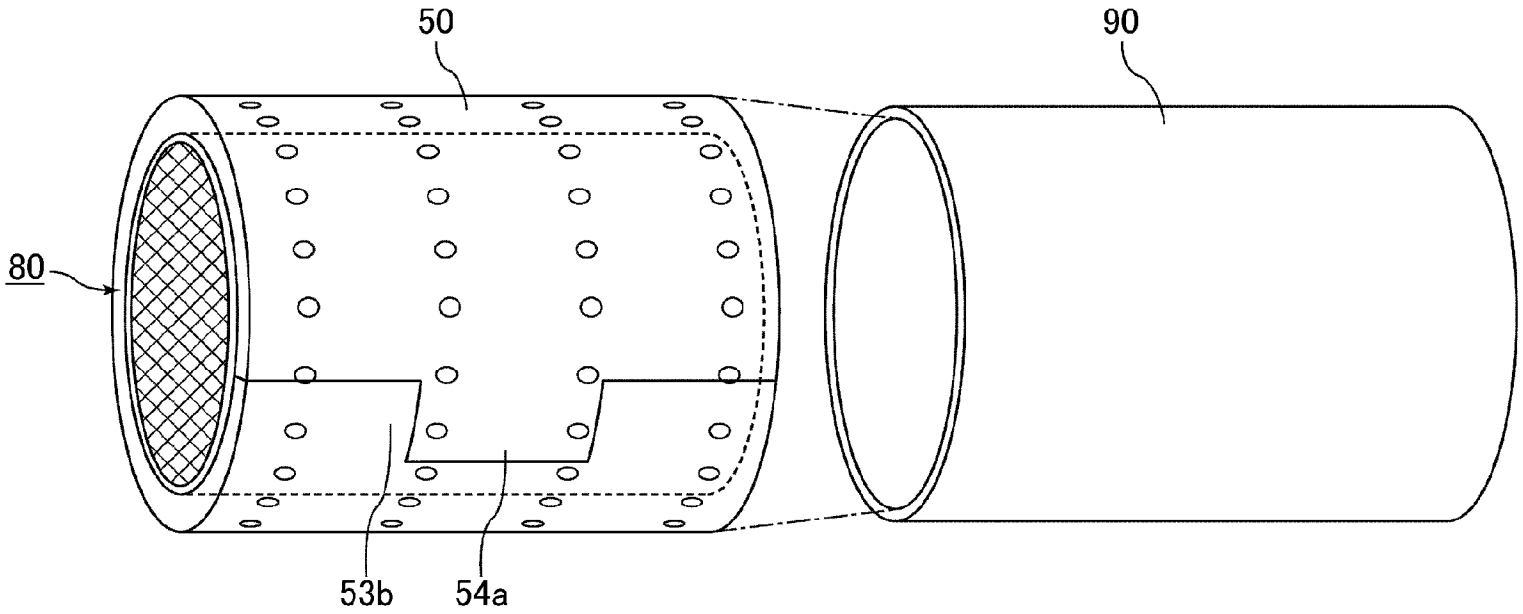
FIG. 17 is a perspective view schematically showing the condition of producing an exhaust gas purification apparatus by using a holding seal material, an exhaust gas treatment body, and a casing constituting an exhaust gas purification apparatus of a first embodiment of the present invention.

FIG. 17 is a perspective view schematically showing the condition of producing an exhaust gas purification apparatus by using a holding sealing material, an exhaust gas treatment body, and a casing constituting an exhaust gas purification apparatus of a first embodiment of the present invention.

(6) Stuffing Step

The holding sealing material 50 produced in the step (5) is wound on the column-like exhaust gas treatment body (honeycomb filter) 80 in such a manner that the projected portion 54*a* and the recessed portion 54*b* are fitted with each other. Thereafter, as shown in FIG. 17, the exhaust gas treatment body 80 on which the holding sealing material 50 is wound is stuffed into the cylindrical casing 90 having a prescribed size and made from mainly a metal or the like.

At the time of stuffing, a stuffing jig may be used which is made from a tapered cylindrical body and has an inner diameter in one end part slightly smaller than the inner diameter of the end part of the casing and an inner diameter in the other end part sufficiently larger than the outer diameter of the exhaust gas treatment body including the holding seal material.

Further, the holding sealing material 50 may be disposed between the exhaust gas treatment body 80 and the casing 90 without using the stuffing method but using the clamshell method.

Through the above steps, the exhaust gas purification apparatus 70 of the present embodiment as shown in FIG. 12A and FIG. 12B is produced.

Hereinafter, the effect of the mat 20 of a first embodiment of the present invention and a method for producing the mat 20 will be exemplified.

(1) According to the mat of the present embodiment, the holding sealing material of the present embodiment tends to be produced by punching. In the holding sealing material of the present embodiment, the direction of the rows formed by the first interlaced part group is the X-direction. Accordingly, at the time of carrying out an operation of winding the holding sealing material on the outer circumference of the exhaust gas treatment body, folding lines tend to be formed by the interlaced parts arranged in the X-direction and therefore, the operation of the winding tends to be carried out easily.

(2) According to the mat of the present embodiment, the holding sealing material of the present embodiment tend to be produced by punching. According to the holding sealing material of the present embodiment, at the time of winding the holding sealing material on the outer circumference of the exhaust gas treatment body, interlaced parts are formed with high density in the direction in which the holding sealing material is extended (that is, the Y-direction) in the second main surface side. Consequently, many portions in which fibers are interlaced tend to be present in the direction in which the holding seal material is extended and therefore, the holding seal material is hardly extended and cut.

(3) According to the mat of the present embodiment, at the time of punching the mat to produce a holding sealing material, even if the punching is carried out from different directions, the same holding sealing materials tend to be obtained and a remnant material tends to be reduced and thus the yield tends to be improved.

(4) According to the mat of the present embodiment, the holding sealing material of the present embodiment tends to be produced by punching. According to the holding sealing material of the present embodiment, at the time of winding the holding sealing material on the outer circumference of the exhaust gas treatment body, the holding sealing material is easy to be extended and therefore easy to be deformed since the interlaced parts are not formed with high density in the direction in which the holding sealing material is extended (that is, the Y-direction) in the first main surface side. Consequently, wrinkles are hardly formed at the time of disposing the conventional holding sealing material between the exhaust gas treatment body and the casing by the stuffing method.

(5) According to the mat of the present embodiment, the holding sealing material of the present embodiment tends to be produced by punching. According to the holding sealing material of the present embodiment, folding lines formed by a plurality of the interlaced parts arranged in the X-direction tend to be set inward by winding the mat on the exhaust gas treatment body in such a manner that the main surface in the side where the interlaced parts are formed in the direction close to the X-direction is to be bonded to the exhaust gas treatment body. Consequently, in the case where the mat is disposed between the exhaust gas treatment body and the casing by the clamshell method, the mat tends to be prevented from being protruded between casing members.

The holding sealing material of the present embodiment tends to exert the effect (4) and at the same time tends to exert the effect (5).

(6) Since the mat of the present embodiment contains an organic binder, at the time of using an exhaust gas purification apparatus, the organic binder is decomposed due to the high temperature exhaust gas, and the inorganic fibers are released from adhesion and the holding seal material is more likely to be expanded and thus, it tends to exhibit high holding force.

(7) The inorganic fibers constituting the mat of the present embodiment are at least one kind selected from the group consisting of alumina fibers, ceramic fibers, alumina-silica fibers, silica fibers, glass fibers, and bio-soluble fibers.

Since these inorganic fibers are excellent in properties such as heat resistance, the holding sealing material is more likely to be excellent in heat resistance, holding force, and the like.

Further, in the case where the inorganic fibers constituting the mat include bio-soluble fibers, even if the bio-soluble fibers are scattered and taken in a living body at the time of handling the holding sealing material, the bio-soluble fibers are more easily dissolved and discharged out of the living body and thus, the holding sealing material is more likely to be excellent in safety for human body.

(8) By the method for producing a mat of the present embodiment, the mat of the present embodiment having the above constitution and effects tends to be produced preferably.

EXAMPLES

Example 1

A mat of the first embodiment was produced through the following steps (1) to (4).

(1) Spinning Step

A silica sol was added to an aqueous basic aluminum chloride solution adjusted so as to have an Al content of 70 g/L and a ratio of Al:Cl=1:1.8 (atomic ratio) in such a manner of adjusting the composition ratio of the inorganic fibers after firing to $Al_2O_3$:$SiO_2$=72:28 (weight ratio) and further, a proper amount of an organic polymer (polyvinyl alcohol) was added to produce a mixed solution.

The obtained mixed solution was concentrated to give a mixture for spinning. The mixture for spinning was spun by a blowing method to produce an inorganic fiber precursor.

The average fiber length of the inorganic fiber precursors was 100 mm and the average fiber diameter thereof was 8.0 μm.

(2) Compaction Step

The inorganic fiber precursor obtained in the step (1) was compacted by a cross-layer method to produce a continuous precursor sheet with a prescribed size.

(3) Needling Step

A needling apparatus having the substantially same constitution as that of the needling apparatus shown in FIG. 14A and FIG. 15A was made ready.

Next, the precursor sheet was set on a mount surface of a supporting plate in such a manner that the width direction of the precursor sheet and needle rows were parallel.

Thereafter, a needle plate positioned above the supporting plate and the precursor sheet was moved down along the thickness direction of the precursor sheet, so that needles were inserted from a first main surface to middle points between the first main surface and a second main surface and then the needles were pulled out of the precursor sheet.

Successively, the precursor sheet was turned back and the precursor sheet was set on the mount surface of the supporting plate in such a manner that the width direction of the precursor sheet and the needle rows were perpendicular.

Thereafter, the needle plate positioned above the supporting plate and the precursor sheet was moved down along the thickness direction of the precursor sheet, so that the needles were inserted from the second main surface to the middle points between the first main surface and the second main surface and then the needles were pulled out of the precursor sheet.

A needling precursor sheet was produced in such a manner.

(4) Firing Step

Successively, the needling precursor sheet was fired at a highest temperature of about 1250° C. to convert the inorganic fiber precursor into inorganic fibers and the mat of the first embodiment was produced.

The produced mat was constituted by interlacing alumina-silica fibers and the weight per unit surface area was 1050 g/m$^2$.

The size of the mat was length 1000 mm×width 700 mm×thickness 7 mm.

The density (bulk density) of the mat was 0.15 g/cm$^3$.

First interlaced parts were formed from the points on the first main surface to the points present between the first main surface and the second main surface. Further, second interlaced parts were formed from the points on the second main surface to the points present between the first main surface and the second main surface.

The rows formed by first interlaced part group and the rows formed by second interlaced part group were orthogonal.

The shortest distance between one first interlaced part and another first interlaced part closest to the former was entirely equal and 5 mm. Also, the shortest distance between one second interlaced part and another second interlaced part closest to the former was entirely equal and 5 mm.

Further, an exhaust gas purification apparatus of the first embodiment was produced through the following steps (5) to (8).

(5) Forming and Cutting Step

The mat produced through the steps (1) to (4) was punched to produce a holding sealing material using a punching apparatus. At this time, the mat was punched to produce a holding sealing material in such a manner that the longitudinal direction of the holding sealing material was perpendicular to the width direction of the mat and the mat was punched to produce a holding sealing material in such a manner that the longitudinal direction of the holding sealing material was parallel to the width direction of the mat (see FIG. 8 and FIG. 16).

As described above, the holding sealing material produced by punching in such a manner that the longitudinal direction of the holding sealing material was perpendicular to the width direction of the mat and the holding sealing material produced by punching in such a manner that the longitudinal direction of the holding sealing material was parallel to the width direction of the mat were the same holding sealing materials.

The size of the holding sealing material was length 310 mm×width 110 mm×thickness 7 mm.

Additionally, since the weight distribution in the regions close to the edge parts of the mat may possibly be uneven, the regions of 100 mm from the edge parts of the mat were not used.

The holding sealing material obtained by punching the mat as described above had a plurality of first interlaced parts arranged in rows in one main surface side and a plurality of second interlaced parts arranged in rows in the other main surface side. The direction of the rows formed by first interlaced part group was parallel to the width direction of the holding sealing material and the direction of the rows formed by second interlaced part group was parallel to the longitudinal direction of the holding sealing material. The width direction and longitudinal direction of the holding sealing material were orthogonal. That is, the direction of the rows formed by the first interlaced part group was X-direction and the direction of the rows formed by the second interlaced part group was Y-direction (6) Winding Step The holding sealing material produced by punching the mat in the forming and cutting step (5) had a projected portion in one end surface of end surfaces parallel to the width direction and a recessed portion in the other end surface. The holding sealing material was wound on the outer circumference of an exhaust gas treatment body in such a manner that the projected portion and the recessed portion were fitted with each other. At this time, the main surface in which the interlaced parts were arranged so as to form the rows in the X-direction was set in the outside.

Figure 23:
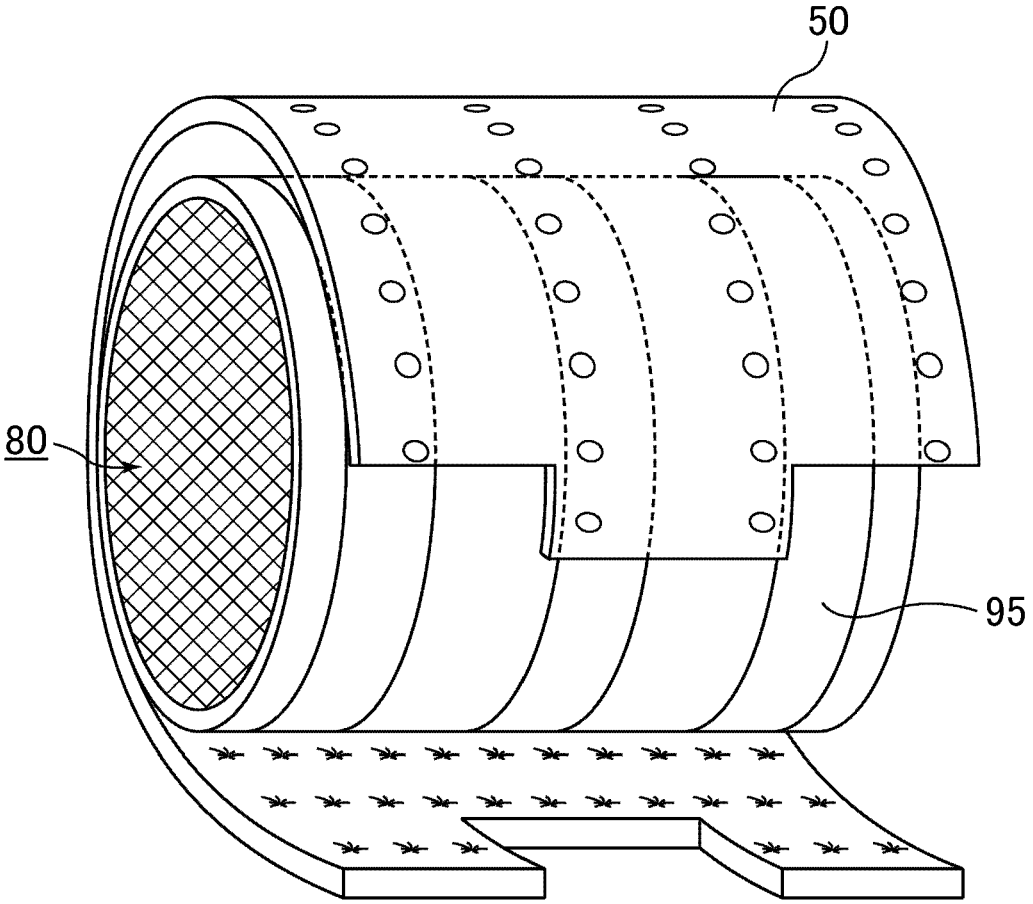
FIG. 23 is a perspective view schematically showing the condition of winding an auxiliary seal on the outer circumference of an exhaust gas treatment body of an exhaust gas purification apparatus of one embodiment of the present invention.

FIG. 23 is a perspective view schematically showing the condition of winding an auxiliary seal on the outer circumference of an exhaust gas treatment body of an exhaust gas purification apparatus of one embodiment of the present invention.

Before execution of the winding operation, as shown in FIG. 23, an auxiliary sheet 95 was wound on the outer circumference of an exhaust gas treatment body 80. The auxiliary seal is a pressure sensitive adhesion tape. If the holding sealing material was wound on the outer circumference of the exhaust gas treatment body on which the auxiliary seal was wound, the surface of the auxiliary seal was attached to the holding sealing material. Consequently, loosing of the holding sealing material once wound on the outer circumference of the exhaust gas treatment body could be prevented.

(7a) Stuffing Step

The exhaust gas treatment body on which the holding sealing material was wound in the winding step (6) was stuffed in a casing by a stuffing method (see FIG. 17 and FIG. 4).

(7b) Clamshell Step

The exhaust gas treatment body on which the holding sealing material was wound in the winding step (6) was set in a casing by a clamshell method (see FIG. 5).

Example 2

A mat and an exhaust gas purification apparatus were produced in the same manner as in Example 1, except that at the time of winding the holding sealing material on the exhaust gas treatment body in the winding step (6) in Example 1, the main surface in which interlaced parts were arranged to form rows in the Y-direction was set in the outside.

Comparative Example 1

A mat and an exhaust gas purification apparatus were produced in the same manner as in Example 1, except that the following needling step (3') was carried out in place of the needling step (3) in Example 1 and the following forming and cutting step (5') was carried out in place of the forming and cutting step (5) in Example 1.

(3') Needling Step

Figure 20A:
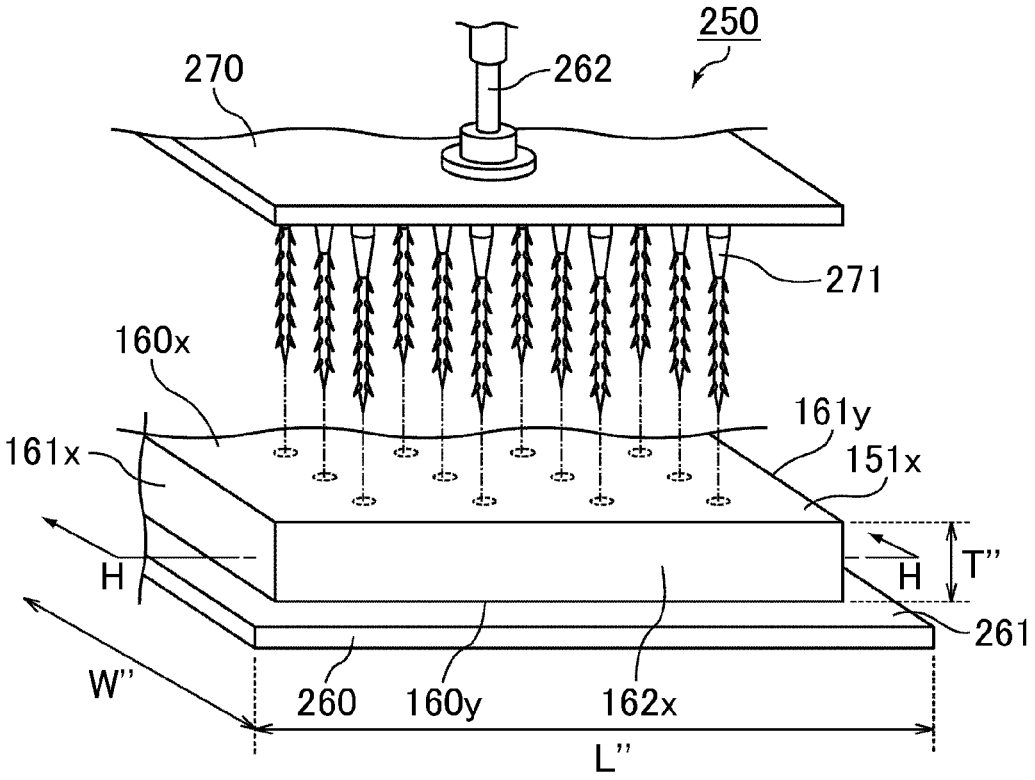
FIG. 20A is a perspective view schematically showing a needling apparatus and a precursor sheet to be used in a method for producing the mat of the present embodiment.

A needling apparatus having a constitution substantially the same as that of the needling apparatus shown in FIG. 20A was made ready.

Next, the precursor sheet was set on a mount surface of a supporting plate in such a manner that the width direction of the precursor sheet and needle rows were parallel.

Thereafter, a needle plate positioned above the supporting plate and the precursor sheet was moved down along the thickness direction of the precursor sheet, so that needles were penetrated from a first main surface to a second main surface and then the needles were pulled out of the precursor sheet.

The needling precursor sheet was produced in such a manner.

(5') Forming and Cutting Step

Using a punching apparatus, the mat was punched to produce a holding sealing material. At this time, the mat was punched to produce a holding sealing material in such a manner that the longitudinal direction of the holding sealing material was perpendicular to the width direction of the mat.

In the holding sealing material produced by punching the mat in this manner, there were a plurality of interlaced parts formed from points on the first main surface to points on the second main surface. The direction of rows formed by an interlaced part group was a direction parallel to the width direction of the holding sealing material. The width direction and longitudinal direction of the holding sealing material were orthogonal. That is, the direction of rows formed by an interlaced part group was X-direction.

Additionally, in the holding sealing material of Comparative Example 1, the interlaced parts were arranged so as to form rows in the X-direction in both main surfaces. Consequently, at the time of winding the holding sealing material on the exhaust gas treatment body in the winding step (6), even if either one of the main surfaces was set in the outside, the main surface in which the interlaced parts were arranged to form rows in the X-direction was set in the outside.

Comparative Example 2

A mat and an exhaust gas purification apparatus were produced in the same manner as in Comparative Example 1, except that the following forming and cutting step (5") was carried out in place of the forming and cutting step (5') in Comparative Example 1.

(5") Forming and Cutting Step

Using a punching apparatus, the mat was punched to produce a holding sealing material. At this time, the mat was punched to produce a holding sealing material in such a manner that the longitudinal direction of the holding sealing material was perpendicular to the width direction of the mat.

In the holding sealing material produced by punching the mat in this manner, there were a plurality of interlaced parts formed from points on the first main surface to points on the second main surface. The direction of rows formed by an interlaced part group was a direction perpendicular to the width direction of the holding sealing material. The width direction and longitudinal direction of the holding sealing material were orthogonal. That is, the direction of rows formed by an interlaced part group was Y-direction.

Additionally, in the holding sealing material of Comparative Example 2, the interlaced parts were arranged so as to form rows in the Y-direction in both main surfaces. Consequently, at the time of winding the holding sealing material on the exhaust gas treatment body in the winding step (6), even if either one of the main surfaces was set in the outside, the main surface in which the interlaced parts were arranged to form rows in the Y-direction was set in the outside.

Comparative Example 3

A mat and an exhaust gas purification apparatus were produced in the same manner as in Example 1, except that the following needling step (3") was carried out in place of the needling step (3) in Example 1.

(3") Needling Step

A needling apparatus having a constitution substantially the same as that of the needling apparatus shown in FIG. 20A was made ready.

Next, the precursor sheet was set on a mount surface of a supporting plate in such a manner that the width direction of the precursor sheet and needle rows were parallel.

Thereafter, a needle plate positioned above the supporting plate and the precursor sheet was moved down along the thickness direction of the precursor sheet, so that needles were penetrated from a first main surface to a second main surface and then the needles were pulled out of the precursor sheet.

Successively, the precursor sheet was turned back and the precursor sheet was set on the mount surface of the supporting plate in such a manner that the width direction of the precursor sheet and the needle rows were perpendicular.

Then, the needle plate positioned above the supporting plate and the precursor sheet was moved down along the thickness direction of the precursor sheet, so that the needles were penetrated from the second main surface to the first main surface and then the needles were pulled out of the precursor sheet.

The needling precursor sheet was produced in such a manner.

In the holding sealing material of Comparative Example 3, there were a plurality of interlaced parts formed from points on the first main surface to points on the second main surface. A plurality of the interlaced parts were constituted by an interlaced part group arranged so as to form rows in the X-direction and an interlaced part group arranged so as to form rows in the Y-direction.

Additionally, in the holding sealing material of Comparative Example 3, the interlaced parts were arranged so as to form rows in the X-direction and the Y-direction in both main surfaces. Consequently, at the time of winding the holding sealing material on the exhaust gas treatment body in the winding step (6), even if either one of the main surfaces was set in the outside, the main surface in which the interlaced parts were arranged to form rows in the X-direction and the Y-direction was set in the outside.

The following tests and evaluations were carried out for Examples 1 and 2 and Comparative Examples 1 to 3.

(Tensile Strength Measurement Test and Rupture Elongation Measurement Test)

First, each produced mat was punched out in a plane view dimension of length 150 mm×width 25 mm to obtain a test sample. At this time, in Examples 1 and 2 and Comparative Examples 1 and 3, each test sample was obtained by punching each mat in such a manner that the longitudinal direction of the test sample was perpendicular to the width direction of the mat. In Comparative Example 2, each test sample was obtained by punching each mat in such a manner that the longitudinal direction of the test sample was parallel to the width direction of the mat.

Each obtained test sample was set in a tensile strength measurement apparatus. Specifically, the test sample was fixed by using upper and lower portions of 50 mm each of the test sample as holding margins. That is, both ends in the longitudinal direction of the test sample were fixed.

Thereafter, one end in the longitudinal direction of the test sample was pulled upward at a rate of 10 mm/minute to rupture the test sample.

The maximum load at the time of pulling was measured as tensile strength (strength per basis weight (N/AD 1050)). Further, the elongation (average rupture elongation) in the longitudinal direction of the test sample at the rupture was measured. The measurement results are show in Table 1.

The tensile strength was evaluated with marks, "o " and "x". The evaluation results are shown in Table 2. In Table 2, the mark "o" in the item "tensile strength" indicates that the tensile strength was good and the mark "x" in the item "tensile strength" indicates that the tensile strength was insufficient. It was evaluated as follows: in the case where the strength per basis weight was 140 or higher, "tensile strength" was regarded as "o " and in the case where the strength per basis weight was lower than 140, "tensile strength" was regarded as "x".

The tensile strength expresses the strength of the mat and also an index of rupture resistance of the mat. The average rupture elongation is a value relevant to the winding property and it can be said that as the average rupture elongation is higher, the winding operation is carried out more easily.

TABLE 1

| | Average rupture elongation (%) | Strength per basis weight (N/AD1050) |
|---|---|---|
| Example 1 | 26.46 | 150 |
| Example 2 | 26.46 | 150 |
| Comparative Example 1 | 33.03 | 126 |

TABLE 1-continued

| | Average rupture elongation (%) | Strength per basis weight (N/AD1050) |
|---|---|---|
| Comparative Example 2 | 19.89 | 175 |
| Comparative Example 3 | 26.46 | 150 |

(Evaluation of Winding Property)

The easiness of the winding operation in the winding step (6) was evaluated with marks, "o" and "x". The evaluation results are shown in Table 2. In Table 2, the mark "o" in the item "winding property" indicates that the winding property was good and the mark "x" in the item "winding property" indicates that the winding property was inferior. It was evaluated as follows: in the case where the folding lines were properly formed by a plurality of the interlaced parts arranged in the X-direction, "winding property" was regarded as "o" and in the case where such folding lines were not formed properly, "winding property" was regarded as "x".

TABLE 2

| | Tensile Strength | Winding Property |
|---|---|---|
| Example 1 | ○ | ○ |
| Example 2 | ○ | ○ |
| Comparative Example 1 | X | ○ |
| Comparative Example 2 | ○ | X |
| Comparative Example 3 | ○ | X |

As shown in Table 2, the evaluations of "tensile strength" in Examples 1 and 2 were higher than the evaluation of "tensile strength" in Comparative Example 1.

Also, the evaluations of "winding property" in Examples 1 and 2 were higher than the evaluations of "winding property" in Comparative Examples 2 and 3.

Hereinafter, the respective evaluation results will be specifically described.

In Comparative Example 1, the evaluation of "tensile strength" is low. It is supposed that portions in which fibers are interlaced are present in low level in the elongation direction of the holding sealing material (that is, Y-direction) and therefore, the holding sealing material tends to be elongated and ruptured easily (see Table 1).

In contrast, the evaluation of "tensile strength" is higher in Examples 1 and 2 than the evaluation of "tensile strength" in Comparative Example 1. It is supposed that portions in which fibers are interlaced are present relatively high in the elongation direction of the holding sealing material (that is, Y-direction) and therefore, the holding sealing material is hardly elongated and ruptured.

In Comparative Examples 2 and 3, the evaluation of "winding property" is low. It is supposed that there is no interlaced part group arranged so as to form the rows in the X-direction or there are not only the interlaced part group arranged so as to form the rows in the X-direction but also the interlaced part group arranged so as to form the rows in the Y-direction and due to that, at the time of winding the holding sealing material on the outer circumference of the exhaust gas treatment body, either no folding line to be formed by a plurality of the interlaced parts arranged in the X-direction is present or such a folding line is difficult to be formed.

In contrast, the evaluation of "winding property" is higher in Examples 1 and 2 than the evaluation of "tensile strength" in Comparative Examples 2 and 3. It is supposed that there is no interlaced part group arranged so as to form the rows in the Y-direction but there is only the interlaced part group arranged so as to form the rows in the X-direction in either one side of the first main surface side and the second main surface side and due to that, at the time of winding the holding sealing material on the outer circumference of the exhaust gas treatment body, holding lines are easily formed by a plurality of the interlaced parts arranged in the X-direction.

(Second Embodiment)

The method for producing a mat of the present invention is not limited to the method for producing a mat of the first embodiment.

The mat in the present invention can be produced by the method described below.

(I) Mat Preparation Step

First, a first mat before lamination and a second mat before lamination are prepared.

The first mat before lamination and the second mat before lamination will be described with reference to FIG. 18A and FIG. 18B, as well as FIG. 19A and FIG. 19B.

Figure 18A:
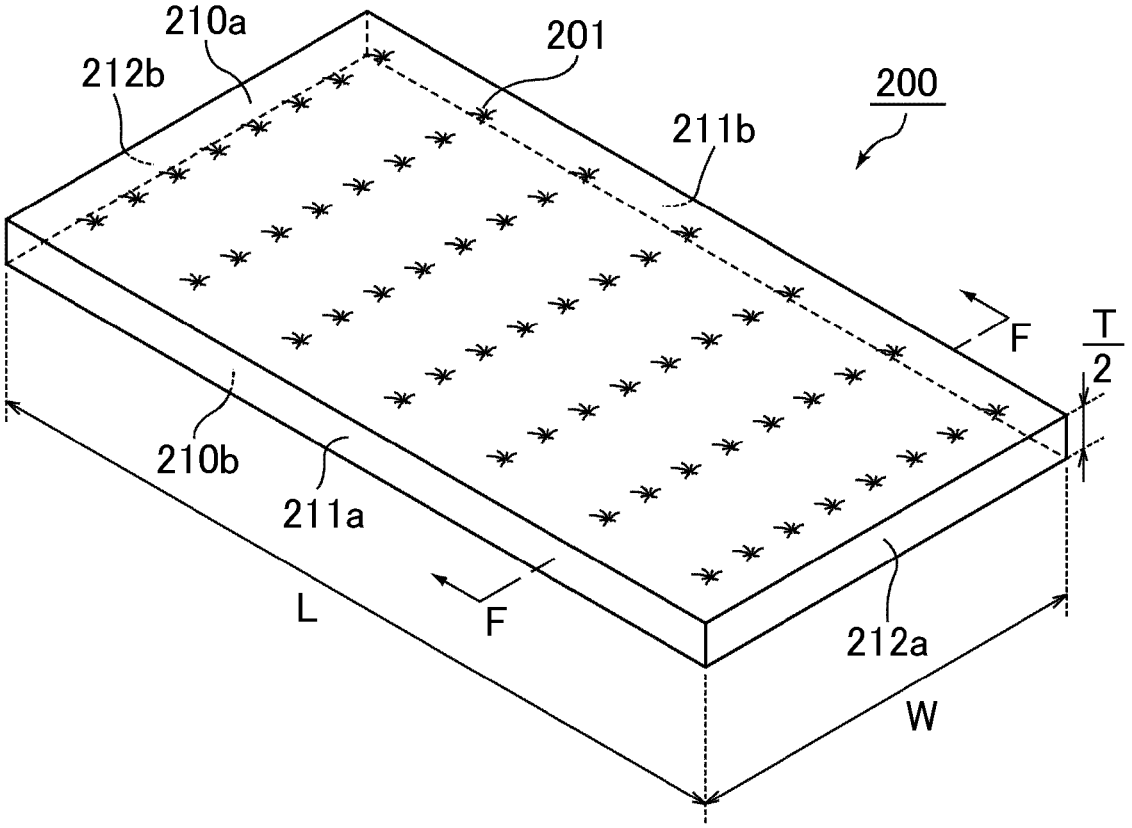
FIG. 18A is a perspective view schematically showing one example of a first mat before lamination of one embodiment of the present invention.

FIG. 18A is a perspective view schematically showing one example of a first mat before lamination of one embodiment of the present invention.

Figure 18B:
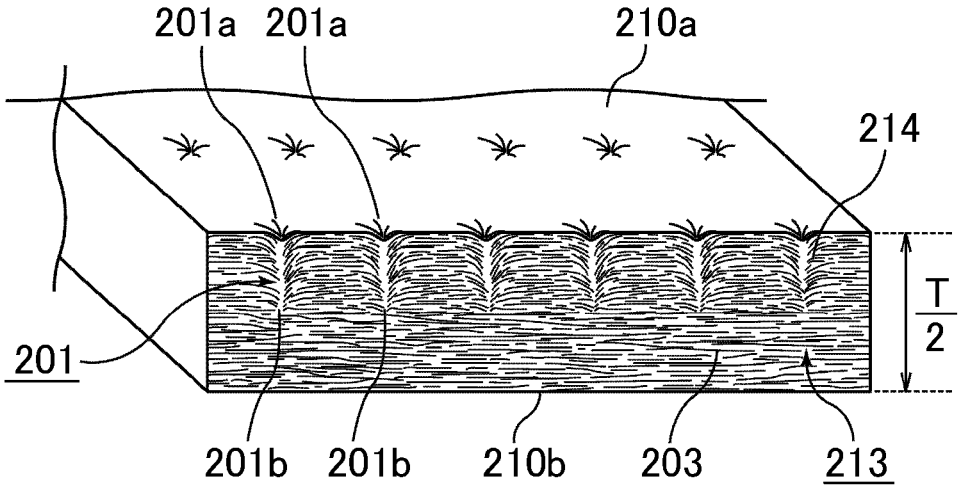
FIG. 18B is an F-F line cross-sectional view of the first mat before lamination shown in FIG. 18A.

FIG. 18B is an F-F line cross-sectional view of the first mat before lamination shown in FIG. 18A.

As shown in FIG. 18A, a first mat before lamination 200 has a main surface α (shown as 210*a* in FIG. 18A) and a main surface β (shown as 210*b* in FIG. 18A) facing to the main surface α (210*a*).

The first mat before lamination 200 has a first long side surface 211*a* and a second long side surface 211*b* facing to the first long side surface 211*a*.

Further, the first mat before lamination 200 has a first short side surface 212*a* and a second short side surface 212*b* facing to the first short side surface 212*a*.

As shown in FIG. 18B, a plurality of first interlacing starting points 201*a* are present on the main surface α (210*a*). Also, a plurality of first interlacing finishing points 201*b* are present between the main surface α (210*a*) and the main surface β (210*b*).

First interlaced parts 201 are formed from the first interlacing starting points 201*a* to the first interlacing finishing points 201*b*.

The distance from the first interlacing starting point 201*a* to the first interlacing finishing point 201*b* is substantially a half of the thickness (T/2) of the first mat before lamination 200.

As shown in FIG. 18A, the first interlaced parts 201 are arranged in substantially straight lines in the direction substantially perpendicular to the longitudinal direction of the first mat before lamination 200. The direction of rows formed by a first interlaced part group is a direction substantially perpendicular to the longitudinal direction of the first mat before lamination 200.

Other constitutions of the first mat before lamination 200 are the same as those of the mat 20 and therefore, their explanation is omitted. However, different from the mat 20, no second interlaced part is formed in the first mat before lamination 200.

Figure 19A:
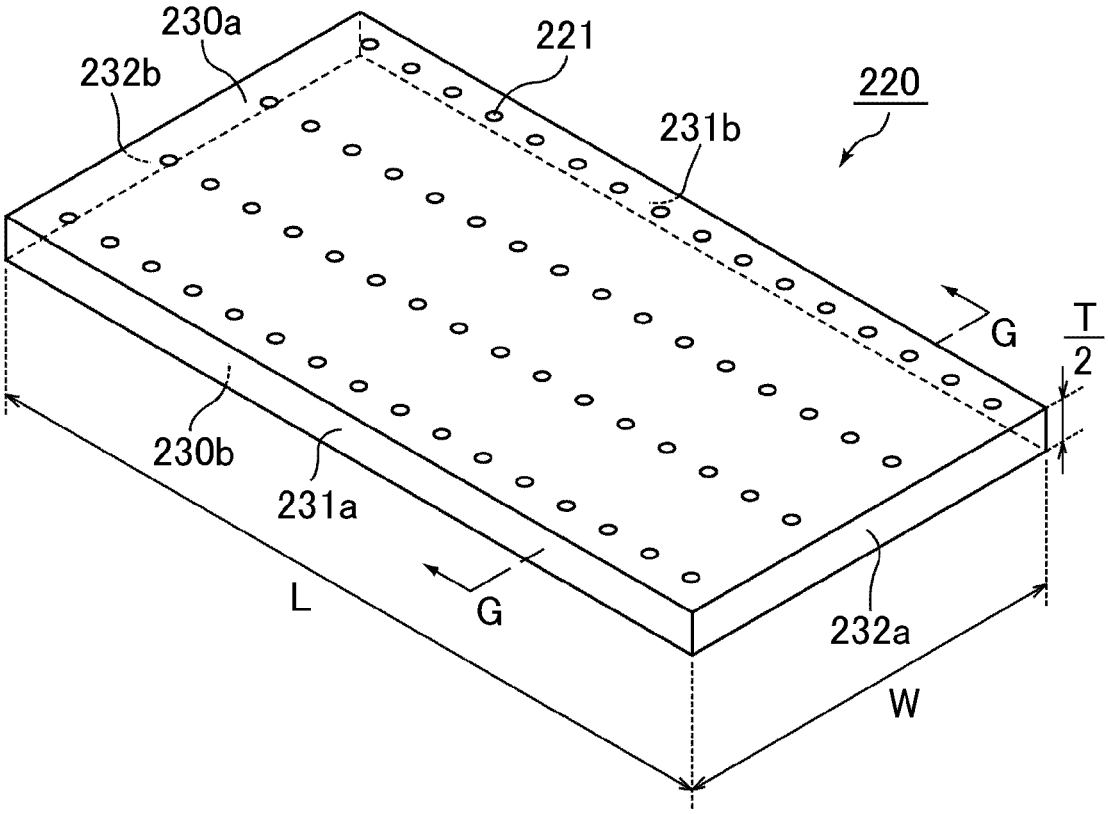
FIG. 19A is a perspective view schematically showing one example of a second mat before lamination of one embodiment of the present invention.

FIG. 19A is a perspective view schematically showing one example of a second mat before lamination of one embodiment of the present invention.

Figure 19B:
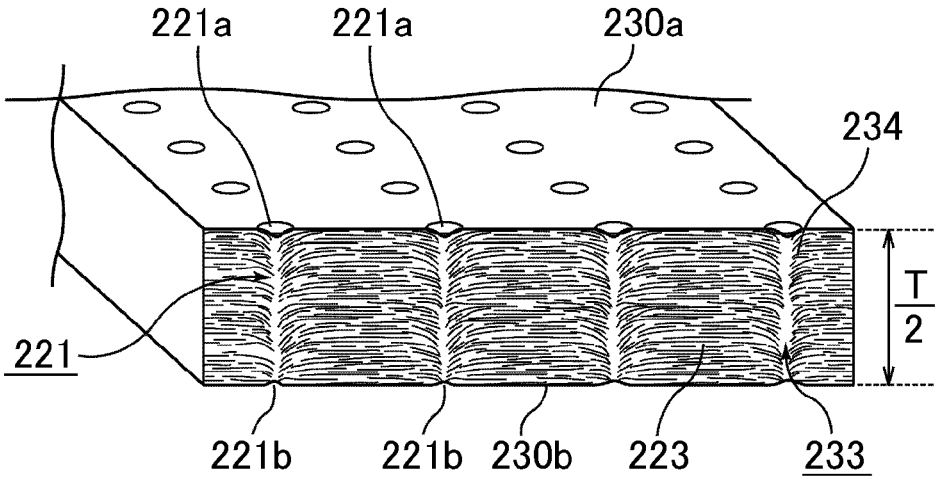
FIG. 19B is a G-G line cross-sectional view of the second mat before lamination shown in FIG. 19A.

FIG. 19B is a G-G line cross-sectional view of the second mat before lamination shown in FIG. 19A.

As shown in FIG. 19A, a second mat before lamination 220 has a main surface γ (shown as 230*a* in FIG. 19A) and a main surface δ (shown as 230*b* in FIG. 19A) facing to the main surface γ (230*a*).

The second mat before lamination 220 has a first long side surface 231*a* and a second long side surface 231*b* facing to the first long side surface 231*a*.

Further, the second mat before lamination 220 has a first short side surface 232*a* and a second short side surface 232*b* facing to the first short side surface 232*a*.

As shown in FIG. 19B, a plurality of second interlacing starting points 221*a* are present on the main surface γ (230*a*). Also, a plurality of second interlacing finishing points 221*b* are present on the main surface δ (230*b*).

Second interlaced parts 221 are formed from the second interlacing starting points 221*a* to the second interlacing finishing points 221*b*.

The distance from the second interlacing starting point 221*a* to the second interlacing finishing point 221*b* is equal to the thickness (T/2) of the second mat before lamination 220.

As shown in FIG. 19A, the second interlaced parts 221 are arranged in substantially straight lines in the direction substantially parallel to the longitudinal direction of the second mat before lamination 220. The direction of rows formed by a second interlaced part group is a direction substantially parallel to the longitudinal direction of the second mat before lamination 220.

Other constitutions of the second mat before lamination 220 are the same as those of the mat 20 and therefore, their explanation is omitted. However, different from the mat 20, no first interlaced part is formed in the second mat before lamination 220.

The first mat before lamination can be produced through (1) Spinning step, (2) Compaction step, (3-1) First needling step, and (4) Firing step.

On the other hand, the second mat before lamination can be produced through (1) Spinning step, (2) Compaction step, (3') Third needling step, and (4) Firing step.

Herein, (3') Third needling step will be described.

Figure 20B:
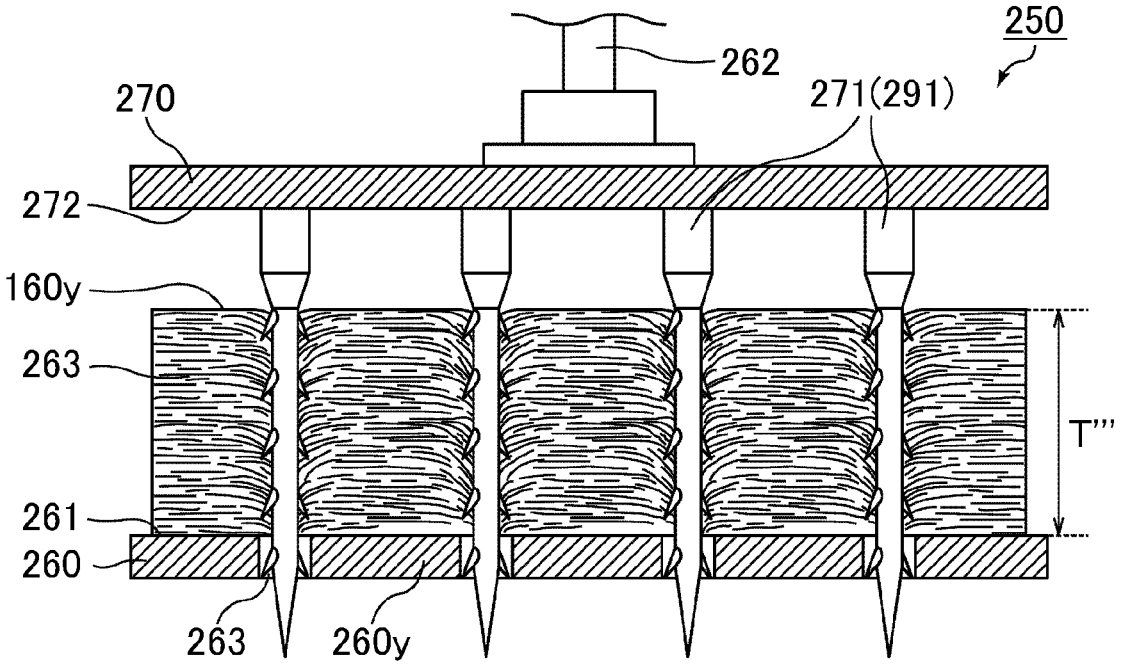
FIG. 20B is an H-H line cross-sectional view of a needling apparatus and a precursor sheet in the case where needles are inserted in the precursor sheet in the method for producing a mat of the present embodiment.

FIG. 20A is a perspective view schematically showing a needling apparatus and a precursor sheet to be used in a method for producing a mat of the present embodiment and FIG. 20B is an H-H line cross-sectional view of a needling apparatus and a precursor sheet in the case where needles are inserted in the precursor sheet in the method for producing a mat of the present embodiment.

A needling apparatus 250 shown in FIG. 20A is constituted by a supporting plate 260 having a mount surface 261 capable of supporting a precursor sheet 151*x* and a needle plate 270 attached to the tip end of a piston 262 provided facing to the mount surface 261 of the supporting plate 260 and capable of reciprocating in the piercing direction (the thickness direction of the precursor sheet 151*x*, the direction shown by both arrows T" in FIG. 20A and FIG. 20B).

A plurality of needles 271 are attached at prescribed intervals in an opposite surface 272 of the needle plate 270 facing to the supporting plate 260, the shape of which is like a pinholder.

The needles 271 are thinly tapered needles and barbs are formed in the needle surface.

The needles 271 are aligned at prescribed intervals in substantially straight lines along the width direction W" of the supporting plate 260 and a plurality of needle rows 291 are formed. A plurality of the needle rows 291 are substantially parallel to one another. The distance between neighboring two needles 271 in the width direction W" is all substantially equal and the distance between neighboring two needle rows 291 is also all substantially equal. The distance between neighboring two needles 271 in the width direction W" is narrower than the distance between neighboring two needle rows 291.

The precursor sheet 151*x* has a first main surface 160*x*, a second main surface 160*y* facing to the first main surface 160*x*, a first long side surface 161*x*, a second long side surface 161*y* facing to the first long side surface 161*x*, a first short side surface 162*x*, a second short side surface (not illustrated) facing to the first short side surface 162*x* and is a sheet constituted by interlacing an inorganic fiber precursor 263 to be converted into inorganic fibers by firing.

Through holes 263 are provided in the position where the needles 271 of the needle plate 270 can be penetrated in the supporting plate 260.

Therefore, when the needle plate 270 comes close to the supporting plate 260, since the needles 271 are penetrated into the through holes 263, the needle plate 270 can be approached to the supporting plate 260 to an extent that the mount surface 261 and the opposite surface 272 are brought into contact with each other.

In the case where needling treatment is carried out by using the needling apparatus 250 described above, first, the sheet 151*x* is set on the mount surface 261 of the supporting plate 260 as shown in FIG. 20A.

Next, the needle plate 270 is moved up and down along the thickness direction of the sheet 151*x*.

Accordingly, as shown in FIG. 20B, the needles 271 are penetrated from the first main surface 160*x* to the second main surface 160*y* of the sheet 151*x* and the inserted needles 271 are pulled out of the sheet 151*x* to complete the needling treatment.

Consequently, a needling precursor sheet is produced.

(I) In the mat preparation step, the first mat before lamination and the second mat before lamination as described above are prepared.

In the second embodiment, there is described the case where the first interlacing finishing points 201*b* are formed between the main surface α (210*a*) and the main surface β (210*b*) (see FIG. 18B), and the second interlacing finishing points 221*b* are formed on the main surface δ (230*b*) (see FIG. 19B).

That is, in the second embodiment, the first interlaced parts 201 are formed from points on the main surface α (210*a*) to points present between the main surface α (210*a*) and the main surface β (210*b*). Further, the second interlaced parts 221 are formed from points on the main surface γ (230*a*) to points on the main surface δ (230*b*).

However, in the present invention, the first interlaced parts of the first mat before lamination and the second interlaced parts of the second mat before lamination are not limited to those of this example.

In the present invention, the first interlaced parts may be formed from points on the main surface α to points on the main surface β, and the second interlaced parts may be formed from points on the main surface γ to points present between the main surface γ and the main surface δ.

Further, the first interlaced parts may be formed from points on the main surface α to points present between the main surface α and the main surface β, and the second interlaced parts may be formed from points on the main surface γ to points present between the main surface γ and the main surface δ.

Further, the first interlaced parts may be formed from points on the main surface α to points on the main surface β, and the second interlaced parts may be formed from points on the main surface γ to points on the main surface δ.

(II) Lamination Step

Successively, the main surface β (210*b*) of the first mat before lamination 200 and the main surface δ (230*b*) (or the main surface γ (230*a*)) of the second mat before lamination 220, both mats are prepared in the mat preparation step (1), are laminated to each other by an adhesion means such as an adhesive or a double-sided tape.

At this time, the first mat before lamination 200 and the second mat before lamination 220 are laminated in such a manner that the rows formed by the first interlaced part group and the rows formed by the second interlaced part group are substantially orthogonal.

In the present embodiment, the sizes of the first mat before lamination 200 and the second mat before lamination 220 are substantially the same. Consequently, the first mat before lamination 200 and the second mat before lamination 220 may be laminated in such a manner that the long side surface of the first mat before lamination 200 and the long side surface of the second mat before lamination 220 can be on substantially the same plane, and the short side surface of the first mat before lamination 200 and the short side surface of the second mat before lamination 220 can be on substantially the same plane.

As a result, a mat substantially same as the mat 20 of the first embodiment can be produced.

In the lamination step of the present embodiment, there is described the case where the first mat before lamination 200 and the second mat before lamination 220 are laminated in such a manner that the rows formed by the first interlaced part group and the rows formed by the second interlaced part group are substantially orthogonal.

However, the lamination step of the present invention is not limited to this example. In the lamination step of the present invention, at the time of laminating the first mat before lamination and the second mat before lamination, the smaller angle of angles formed between the direction of the rows formed by the first interlaced part group and the direction of the rows formed by the second interlaced part group is adjusted to desirably from about 60° to about 90°, more desirably from about 85° to about 90°, and even more desirably about 90° as it is in the present embodiment. If the smaller angle of angles formed between the direction of the rows formed by the first interlaced part group and the direction of the rows formed by the second interlaced part group is not narrower than about 60°, it may become easier to sufficiently solve the problems of the conventional techniques as describe above.

Figure 21:
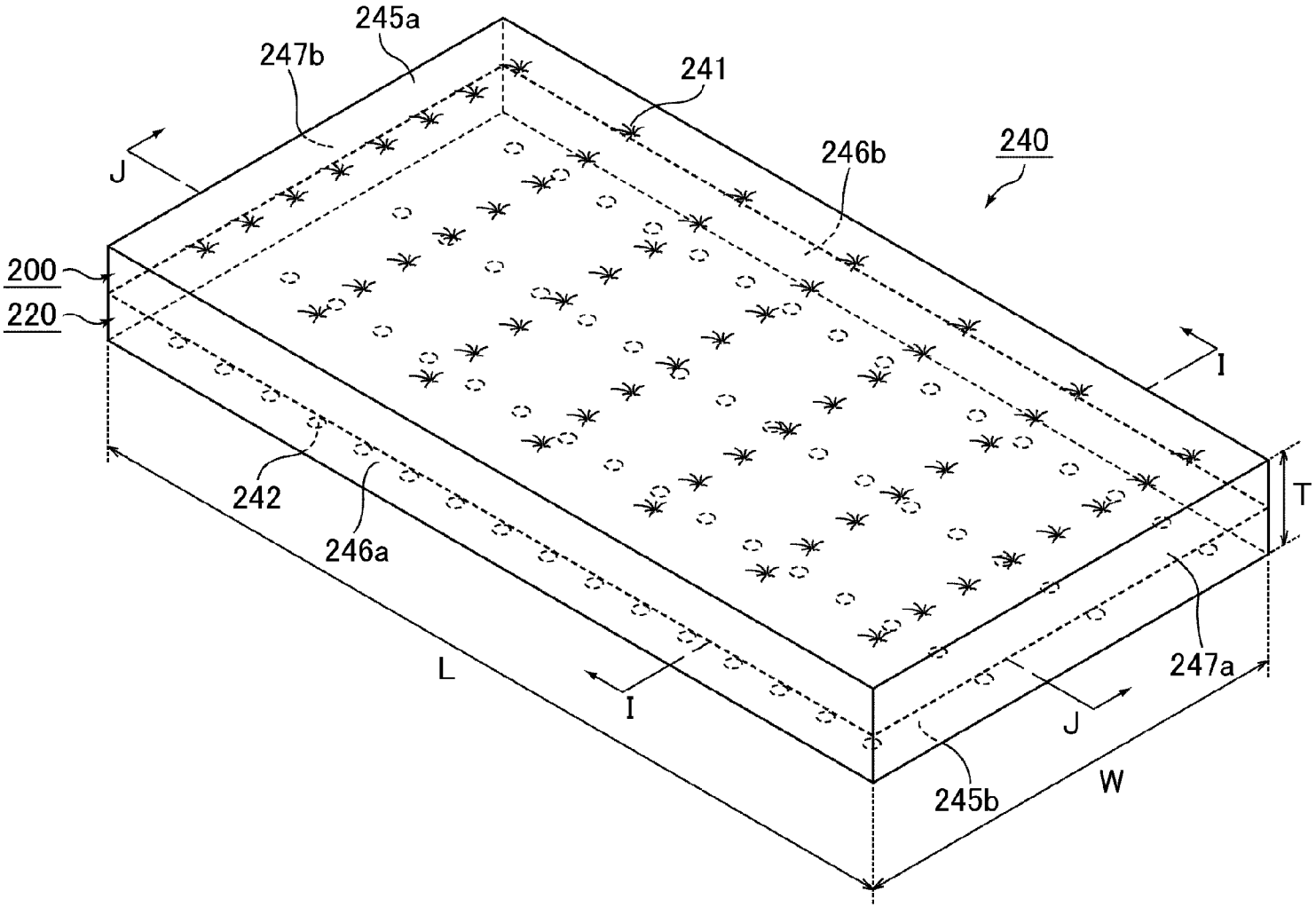
FIG. 21 is a perspective view schematically showing one example of a mat of one embodiment of the present invention.

FIG. 21 is a perspective view schematically showing one example of a mat of one embodiment of the present invention.

Figure 22A:
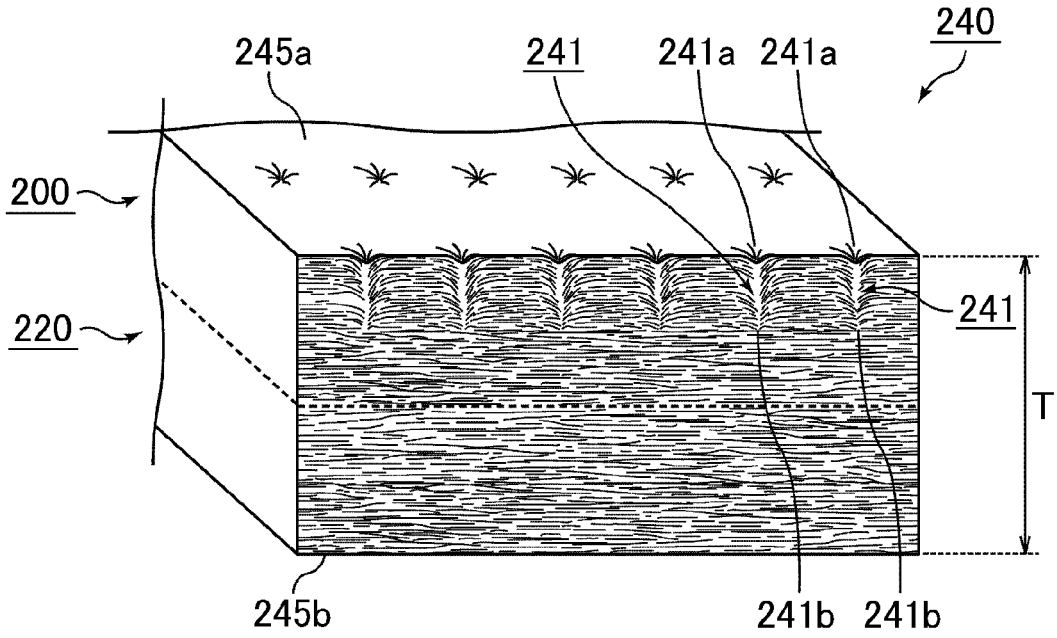
FIG. 22A is an I-I line cross-sectional view of the mat shown in FIG. 21.
Figure 22B:
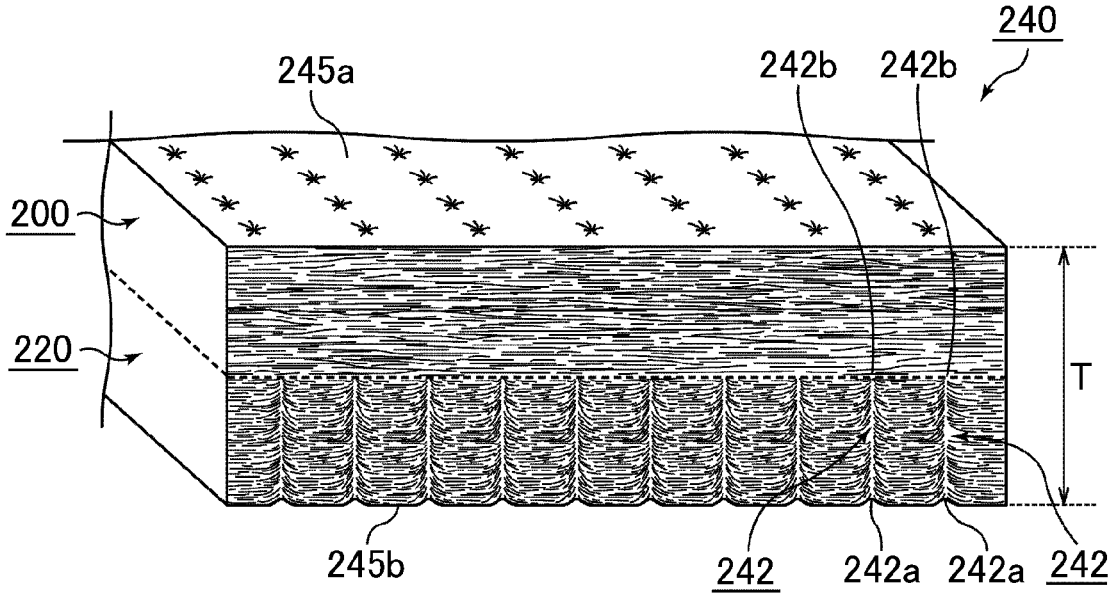
FIG. 22B is a J-J line cross-sectional view of the mat shown in FIG. 21.

FIG. 22A is an I-I line cross-sectional view of the mat shown in FIG. 21 and FIG. 22B is a J-J line cross-sectional view of the mat shown in FIG. 21.

FIG. 21 shows a mat 240 of the second embodiment.

As shown in FIG. 21, the mat 240 has a first main surface 245*a* and a second main surface 245*b* facing to the first main surface 245*a*.

Further, the mat 240 also has a first long side surface 246*a* and a second long side surface 246*b* facing to the first long side surface 246*a*.

Still further, the mat 240 also has a first short side surface 247*a* and a second short side surface 247*b* facing to the first short side surface 247*a*.

As shown in FIG. 22A, a plurality of first interlacing starting points 241*a* are present on the first main surface 245*a*. Also, a plurality of first interlacing finishing points 241*b* are present between the first main surface 245*a* and the second main surface 245*b*.

First interlaced parts 241 are formed from the first interlacing starting points 241*a* to the first interlacing finishing points 241*b*.

The distance from the first interlacing starting point 241*a* to the first interlacing finishing point 241*b* is substantially one fourth of the thickness T of the mat 240.

As shown in FIG. 22B, a plurality of second interlacing starting points 242*a* are present on the second main surface 245*b*. Also, a plurality of second interlacing finishing points 242*b* are present between the first main surface 245*a* and the second main surface 245*b*.

Second interlaced parts 242 are formed from the second interlacing starting points 242*a* to the second interlacing finishing points 242*b*.

The distance from the second interlacing starting point 242*a* to the second interlacing finishing point 242*b* is substantially a half of the thickness T of the mat 240.

The mat 240 is produced by laminating the first mat before lamination 200 and the second mat before lamination 220 in the lamination step (II).

The main surface α (210*a*) of the first mat before lamination 200 becomes the first main surface 245*a* of the mat 240, and the main surface γ (230*a*) of the second mat before lamination 220 becomes the second main surface 245*b* of the mat 240.

Also, the first interlaced parts 201 of the first mat before lamination 200 becomes the first interlaced parts 241 of the mat 240, and the second interlaced parts 221 of the second mat before lamination 220 becomes the second interlaced parts 242 of the mat 240.

Additionally, in the present invention, in the case where the first interlaced parts are formed from the points on the main surface α to the points on the main surface β, the main surface α and the main surface β are not particularly distinguished from each other, and the main surface α may sometimes be referred to as the main surface β. Further, in the case where the second interlaced parts are formed from the points on the main surface γ to the points on the main surface δ, the main surface γ and the main surface δ are not particularly distinguished from each other, and the main surface γ may sometimes be referred to as the main surface δ.

Similarly to the mat of the first embodiment, the mat of the present embodiment tends to exert the effects (1) to (6).

Further, according to the method for producing a mat of the present embodiment, a mat of the present embodiment having the above constitution and effects tend to be preferably produced.

Other Embodiments

The mat of the present invention may be a binder mat as described in the first embodiment of the present invention, and in the case where a binder mat is produced, it may be produced by carrying out the following steps (A) to (C).

(A) Impregnation Step

First, an organic binder solution containing an organic binder described in the first embodiment of the present invention is prepared.

After that, the entire of a mat produced though the firing step is evenly impregnated with the organic binder solution by flow-coating or the like to produce an impregnated mat.

Additionally, the organic binder solution is produced by dissolving the organic binder in a solvent such as water or an organic solvent or dispersing the organic binder in a dispersant such as water.

It is desirable that the concentration of the organic binder solution is properly adjusted so as to have a total amount of the organic binder contained in the entire binder mat produced through the following of from about 0.5 wt % to about 20 wt % in the weight of the entire binder mat. If the total amount of the organic binder contained in the entire binder mat is not less than about 0.5 wt % in the weight of the entire binder mat, the bulk of the mat tends to be suppressed. On the other hand, if the total amount of the organic binder in the entire binder mat is not more than about 20 wt % in the weight of the entire binder mat, the mat tends to be hard and the winding property tends to be deteriorated.

(B) Suction Step

Next, the excess organic binder solution is removed from the impregnated mat by suction using a suction apparatus or the like.

Additionally, the suction step is not necessarily carried out and, for example, if the amount of the organic binder solution contained in the impregnated mat is slight, after the impregnation step, the obtained impregnated mat may be directly subjected to the following drying step.

(C) Drying Step

Thereafter, the solvent or the like contained in the organic binder solution remained in the impregnated mat is volatilized by using a hot air drying device or the like while the impregnated mat is compacted.

Accordingly, a binder mat is produced.

The mat of the present invention may further contain an expansive material.

In a holding sealing material using a mat containing an expansive material, since the expansive material is more likely to be expanded by high temperature exhaust gas at the time of using an exhaust gas purification apparatus, the mat tends to exhibit high holding force.

Examples of the expansive material include expansive vermiculite, bentonite, and expansive graphite.

In the method for producing a mat of the present invention, the precursor sheet produced by layering inorganic fiber precursor is used.

However, in place of the precursor sheet, a precursor sheet made from inorganic fibers (hereinafter, also referred to as inorganic fiber sheet) may be used. For example, the mat of the present invention can be produced by using the inorganic fiber sheet in place of the precursor sheet used in the needling step (3) in the first embodiment of the present invention.

The inorganic fiber sheet may be produced by firing the precursor sheet obtained by layering the inorganic fiber precursor described in the first embodiment of the present invention.

Further, the inorganic fiber sheet may be produced by employing a centrifugal method.

In the case of employing the centrifugal method, inorganic fibers are produced by, first, supplying a molten raw material such as molten silica or molten alumina to the inside of a cylinder having a large number of small pores in the circumferential wall and capable of rotating while heating the cylinder and rotating the cylinder at a high rate; discharging the supplied molten raw material outside through the small pores by centrifugal force; stretching the discharged molten raw material by heating with a burner provided in the periphery of the cylinder; and cooling the stretched fibrous molten raw material.

An inorganic fiber sheet can be produced by compacting the produced inorganic fibers.

The inorganic fibers constituting the inorganic fiber sheet may be inorganic fibers having the same constitution (type, composition, average fiber length, and average fiber diameter) as that of the inorganic fibers constituting the mat of the present invention.

A catalyst may be deposited on the exhaust gas treatment body constituting the exhaust gas purification apparatus of the present invention.

Examples of the catalyst include noble metals such as platinum, palladium, and rhodium; alkali metals such as potassium and sodium; alkaline earth metals such as barium; and metal oxides such as $CeO_2$. These catalysts may be used alone or two or more of them may be used in combination.

Examples of a method of depositing a catalyst on the exhaust gas treatment body include a method of forming a catalyst carrier layer made from an alumina film on the surface of the exhaust gas treatment body and depositing a catalyst on the alumina film, in addition to a method of impregnating the exhaust gas treatment body with a solution containing a catalyst and thereafter heating the exhaust gas treatment body.

An indispensable constituent feature for the mat of the present invention is that the direction of the rows formed by the first interlaced part group and the direction of the rows formed by the second interlaced part group are different from each other.

Further, an indispensable constituent feature for the method for producing a mat of the present invention is that the first mat before lamination and the second mat before lamination are laminated to each other by laminating the main face β of the first mat before lamination and the main face δ of the second mat before lamination in such a manner that the direction of the rows formed by a plurality of points on the first main face in which the needles are inserted in the first needling step and the direction of the rows formed by a plurality of points on the second main face in which the needles are inserted in the second needling step may be different from each other, or the direction of the rows formed by the first interlaced part group of the first mat before lamination and the direction of the rows formed by the second interlaced part group of the second mat before lamination may be different from each other.

Desired effects tend to be caused by properly combining the indispensable constituent features with various constitutions (e.g. composition of inorganic fibers, fiber length of inorganic fibers, etc.) described in the first embodiment, the second embodiment, and the other embodiments.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mat comprising:

inorganic fibers;

a first main surface;

a second main surface;

a first interlaced part group including a plurality of first interlaced parts arranged in rows along the first main surface, each of the plurality of first interlaced ports being constituted by interlacing the inorganic fibers with one another and formed from a starting point on the first main surface to a finishing point present between the first main surface and the second main surface, the plurality of first interlaced parts within each row of the first interlaced group being not arranged on substantially straight lines, all of the plurality of first interlaced parts within each row of the first interlaced part group being provided within respective first stripe regions each having a width of 6 mm, each first stripe region of the first stripe regions being spaced apart by a first open region from each adjacent first stripe region of the first stripe regions such that no first interlaced parts of the plurality of first interlaced parts are provided in the first oven region;

a second interlaced part group including a plurality of second interlaced parts arranged in rows alone the second main surface, each of the plurality of second interlaced parts being constituted by interlacing the inorganic fibers with one another and formed from a starting point on the second main surface to a finishing point present between the first main surface and the second main surface, the plurality of second interlaced parts within each row of the second interlaced group being not arranged on substantially straight lines, all of the plurality of second interlaced parts within each row of the second interlaced part group being provided within respective second stripe regions each having a width of 6 mm, each second stripe region of the second stripe regions being spaced apart by a second open region from each adjacent second stripe region of the second stripe regions such that no second interlaced parts of the plurality of second interlaced parts are provided in the second open region; and a direction of rows formed by the first interlaced part group along the first main surface and a direction of rows formed by the second interlaced part group along the second main surface being different from each other, wherein an angle formed between the direction of the rows formed by the first interlaced part group and the direction of the rows formed by the second interlaced part group is from about 60° to about 90° when viewed in a thickness direction of the mat.

2. The mat according to claim 1, wherein the angle formed between the direction of the rows formed by the first interlaced part group and the direction of the rows formed by the second interlaced part group is from about 85° to about 90° when viewed in the thickness direction of the mat.

3. The mat according to claim 1, further comprising an organic binder.

4. The mat according to claim 1, wherein the inorganic fibers include alumina fibers, ceramic fibers, alumina-silica fibers, silica fibers, glass fibers, bio-soluble fibers, or a combination thereof.

5. The mat according to claim 1, wherein a formation density of a total of the first interlaced parts and the second interlaced parts is from about 1 interlaced part/$cm^2$ to about 60 interlaced part/$cm^2$.

6. The mat according to claim 1, wherein each of the first interlaced parts is formed from a first interlacing starting point to a first interlacing finishing point, each of the second interlaced parts is formed from a second interlacing starting point to a second interlacing. finishing point, and a shortest distance between one first interlacing starting point and another first interlacing starting point closest to the former is from about 1 mm to about 10 mm, and a shortest distance between one second interlacing starting point and another second interlacing starting point closest to the former is from about 1 mm to about 10 mm.

7. The mat according to claim 1, wherein each of the first interlaced parts is formed from a first interlacing starting point to a first interlacing finishing point, each of the second interlaced parts is formed from a second interlacing starting point to a second interlacing finishing point, and a diameter of the first interlacing starting point is from about 0.1 mm to about 2 mm, and a diameter of the second interlacing starting point is from about 0.1 mm to about 2 mm.

8. The mat according to claim 1, wherein the direction of the rows of the plurality of first interlaced parts is defined as being along a line that extends along the first main surface from one first interlaced part to a closest adjacent first interlaced part, and wherein the direction of the rows of the plurality of second interlaced parts is defined as being along a line that extends along the second main surface from one second interlaced part to a closest adjacent second interlaced part.

9. The mat according to claim 1, wherein a thickness of the mat is defined as T, a distance between the first interlacing starting point and the first interlacing finishing point is defined as $T_1$, a distance between the second interlacing starting point and the second interlacing finishing point is defined as $T_2$, and wherein the following relationships are satisfied:

$$T\times \text{ about } 0.1 \leq T_1 < T\times \text{ about } 0.5; \text{ and}$$

$$T\times \text{ about } 0.1 \leq T_2 < T\times \text{ about } 0.5.$$

10. The mat according to claim 1, wherein each first stripe region of the first stripe regions extends linearly from a first side edge of the first main surface to an opposite second side edge of the first main, surface, and wherein each first stripe region of the second stripe regions extends linearly from a first side edge of the second main surface to an opposite second side edge of the second main surface.

11. The mat according to claim 10, wherein the first open region extends linearly from the first side edge of the first main surface to the opposite second side edge of the first main surface, and wherein the second open region extends linearly from the first side edge of the second main surface to the opposite second side edge of the second main surface.

12. The mat according to claim 1, wherein the first open region extends linearly from a first side edge of the first main surface to an opposite second side edge of the first main surface, and wherein the second open region extends linearly from a first side edge of the second main surface to an opposite second side edge of the second main surface.

* * * * *

UNITED STATES PATENT AND TRADEMARK OFFICE

CERTIFICATE OF CORRECTION

PATENT NO. : 9,133,569 B2
APPLICATION NO. : 13/338145
DATED : September 15, 2015
INVENTOR(S) : Kanaya It is certified that error appears in the above-identified patent and that said Letters Patent is hereby corrected as shown below:

In the claims

Column 42, line 56, claim 1, delete “ports” and insert --parts--.

Column 43, line 3, claim 1, delete “oven” and insert --open--; line 5, delete “alone” and insert --along--; line 53, claim 6, delete the “.” between “interlacing” and “finishing”.

Signed and Sealed this
Fifth Day of April, 2016

Michelle K. Lee

Michelle K. Lee
*Director of the United States Patent and Trademark Office*